US011466828B2

(12) United States Patent
Dolan

(10) Patent No.: US 11,466,828 B2
(45) Date of Patent: Oct. 11, 2022

(54) COMBINED LIGHTING DEVICE WITH AN INTEGRATED DIMMING CONTROL SYSTEM

(71) Applicant: DOLAN DESIGNS INCORPORATED, Portland, OR (US)

(72) Inventor: Patrick S. Dolan, Portland, OR (US)

(73) Assignee: DOLAN DESIGNS INCORPORATED, Portland, OR (US)

( * ) Notice: Subject to any disclaimer, the term of this patent is extended or adjusted under 35 U.S.C. 154(b) by 0 days.

(21) Appl. No.: 17/074,266

(22) Filed: Oct. 19, 2020

(65) Prior Publication Data

US 2021/0051788 A1 Feb. 18, 2021

Related U.S. Application Data

(63) Continuation of application No. 16/172,000, filed on Oct. 26, 2018, now Pat. No. 10,813,199, which is a (Continued)

(51) Int. Cl.
*F21S 8/06* (2006.01)
*F21V 21/008* (2006.01)

(Continued)

(52) U.S. Cl.
CPC ..... *F21S 8/065* (2013.01); *F21S 8/06* (2013.01); *F21V 21/008* (2013.01);

(Continued)

(58) Field of Classification Search
CPC ..... F21S 8/06; F21S 8/065; F21V 21/008; F21V 21/02; F21V 21/025; F21V 21/10;

(Continued)

(56) References Cited

U.S. PATENT DOCUMENTS 4,719,446 A 1/1988 Hart
4,918,690 A 4/1990 Markkula (Continued)

FOREIGN PATENT DOCUMENTS

WO 2013120108 8/2013
WO 2016050872 4/2016
WO 2017064090 4/2017

OTHER PUBLICATIONS

Amazon.Com, Casablanca Inteli Touch III Handheld Remote Control, First Available Nov. 1, 2010.

(Continued)

*Primary Examiner* — Jason Crawford
(74) *Attorney, Agent, or Firm* — Schwabe Williamson & Wyatt

(57) ABSTRACT

A lighting system that includes a lighting device and a dimming controller. The lighting device has a support structure that supports multiple lighting zones. Each lighting zone including one or more lighting sources. The dimming controller is in communication with multiple dimmers supported by the lighting device. Each of the lighting sources is coupled to a corresponding dimmer from the multiple dimmers. The dimming controller is configured to communicate a controlled setting for one or more of the lighting zones to the multiple dimmers. Other embodiments may be described and/or claimed.

38 Claims, 70 Drawing Sheets

Related U.S. Application Data continuation-in-part of application No. 15/870,515, filed on Jan. 12, 2018, now Pat. No. 10,278,269, which is a continuation of application No. 15/392,216, filed on Dec. 28, 2016, now Pat. No. 9,907,149, which is a continuation-in-part of application No. 14/695,464, filed on Apr. 24, 2015, now Pat. No. 9,538,622, which is a continuation of application No. 13/762,186, filed on Feb. 7, 2013, now Pat. No. 9,035,572.

(60) Provisional application No. 62/614,102, filed on Jan. 5, 2018, provisional application No. 61/596,101, filed on Feb. 7, 2012.

(51) Int. Cl.

| | |
|---|---|
| ***H05B 47/19*** | (2020.01) |
| ***H05B 47/175*** | (2020.01) |
| ***H05B 45/31*** | (2020.01) |
| ***H05B 35/00*** | (2006.01) |
| ***F21V 23/00*** | (2015.01) |
| *F21Y 115/10* | (2016.01) |
| *F21Y 103/10* | (2016.01) |
| *F21Y 113/00* | (2016.01) |
| *H05B 47/195* | (2020.01) |

(52) U.S. Cl.

CPC ..... *F21V 23/001* (2013.01); *H05B 35/00* (2013.01); *H05B 45/31* (2020.01); *H05B 47/175* (2020.01); *H05B 47/19* (2020.01); *F21Y 2103/10* (2016.08); *F21Y 2113/00* (2013.01); *F21Y 2115/10* (2016.08); *H05B 47/195* (2020.01)

(58) Field of Classification Search

CPC ..... F21V 21/12; F21V 7/005; F21Y 2103/00; F21Y 2103/10

See application file for complete search history.

(56) References Cited

U.S. PATENT DOCUMENTS

| | | | | |
|---|---|---|---|---|
| 5,059,871 | A | 10/1991 | Pearlman | |
| 5,191,265 | A | 3/1993 | D'Aleo | |
| 5,205,644 | A * | 4/1993 | Bayer | F21V 15/02 362/451 |
| 5,530,322 | A | 6/1996 | Ference | |
| 5,736,965 | A | 4/1998 | Mosebrook | |
| 5,838,226 | A | 11/1998 | Houggy | |
| 5,844,888 | A | 12/1998 | Markkula | |
| 5,848,054 | A | 12/1998 | Mosebrook | |
| 5,868,489 | A * | 2/1999 | Fuller | F21S 8/06 362/147 |
| 5,905,442 | A | 5/1999 | Mosebrook | |
| 5,909,087 | A | 6/1999 | Bryde | |
| 5,967,640 | A | 10/1999 | Moriyama | |
| 6,046,550 | A | 4/2000 | Ference | |
| 7,227,341 | B2 | 6/2007 | Downey | |
| 7,345,998 | B2 | 3/2008 | Cregg | |
| 8,279,079 | B2 | 10/2012 | Bergman | |
| 8,467,887 | B2 | 6/2013 | Jung | |
| D691,097 | S | 10/2013 | Lind | |
| 9,035,572 | B1 * | 5/2015 | Dolan | H05B 35/00 315/307 |
| 9,538,622 | B1 * | 1/2017 | Dolan | H05B 47/19 |
| 9,907,149 | B1 * | 2/2018 | Dolan | F21V 21/008 |
| 10,278,269 | B2 * | 4/2019 | Dolan | H05B 47/175 |
| 10,492,263 | B2 * | 11/2019 | Miller | H05B 45/00 |
| 10,775,018 | B1 * | 9/2020 | Grove | G02B 6/0036 |
| 10,813,199 | B2 * | 10/2020 | Dolan | F21S 8/065 |
| 2004/0252521 | A1 * | 12/2004 | Clark | F21V 13/04 362/554 |
| 2006/0076908 | A1 | 4/2006 | Morgan | |
| 2006/0202851 | A1 | 9/2006 | Cash | |
| 2009/0002986 | A1 * | 1/2009 | Medendorp, Jr. | F21V 7/0016 362/247 |
| 2009/0213581 | A1 * | 8/2009 | Gauger | F21S 19/00 362/161 |
| 2009/0218951 | A1 | 9/2009 | Weaver | |
| 2009/0230894 | A1 | 9/2009 | De Geoderen | |
| 2009/0284966 | A1 | 11/2009 | Crookham | |
| 2009/0316408 | A1 * | 12/2009 | Villard | F21K 9/00 362/249.02 |
| 2010/0246158 | A1 * | 9/2010 | Van Gorkom | G02B 6/0028 362/19 |
| 2010/0277106 | A1 | 11/2010 | Baaijens | |
| 2010/0277316 | A1 * | 11/2010 | Schlangen | F21S 10/02 315/312 |
| 2011/0140832 | A1 | 6/2011 | Vinkenvleugel | |
| 2012/0049765 | A1 * | 3/2012 | Lu | F21S 10/04 315/312 |
| 2012/0206050 | A1 * | 8/2012 | Spero | F21V 19/02 315/152 |
| 2013/0107502 | A1 | 5/2013 | Leadford | |
| 2014/0175875 | A1 | 6/2014 | Newman | |
| 2015/0061506 | A1 * | 3/2015 | Baaijens | H05B 47/11 315/152 |
| 2015/0247623 | A1 * | 9/2015 | Hikmet | F21V 13/08 362/84 |
| 2015/0289347 | A1 * | 10/2015 | Baaijens | H05B 39/044 315/294 |
| 2017/0299146 | A1 * | 10/2017 | Meerbeek | F21V 7/0016 |
| 2018/0160512 | A1 | 6/2018 | Dolan | |
| 2018/0231227 | A1 | 8/2018 | Strolin | |
| 2019/0098734 | A1 * | 3/2019 | Dolan | H05B 47/185 |
| 2021/0051788 | A1 * | 2/2021 | Dolan | H05B 45/31 |

OTHER PUBLICATIONS

Grafik Eye® QS Brochure, Lutron Electronics Co., Inc., Aug. 2010, found at http://www.lutron.com/TechnicalDocumentLibrary/GRAFIK%20Eye%20QS%20Brochure%20367-1603%20B.pdf, 12 pages.

RadioRA® 2 Brochure, Lutron Electronics Co., Inc., Nov. 2016, found at http://www.lutron.eom/T echnicalDocumentlibrary/367-1663.pdf, 36 pages.

Caseta® Wireless Brochure, Lutron Electronics Co., Inc., Nov. 2016, found at http://www.lutron.com/TechnicalDocumentlibrary/3672499a_Caseta_Brochure.pdf, 20 pages.

MultiSet Pro® Low-Wattage Universal Dimmer, Lightolier Controls, found at http://site.electricsuppliesonline.com/documents/lightolier/multisel/MSP600VA-spec.pdf, 2 pages.

Adome® collection dimmers product catelog, Legrand North America, Inc., found at http://www.legrand.US/dome-2016-catalog.aspx, 10 pages.

Forbes Magazine; "The Best Product of 2012: The Philips Hue LED lighting System", https://www.forbes.com/sites/sethporges2012/12/28/,<https://www.forbes.com/sites/sethp orges/2012/12/28/the-best-product-of-2012-the-philips-hue-led-lighting-system/#381a37775dal; Dec. 28, 2012.

Arch20 Newsletter; "VorteXX Chandelier, Zaha Hadid Architechts and Patrik Schumacher", http://www.arch2o.com/vortexx-chandelier-zaha-hadid-and-Patrik-schumacher/; Accessed on Oct. 8, 2017.

Destinationlighting.Com, "Wireless Dimmer Kit White: Works only with GoConex Genius Series" (2018), available at https://web.archive.Org/web/20180223001229/https://www.destinationlighting.com/item/wi Yeless-dimmer-kit-white-works-only-goconex-genius-series/657252.

* cited by examiner

Prior Art (Single Dimmer)

Prior Art (Multiple Dimmer Controlled Light Fixtures)

Master Dimmer Controller – Generic Wiring Example

Dimming Control Keypad – Generic Wiring Example

As defined in the Echelon PL3170 Publication
"005-0193-01C PL Data Book"

KEYPAD
Power Line Communications Module

KEYPAD
POWER SUPPLY

MASTER DIMMING CONTROLLER
ZONE DIMMER CIRCUITS

MASTER DIMMER CONTROL
ZERO CROSS DETECTION CIRCUIT

As defined in the Echelon PL3170 Publication
"005-0193-01C PL Data Book"

MASTER DIMMING CONTROLLER
POWER LINE COMMUNICATIONS MODULE

MASTER DIMMING CONTROLLER
POWER SUPPLY

Low Voltage Wire D.C

High Voltage Wire A.C

Low Voltage Wire D.C

COMBINED LIGHTING DEVICE WITH AN INTEGRATED DIMMING CONTROL SYSTEM

CROSS-REFERENCES TO RELATED APPLICATIONS

This application is a continuation of U.S. application Ser. No. 16/172,000 filed Oct. 26, 2018, which claims priority to U.S. Provisional App. No. 62/614,102 filed Jan. 5, 2018 and is also a continuation-in-part of U.S. application Ser. No. 15/870,515 filed Jan. 12, 2018, now U.S. Pat. No. 10,278,269 issued Apr. 30, 2019, which is a continuation of U.S. application Ser. No. 15/392,216 filed Dec. 28, 2016, now U.S. Pat. No. 9,907,149 issued on Feb. 27, 2018, which is a continuation-in-part of U.S. application Ser. No. 14/695,464 filed Apr. 24, 2015, now U.S. Pat. No. 9,538,622 issued on Jan. 3, 2017, which is a continuation of U.S. application Ser. No. 13/762,186 filed Feb. 7, 2013, now U.S. Pat. No. 9,035,572 issued on May 19, 2015, which claims the benefit of provisional patent application Ser. No. 61/596,101 filed Feb. 7, 2012, the contents of each of which are hereby incorporated herein by reference in their entireties.

FIELD OF THE INVENTION

The present invention generally relates to a lighting device with a master dimming control system enclosed with the lighting device. More particularly, the lighting device has a plurality of lighting effects, scenes and zones controlled by one or more remote control switches.

BACKGROUND

Existing lighting control systems that are multi-zone multi-scene are expensive to install and usually require a lighting designer or lighting specialist to create the lighting design. These lighting systems are not installed just to raise and lower the lighting in a room but rather they are installed so they will create a dramatically different lighting effect with each of the different actuators on a remote, wall control, or master control. In order to install a multi-zone multi-scene in new or existing construction, this type of system requires the electrician to run wiring, connecting each fixture on the same zone back to the master control station, which usually requires a four gang electrical box. In many installations in existing homes it is necessary to cut out sections of the ceiling drywall or lath and plaster to run wiring, which adds greatly to the complexity and cost of the installation. Prior art multi-zone multi-scene lighting controls have not been designed to control one lighting device in a room but rather a group of lights selected, and the lighting design for such a system usually requires the expertise of a professional lighting specialist who has been trained. A typical installation over a table might include a pair of recessed lights mounted four feet apart and centered on the chandelier and the table, which would then provide task lighting or direct lighting on the table (zone 1). Another recessed light would be installed to accent a centerpiece arrangement that would later be placed directly under the chandelier (zone 2), while another couple of recessed lights would be positioned to direct light at art work in the room (zone 3). A chandelier would be installed, centered on the table (zone 4).

Lighting effects such as general area lighting, accent lighting, task lighting and are often used in lighting the interiors of residential and commercial spaces. Grazing as a lighting effect is commonly used in interior design in order to accentuate the architecture of a residence or commercial building. This is accomplished by placing a light source close to the plane of a wall and then directing the light beam obliquely across the wall's surface. Grazing is a particularly dramatic way to highlight the texture of a stone or brick wall by creating shadows.

A need remains for a way to provide multi-scene, multi-zone lighting with minimal wiring and ease of use.

SUMMARY

Various embodiments discussed herein provide a multi-zone, multi-scene dimming system that does not require installing new wiring in the walls or ceiling. Such embodiments do not require special wiring. For example, you could install the wall remote in place of an existing single-pole switch that controls a lighting device such as a chandelier. The wall remote would fit in the same switch box and fit inside a decora style switch plate. This wall-mounted remote would preferably have at least four actuators for selecting different scenes as well as an on/off button. There would be an antenna in or coupled to the remote.

Various embodiments may also incorporate several different lighting techniques such as general area lighting, task lighting, grazing, indirect lighting and accent lighting into the support structure of a single lighting device wherein a multi-zone multi-scene dimming system is built into the base or body of the single device such as a chandelier, ceiling light, floor lamp, wall mounted light or ceiling fan.

General area lighting provides light without concern for directing the light in any specific direction, lighting the general area without placing any focus on any features in the area, whereas task lighting provides bright lighting direct to a specific surface such as a dining room table or conference room table or rug. Ninety percent of the light is directed downward. On the other hand, accent lighting for a lighting device is directed narrowly at a specific object such as a flower arrangement or statue centered directly under the center of the chandelier or at a piece of artwork on an adjacent wall.

In some embodiments, a lighting device is provided, which has multiple scenes with layered lighting effects such as general area lighting, task lighting, grazing and accent lighting that can all be pre-programed and easily selected.

For example, consider a four scene system wherein zone 1 is defined by a lighting device with a plurality of general area lights, zone 2 is defined by a plurality of task lights, zone 3 is defined by a plurality of accent lights and zone 4 is defined by indirect lighting. Various on/off and intensity combinations of the zones may be imagined, each of which defines one possible scene. Thus, scene 1 might be defined by zone 1 (a plurality of general area lights) 10% intensity, zone 2 (plurality of task lights) at say, 50% intensity, zone 3 off and zone 4 (indirect lighting) at 20%. Each scene may be selected by depressing on one of the scene select options on one of the different remotes, or all zones may be turned off by depressing an off button as is common.

The defined scenes are stored in a master dimming control memory, together with a fade time representing a desired time for effecting a change from existing intensity for each zone in the most recently selected scene to the desired intensity for each zone in the currently selected scene. Optionally, controls can be provided for color changes, e.g., drivers for selecting combinations of different color LEDs used as light sources in one or more zones.

Each scene can be preset at the factory; also fade rates can be preset at the factory. One or more of the lighting devices are capable of being networked so they can operate with the same remote and can be turned on and off as well as display the same scenes when a given scene selection is made.

Each system can be controlled and programmed from a remote control. For instance, in a dining room a remote control could be installed in a standard single gang wall box and/or a hand-held or table top remote could be used.

In most entryways, a switch for an entry chandelier often is in a multi-gang box with a three or four-gang switch plates and other switches located adjacent to the entry chandelier switch. The embodiments herein allow the entryway switch to be replaced with a wall-mounted remote control that fits in a standard single gang box and in one gang of a decora plate.

In most dining rooms there is usually only one single gang box controlling a chandelier. The existing switch can be easily removed and replaced with a remote control of the embodiments herein, which may include 4-6 different actuators from which to select different scenes, as well as an on/off control. There are no multi-zone multi-scene master controls that are able to fit into an industry standard single gang decora switch plate and box, so remotely installing the master dimming control in the chandelier or lighting device is a desirable advantage. A wall-mounted remote or a hand-held remote could use a touch screen or buttons as actuators that are commonly used in a smart phone or security controller along with any other known actuator.

Another aspect is an ability to provide a multi-scene lighting device with a selling demonstration mode incorporated in the master dimming control of the lighting device that will allow each of scenes to continually cycle. For instance in a four-scene program, if it was on scene 1, it could remain at scene 1 for 10 seconds, then cycle to scene 2 and stay there for 10 seconds and then cycle to scene 3 for 10 seconds and then cycle to scene 4 for 10 seconds and then turn off for 10 seconds and go back to scene 1, continually recycling through the different scenes in a loop.

Using either power line technology or wireless remote, would use a computer chipset that would include a dimming module. The chipset would be addressable. One of the preferred embodiments described in FIG. 3 (310) shows a master dimming system, which would preferably include communications module, such as an Echelon transceiver, connected to the circuit board inside the unit. There can be at least one transceiver for each lighting channel. Each chipset using wireless and/or power line technology can be individually addressable and can have a dimming module connected to it, if the electrical device is dimmable, otherwise it would just turn on and off.

The master dimming control system would be either installed inside part of the lighting device such as the canopy of a chandelier or the body of the lighting device. Alternately, more than one master dimming control could be installed in a lighting device. The master dimming control can be a unitary module incorporating both control and communication circuitry and dimmers or its components can be distributed in different parts of the lighting device, for example, the canopy, and body of a chandelier.

In another embodiment, there would be two types of remote controllers: a hard wired remote that would be capable of sending a signal over standard house wire using an Echelon power line smart transceivers to the master control panel or alternately by an infrared remote or a radio frequency remote that is wall mounted or handheld. In some applications, both power line technology and wireless might be used. The remote controllers can be hard-wired using three-wires (i.e., having connections to the hot, dimmed hot and neutral lines) or as a two wire system. It will work on a switched leg. The wall mounted controls will work with single pole, 3-way and 4-way installations.

The remote units are preferably provided with manual controls for selecting different scenes and/or for temporarily raising or lowering the intensity of all zones simultaneously.

The manual controls can include dedicated push buttons, state-selectable buttons and soft-keys, a touch-screen displaying buttons or a combination thereof.

A feature of this device would be that it has a plurality of zones of lighting whereby different zones can be mixed to create different scenes. Another feature of the remote control is that the remote control would be fully programmable.

If the end user would like to change one or more of the pre-set scenes or fade rates set at the factory, it can be accomplished from the remote controllers or on the master control panel.

In one embodiment, there are four scenes and four lighting zones. In selecting one of the four scenes, it would be possible to create a dramatic change in the mood of the room with the raising and lowering of different zones. It should be recognized that numerous types of lamps could be interchanged in this lighting device, such as any of the light emitting elements discussed herein such as, for example, incandescent, fluorescent, halogen and LED lighting. A different driver can be used for each light source channel.

In another embodiment, a linear chandelier comprises an elongated fixture body a first set of one or more lights extending along one or more elongated sides or ends of the fixture body producing ambient light. The linear chandelier also comprises a translucent shade that extends around the fixture body to cover the first set of lights. The linear chandelier also comprises a second set of one or more lights extending down from the fixture body that are not visible when looking at the chandelier from a straight on front view. The linear chandelier also comprises a lower cover with a textured surface attached on a bottom side of the fixture body and surrounding the second set of lights. The linear chandelier also comprises one or more grazing lights extending around a perimeter of a bottom side of the fixture body producing a grazing light on the textured surface of the lower cover.

Additionally or alternatively, the second set of lights include two downwardly directed flood lights located on opposite ends of the fixture body and at least one spot light located between the two flood lights producing accent lighting. Additionally or alternatively, the linear chandelier further includes a third set of one or more lights extending upward from the fixture body that are not visible when looking at the chandelier from the straight on front view. In some embodiments, the third set of lights include upwardly directed task lights producing indirect lighting.

Additionally or alternatively, the linear chandelier further includes one or more dimmers located in the fixture each coupled and independently dimming a different one of the first, second, and third set of lights. Additionally or alternatively, the linear chandelier further includes an upper cover with a textured surface attached on a top side of the fixture body; and one or more grazing lights extending around a perimeter of a top side of the fixture body producing a grazing light on the textured surface of the upper cover. In some embodiments, the first set of lights of the linear chandelier include light strips attached to the elongated sides and ends of the fixture body.

The embodiments herein enable a single lighting device that incorporates several lighting effects, such as general area lighting, down lighting, accent lighting, grazing, and indirect lighting and a plurality of up lighting each wired to different zones so that each type of lighting effect could be mixed to create different scenes of lighting.

DETAILED DESCRIPTION

In the following detailed description, reference is made to the accompanying drawings that form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense. Various operations may be described as multiple discrete operations in turn, in a manner that may be helpful in understanding embodiments; however, the order of description should not be construed to imply that these operations are order-dependent. The description may use perspective-based descriptions such as up/down, back/front, and top/bottom. Such descriptions are merely used to facilitate the discussion and are not intended to restrict the application of disclosed embodiments.

Figure 1:
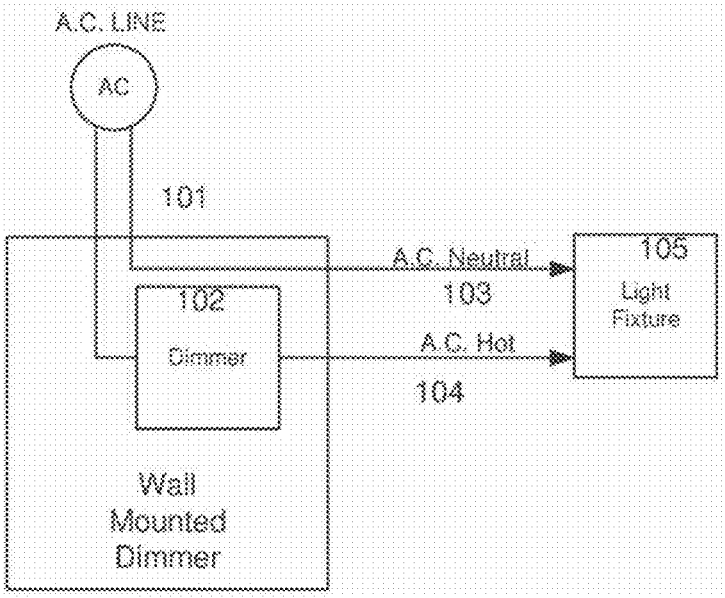
FIG. 1 shows a conventional single dimmer circuit.

FIG. 1 exemplifies the prior art of a single dimmer 102 installed in a single gang electrical box controlling a single light fixture 105. This is representative of the most common existing wiring in residential buildings. The single A.C. Hot wire 104 precludes the dimmer from controlling more than one lighting zone. An existing residence wired in this configuration would require substantial and expensive remodeling of the existing wiring enclosed within the wall and ceiling spaces.

Figure 2:
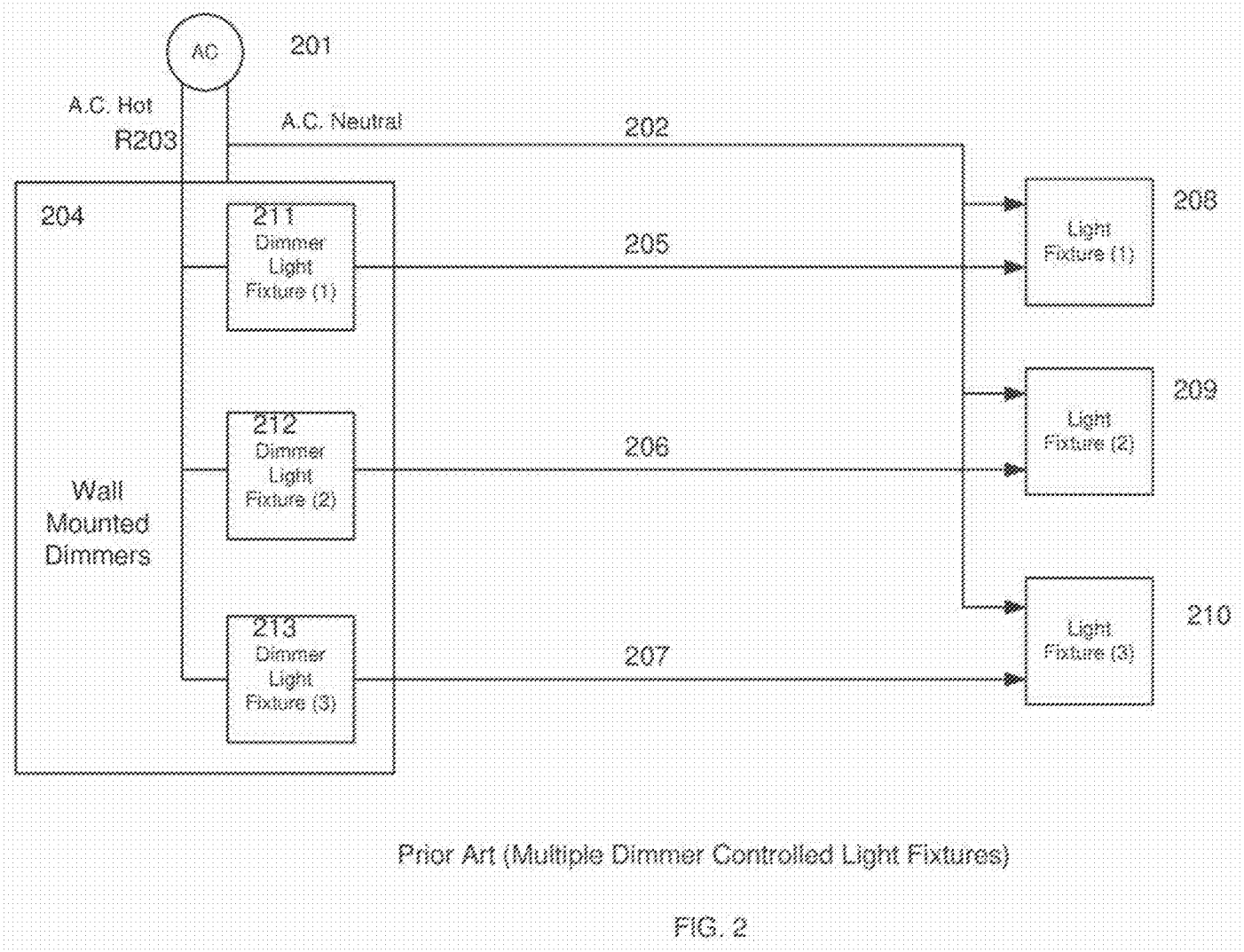
FIG. 2 shows a conventional multiple dimmer circuit.

FIG. 2 exemplifies the prior art of multiple wall mounted dimmers controlling multiple lighting zones. This is representative of common existing wiring in residential buildings for multiple dimmers. In this configuration, existing residences are precluding from changing the location of or adding additional lighting zones without extensive remodeling.

Figure 3:
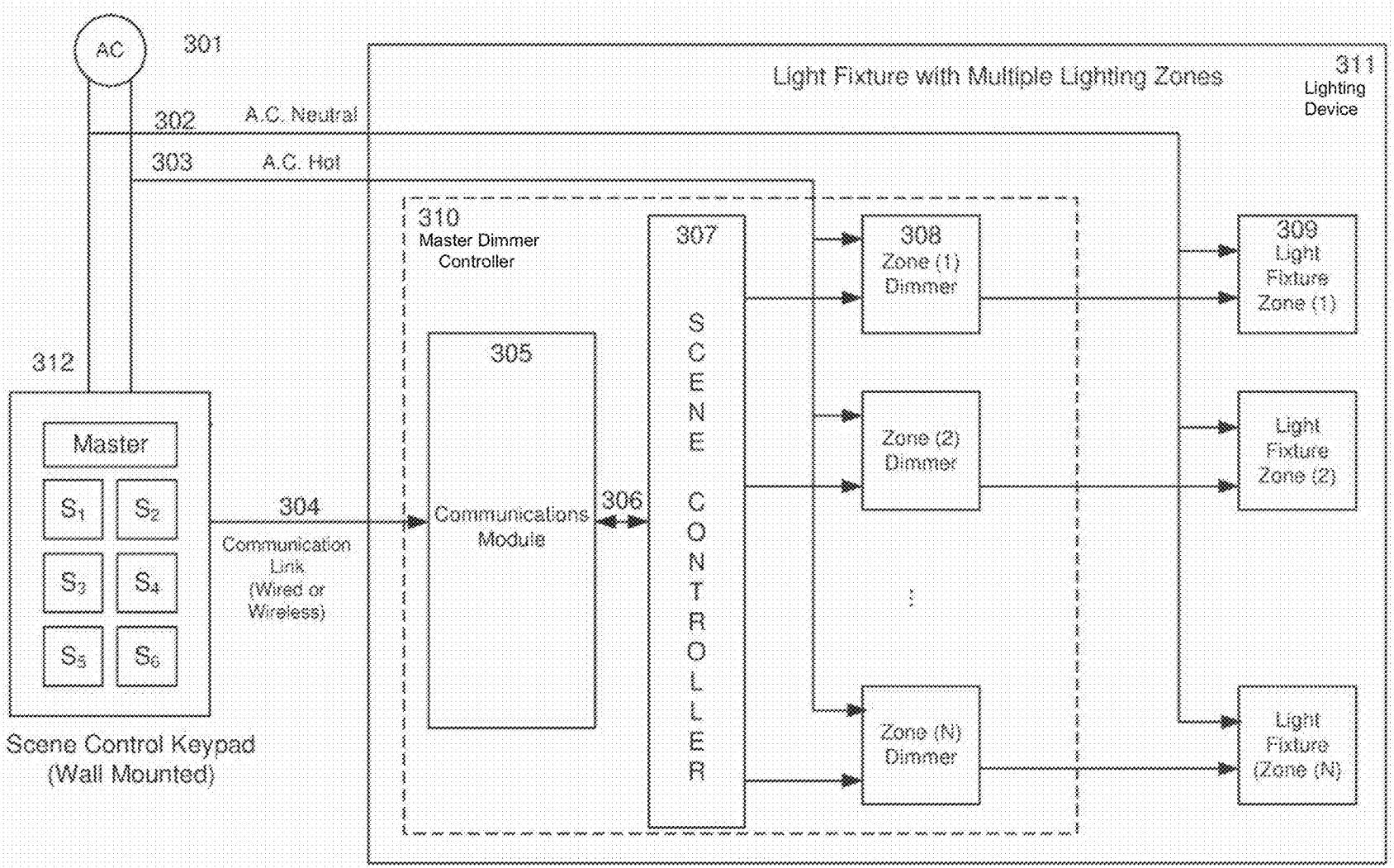
FIG. 3 shows an embodiment providing remote scene control of multiple lighting zones in a lighting fixture.

FIG. 3 exemplifies the dimming control improvements over the prior art wiring limitations shown in FIG. 1 and FIG. 2. In this exemplary illustration of system 301, a Master Dimmer Controller 310 is mounted within the physical support structure of a lighting device 311. Electrical power for the lighting device 311 is provided by a single A.C. circuit consisting of a A.C. Hot wire 303, A.C Neutral wire 302 and safety ground wire (not shown). The Master Dimmer Controller 310 allows for a plurality of individually controlled dimmable lighting zones powered by a single A.C. circuit.

A wall mounted or portable keypad or remote control device 312 transmits digital information containing the illumination level for each lighting zone to the Master Dimmer Controller 310 via the Communication Link 304. The Communication Link 304 may be implemented in any of a plurality of wireless media including Radio Frequency (R.F.), Infrared Light (I.R.), Data over Power Line, or a directly wired connection. The remote control device can be a special-purpose device or can be implemented by software in a mobile device using, e.g., BLUETOOTH® communications. Examples of mobile devices include mobile phones and mobile computers, such as smartphones, smartwatches and other wearable computers, tablets, and personal digital assistants.

The Zone Dimmers 308 may support the electrical and dimming requirements of a multitude of lighting technologies such as incandescent lamps, low voltage halogen lamps, or LED lamps. Each Light Fixture Zone 309 has at least one lamp or other lighting element.

A lighting device with an integrated multiple zone dimming controller enables existing residential or commercial lighting fixtures to be retrofitted with an advanced lighting fixtures capable of providing advanced lighting architecture solutions without modifying the preexisting wiring.

Figure 4:
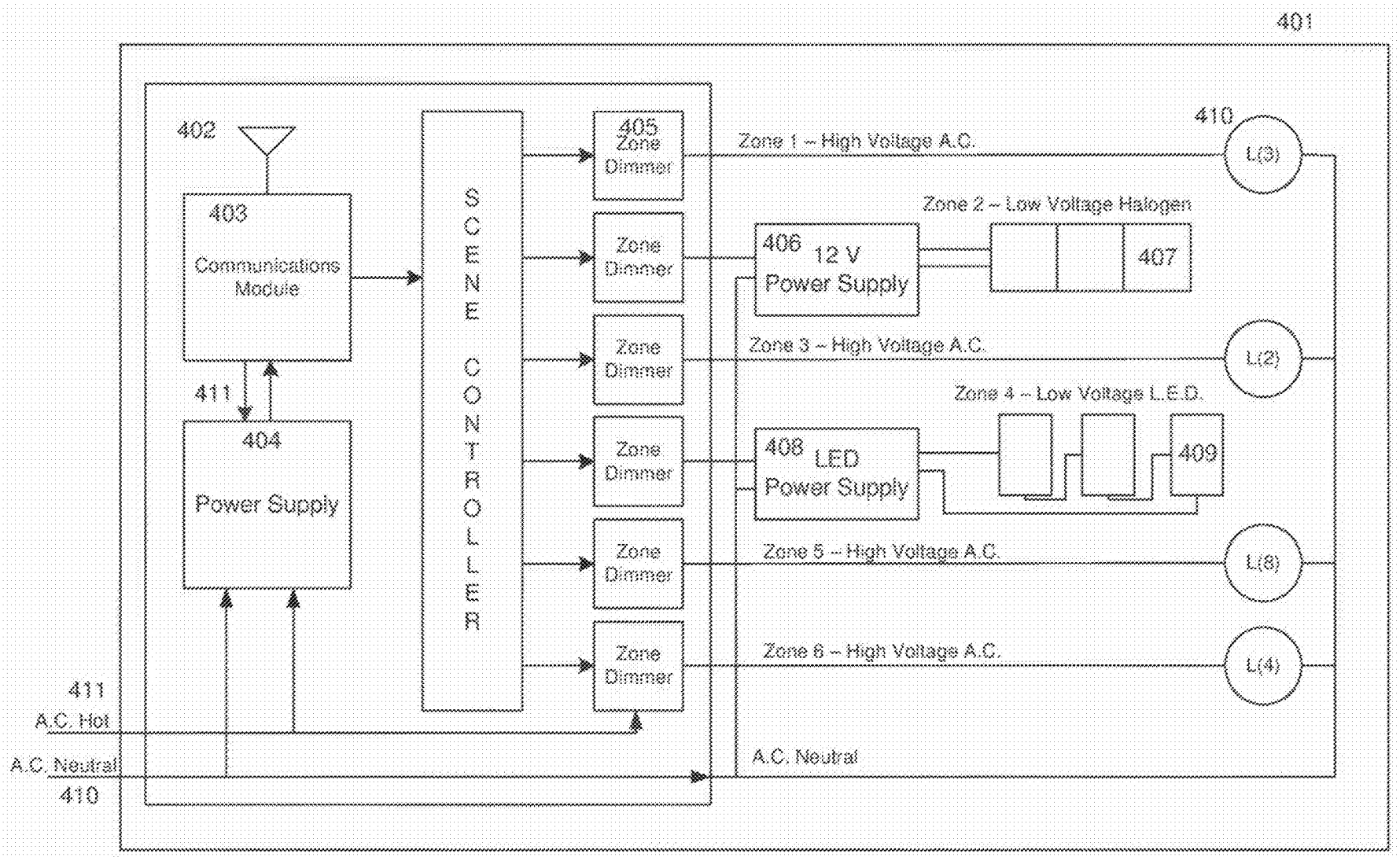
FIG. 4 shows another embodiment providing remote scene control of multiple lighting zones in a lighting fixture which includes low voltage lighting elements.

FIG. 4 is an example of a generic lighting device consisting of an integrated Master Dimming Controller 402, six independently dimmable Zone Dimmers 405. In this example, the lighting fixture utilizes three illumination technologies in six zones: Zone 1 three incandescent lamps 401; Zone 2 three low voltage halogen lamps 407; Zone 3 two incandescent lamps; Zone 4 three LED lamps 409; Zone 5 eight incandescent lamps; Zone 6 four incandescent lamps.

Figure 5:
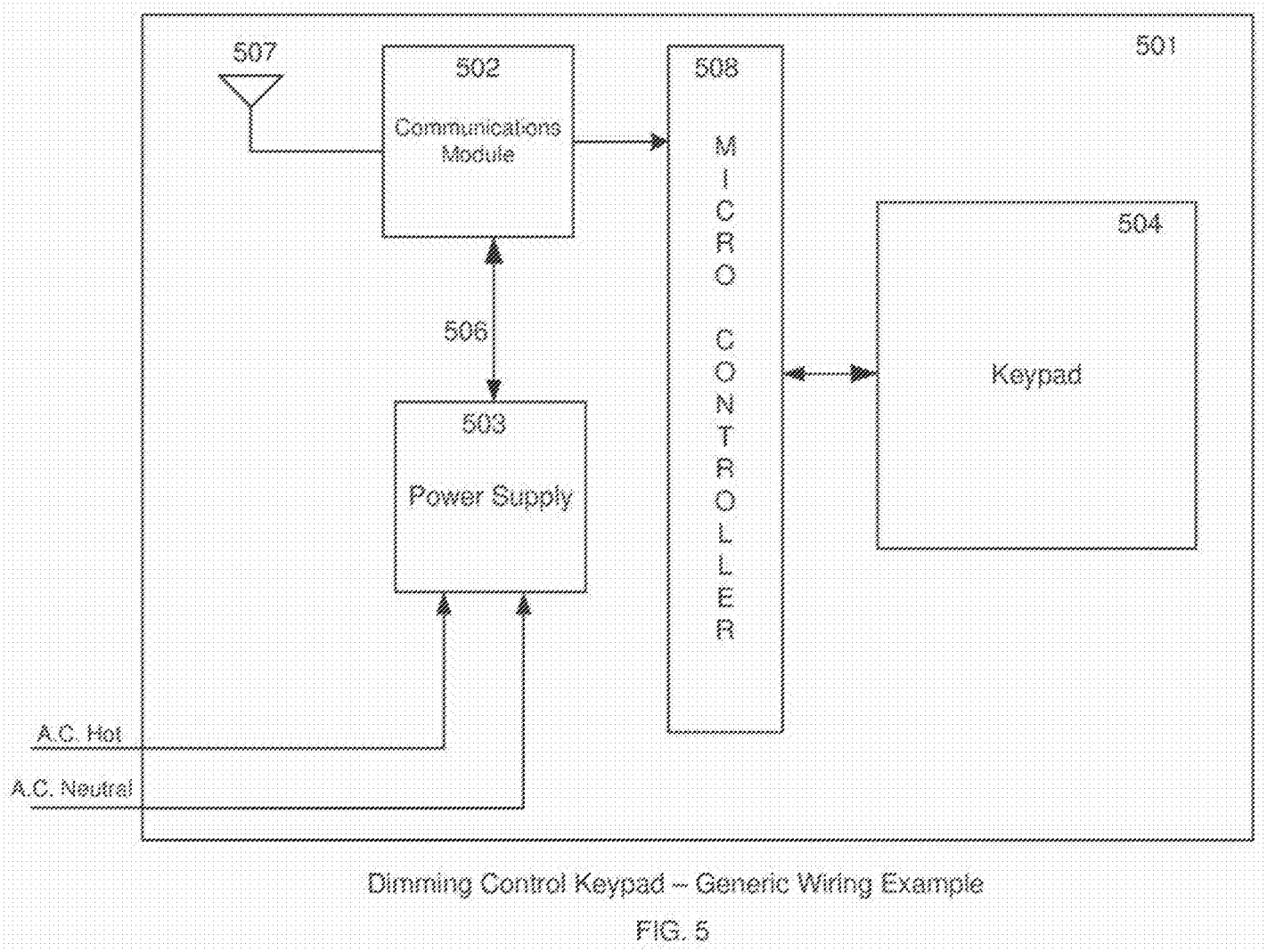
FIG. 5 shows an embodiment of a dimming control keypad that can be used in the embodiments of FIGS. 3 and 4.

FIG. 5 is a block diagram of a typical wall mounted keypad for use in system 301. The microcontroller 508 detects and processes keypad 504 switch closures and transmits the state of each keypad switch to Master Dimmer Controller 310 via Communications Module 502.

Figure 6:
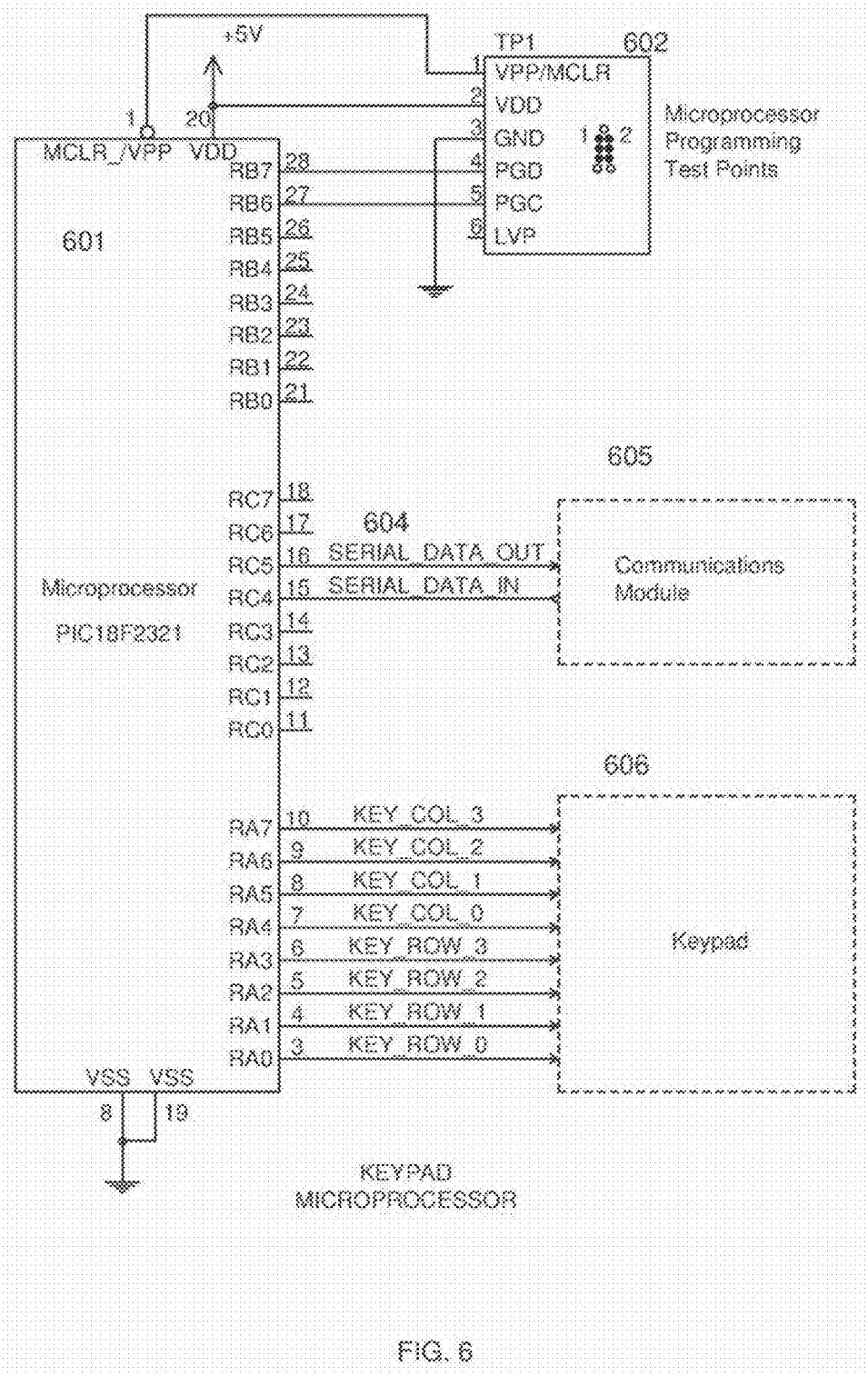
FIG. 6 shows an example of a keypad microprocessor for use in the keypad of FIG. 5.

FIG. 6 is an example implementation of the keypad microcontroller circuit. Microcontroller 601, such as a Microchip Technology microprocessor part number PIC18F4321, is programmed by interfacing the Programming Test Points 602 with a compatible programming device such as a Microchip Technology PICKIT3, ICD3 or RealICE.

Figure 7:
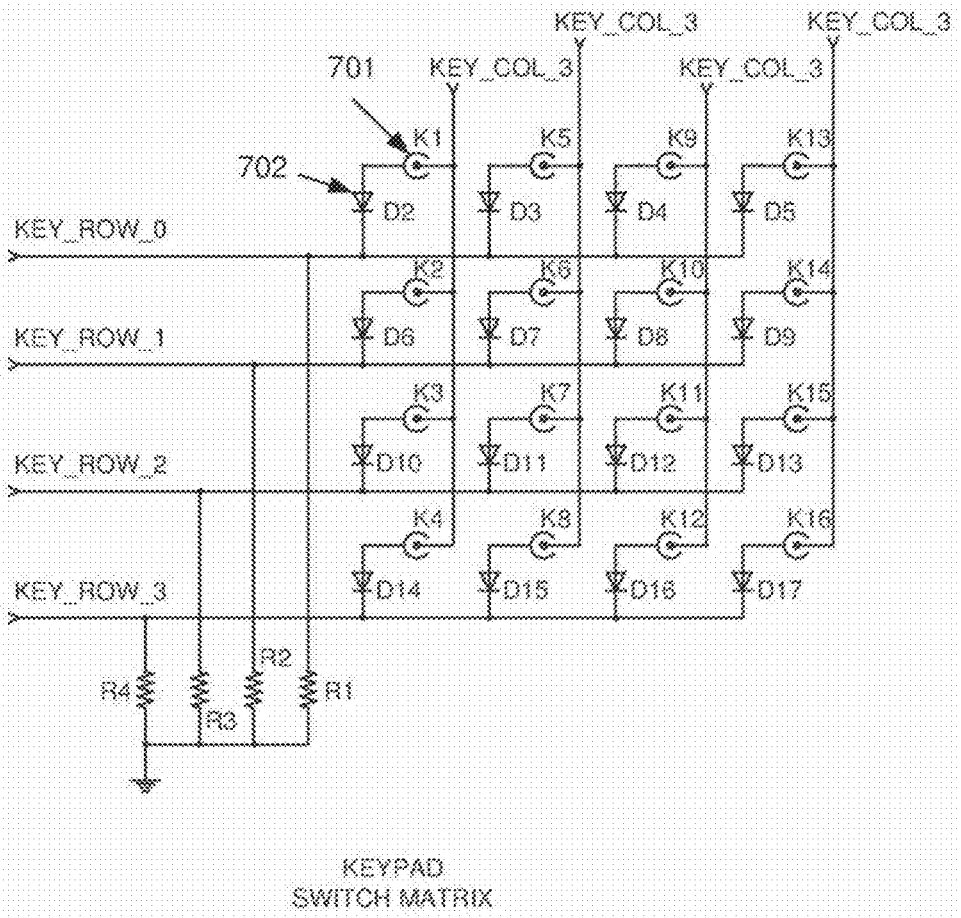
FIG. 7 shows an example of a keypad switch matrix for use in the keypad of FIG. 5.

The microcontroller 601 program scans the rows and columns of the keypad button matrix by sequentially setting one of the Key_Col_0 through Key Col_3 output pins to a logical '1' (+5V) while the others are set to a logical '0' (0V). Each Key_Row_0 through Key_Row_3 input pins are read into a memory location indicating the current state of each of four buttons in the respective column. FIG. 7 depicts the keypad button matrix.

If a Scene button is pressed and held for greater than two seconds, the Mode field shall be toggled from a '0' to a '1' or a '1' to a '0' to indicate the mode is in Programming or Normal mode respectively. The Scene button initiating the Programming mode shall be reported to the Master Dimming Controller in the Keypad Data Payload.

The microcontroller 601 program periodically reports the following Keypad data shown in TABLE 1 below to the Master Dimming Controller:

TABLE 1

Keypad Data Payload

| Field | Position | Type | Value | Notes |
|---|---|---|---|---|
| Target Light Fixture ID | 0 | Bits(3-0) | 0x0 – 0xf<br>Default = 0x0 | Lighting Fixture ID |
| Mode | 0 | Bit(7) | 0 = Normal<br>1 = Program | |
| Program Scene Number | 1 | UINT8 | 1-16 | Scene Button number initiating program mode |
| Current Button State | 1-2 | Bit(0) = K1,<br>Bit(1) = K2,<br>. . .<br>Bit(15) = K16 | 0 = Not Pressed<br>1 = Pressed | |
| Previous Button State | 3-4 | Bit(0) = K1,<br>Bit(1) = K2,<br>. . .<br>Bit(15) = K16 | 0 = Not Pressed<br>1 = Pressed | |

FIG. 7 is an example of a common industry practice combining a plurality of switches into a matrix of rows and columns to reduce the total number of I/O pins required to read each switch. In this example, switch contact 701 forms a unique switch (button). Isolation diodes 702 allow the microcontroller to detect multiple simultaneous switch closures. Detecting two or more simultaneous switch closures allows the microcontroller to implement alternative functionality.

Figure 8:
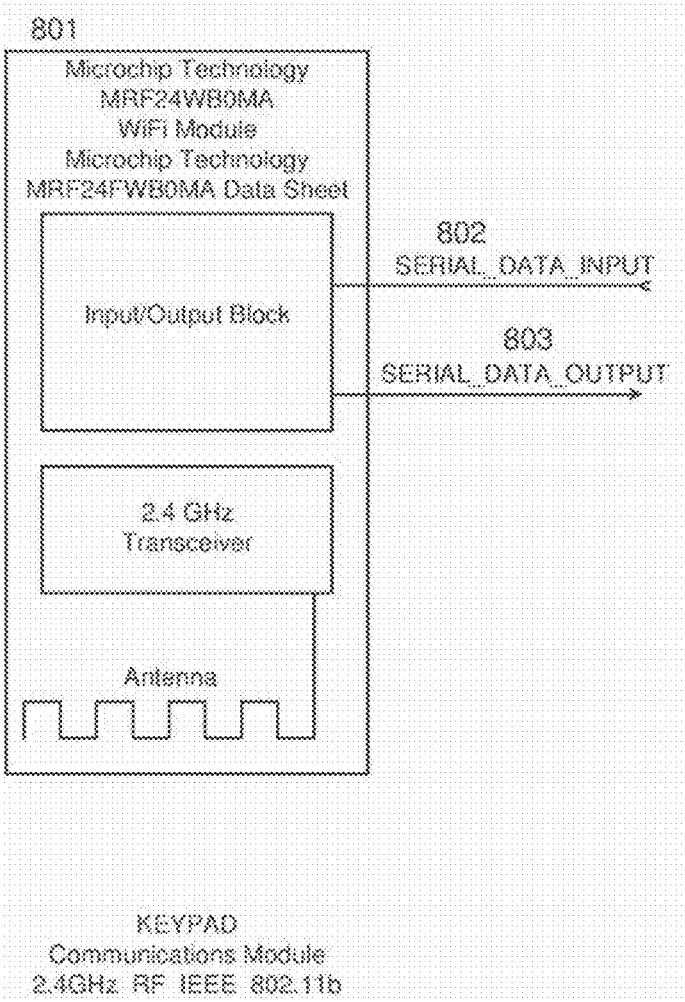
FIG. 8 shows an example of a wireless communications module for use in the keypad of FIG. 5.

FIG. 8 is an implementation of the keypad to use a Master Dimmer Controller communications link using, for example, an industry standard Wi-Fi 802.11b communications module 801, Microchip Technology part number MRFWB0MA. The MRFWB0MA module is controlled by the keypad microcontroller 601 via an industry standard SPI serial data interface port. The module 801 has serial data input port 802 and serial data output port 803.

Figure 9:
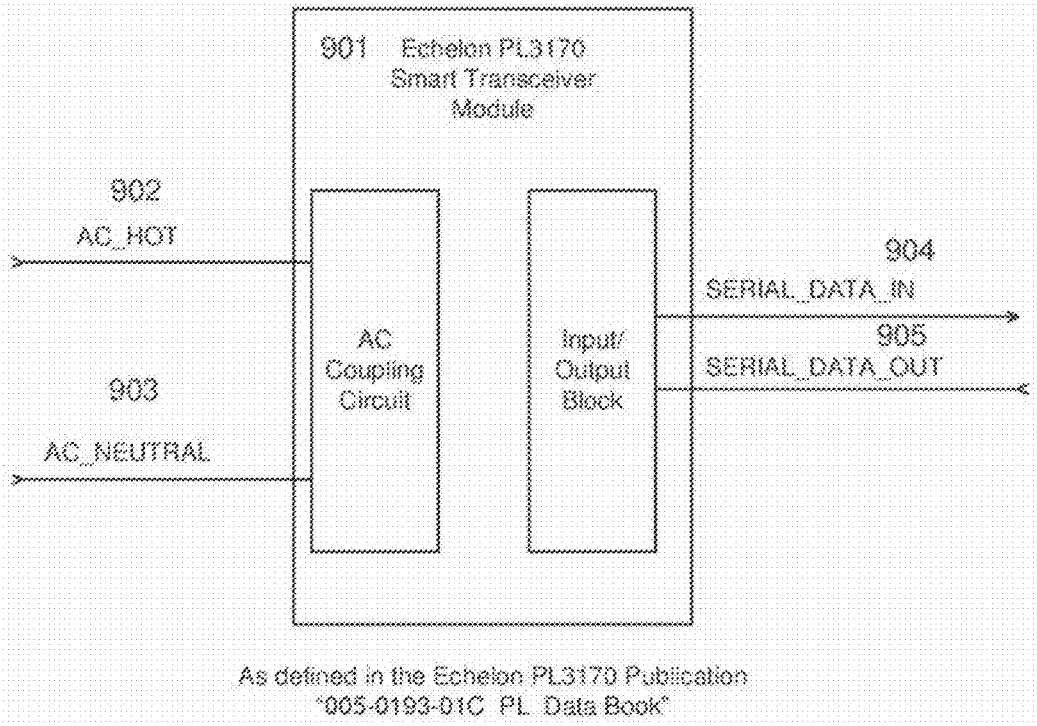
FIG. 9 shows an example of a powerline communications module for use in the keypad of FIG. 5.

FIG. 9 is an implementation of the keypad to use a Master Dimmer Controller communications link implemented using Echelon Corporation's Power Line Communications technology, Echelon P/N PL3170. The PL3170 power line module is controlled by the keypad microcontroller 601 via an industry standard SPI serial data I/O interface port 904, 905.

Figure 10:
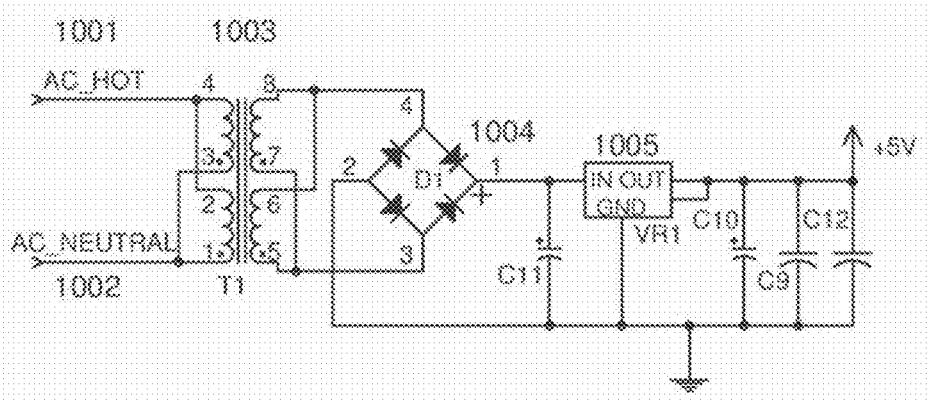
FIG. 10 shows an example of a keypad power supply for use in the keypad of FIG. 5.

FIG. 10 is a commonly used power supply implementation. Transformer 1003 reduces the 110 volt A.C. input via lines 1001, 1002 to 10 volts. A.C. Bridge rectifier 1004 and capacitor C11 convert the A.C. voltage to an unregulated, filtered D.C. voltage. The linear voltage regulator 1005 converts the unregulated D.C. voltage to a fixed +5 volt output to power the remaining keypad components.

Figure 11:
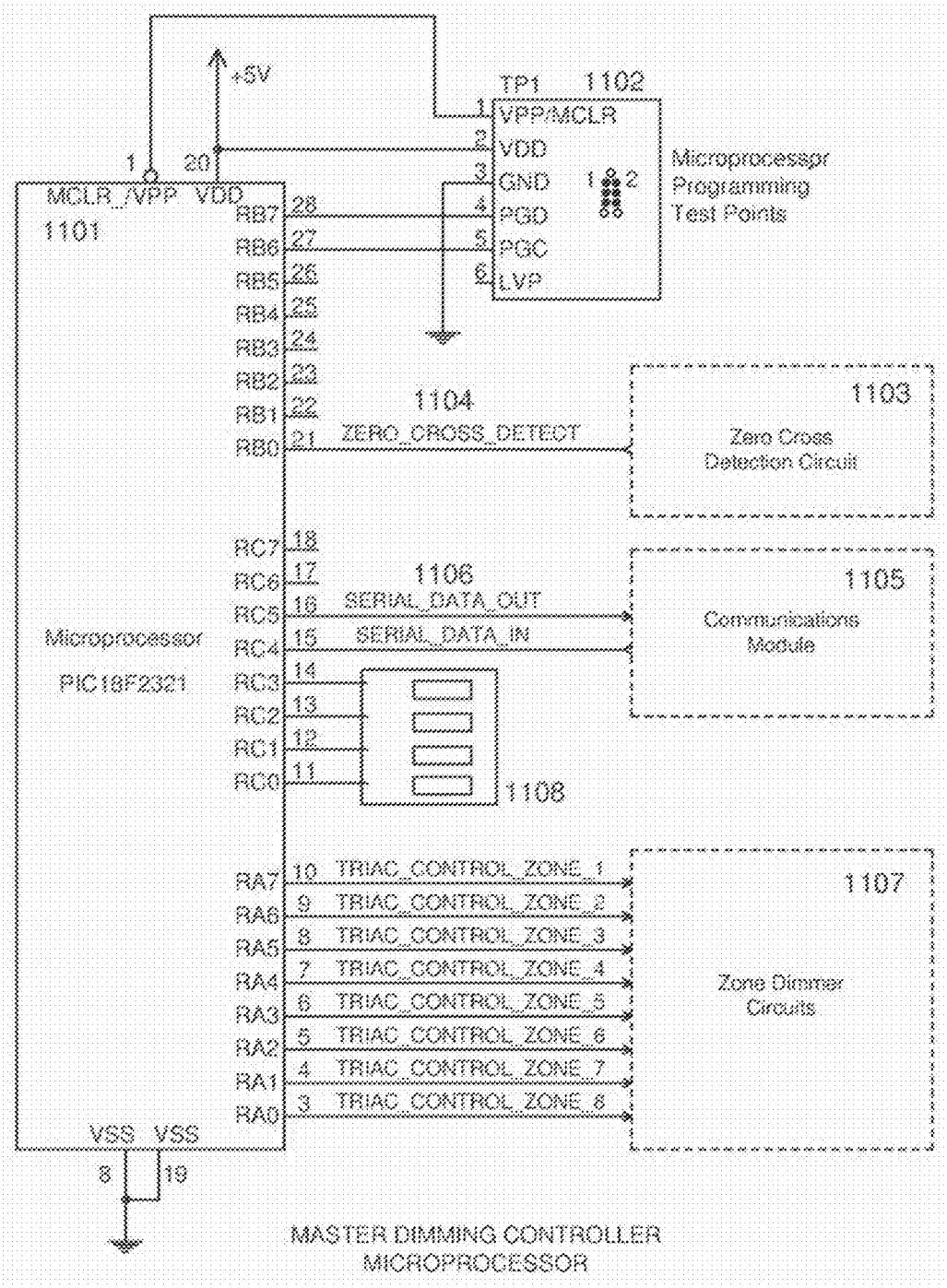
FIG. 11 shows an example of a master dimming controller microprocessor for use as the scene controller in the embodiments of FIGS. 3 and 4.

FIG. 11 is a block diagram of a Master Dimming Controller. This exemplary implementation uses a Microchip Technology PIC18F2321 microcontroller 1101. The microcontroller 1101 receives the keypad switch state data via the Communications Module 1105. The serial data interface 1106 is an industry standard SPI serial data interface.

Up to 16 Master Dimming Controller lighting fixtures can be controlled with a single Keypad. In a multiple Master Dimming Controller lighting fixture environment, each lighting fixture's ID "DIP" switch 1108 is set to a unique four binary bit combination. The default setting for the "DIP" switch is 0000.

The microcontroller 1101 has internal non-volatile EEPROM memory which stores the illumination level for each of the dimming zones 1107. In the event of a power failure optionally all zones will return to the factory settings.

The Master Dimming Controller microcontroller either polls for or is interrupted by the communication module's reception of a Keypad data payload. Upon receipt of the payload, the Master Dimming Controller compares the received "Target Light Fixture ID" to the value of the DIP Switch 1108. If the values match, the Master Dimming Controller parses the remainder of the received data payload.

The bitwise comparison of exclusive OR'ing (XOR) of the Current Button State and Last Button State to the respective Current Button State determines whether the Current Button State is the result of a make, break or steady state condition of a specific button as shown in TABLE 2:

TABLE 2

| Current Button State Bit (Kx) | Bitwise XOR Bit (Kx) | Notes |
|---|---|---|
| 0 | 0 | Released |
| 0 | 1 | Break |
| 1 | 0 | Pressed |
| 1 | 1 | Make |

1. Scene Selection

If the Keypad Data Payload bit field "Mode" is set to zero and a Scene Keypad button indicates a "Make" condition, the Controller retrieves the respective Scene's Zone illumination from the non-volatile and sets all zone illumination levels respectively. If more than one Scene Button is determined to be in the "Make" condition, the remaining Scene Buttons are ignored.

1.1. Scene Programming Embodiments

If the Keypad Data Payload bit field "Mode" is set to '1', programming mode is enabled. The keypad switches K1-K5 are remapped to different functions as shown in TABLE 3 below.

1. The Keypad Data Payload field "Program Scene Number" specifies which of 16 possible scenes is to be programmed based upon the last Scene button pressed for greater than two seconds.

2. Target Lighting Fixture Selection: The Scene 1 buttons is now remapped and causes the Keypad to rotate through each of the 16 valid Target Lighting Fixture ID values each time the button is pressed. Each time the button is pressed, the corresponding lighting fixture will flash all of its lamps for a period of about one second.

3. Zone Selection: The Scene 2 button is now remapped and causes the Controller to rotate through each of the valid Zones each time the button is pressed. During programming, only the selected zone lamps will be illuminated.

4. Zone Illumination Level: The Scene 3 and Scene 4 buttons are now remapped to increase or decrease the lighting level for the selected zone with each respective button press. Upon release of a button press, the then current zone illumination level will be stored in the respective Scene and Zone non-volatile microcontroller memory location.

5. Additional lighting zones may be programmed as shown in steps 3 and 4 above.

6. Additional Target Lighting Fixtures may be programmed as shown in steps 2, 3, and 4 above.

7. Programming Exit: Press and hold any Scene button for greater than two seconds.

TABLE 3

Keypad Button Function Mapping

| Button | Normal Mode | Programming Mode | Notes |
|---|---|---|---|
| K1 | Scene 1 | Select Target Lighting Fixture ID | Press to increment ID #; All zones on targeted ID will flash for one second |
| K2 | Scene 2 | Zone Select | Press to select Zone; only selected zone will be illuminated. |
| K3 | Scene 3 | Zone Brighter | |
| K4 | Scene 4 | Zone Dimmer | |
| K5-K16 | Scene 5-Scene 16 | N/A | |

A "scene" is a combination of smart home controls saved under a unique name for a specific time, date, and/or action. Scenes can be created and/or programmed as discussed previously. In general, scenes allow a user to customize the states of various electronic devices and/or one or more sequences of actions carried out by one or more electronic devices to create an desired experience or effect. For purposes of the present disclosure, a scene allows a user to illuminate an area based on the lighting needs, activities, and/or any desired criteria. Lighting scenes provide a visual pattern at a desired time or in response to a command issued by a controller. Examples of such visual patterns may include, but are not limited to, activating or deactivating (e.g., turning on/off) individual lighting elements, the brightness level (e.g., bright, muted, matte, etc.) of individual lighting elements, colors of individual light elements, blinking rate or flashing rate of individual lighting elements, and/or the like. Lighting scenes can be activated using one-button commands, a voice command, or based on preset schedules (e.g., time, date, etc.).

Figure 12:
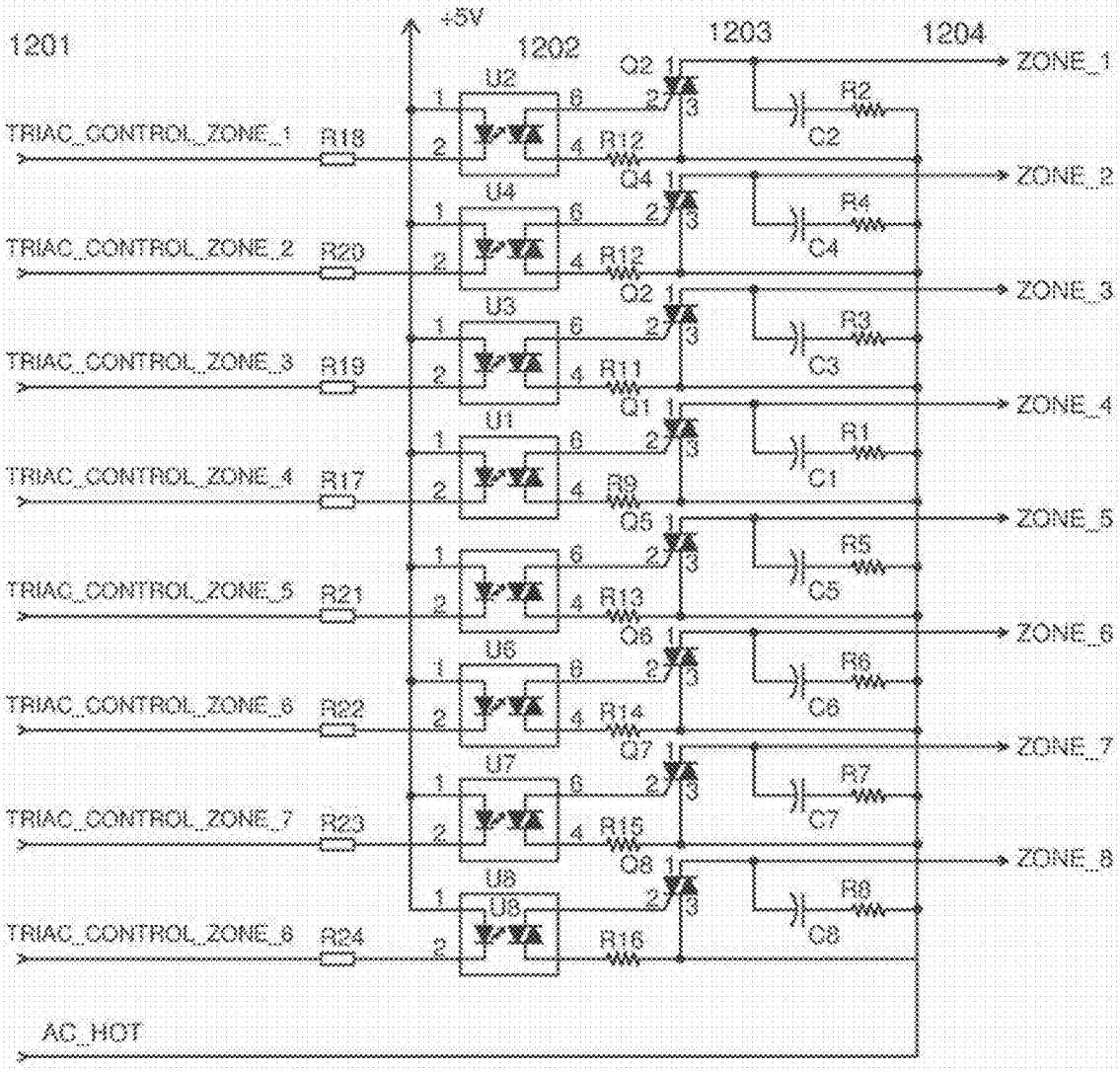
FIG. 12 shows an example of an array of zone dimmer circuits used in the master dimming controller microprocessor circuit of FIG. 11.

FIG. 12 depicts industry standard dimming control of A.C. line voltages. Each dimming zone is controlled by a semiconductor device known in the industry as a triac. When the triac control signal 1201 is set by the microcontroller to zero volts, the optically isolated triac driver 1202 triggers the gate of the triac 1203, turning the triac switch on. A triac inherently turns off upon the next occurring zero crossing of the A.C. voltage cycle if the triac gate is not triggered.

Dimming of a lamp is accomplished when a pulse is applied to the triac's gate at some time after a zero crossing of the A.C. signal. If the triac pulse is shorter that the total time of the A.C. half cycle period, the triac will inherently turn off. Thus, the triac is only on for a portion of a half cycle of the A.C. line voltage. The reduction in total power applied to a lamp results in a lower light output. The use of triacs for dimming is compatible with all incandescent lamps and newer generation compact florescent lamps/L.E.D sources.

In this example, the microcontroller generates a triac trigger control pulse signal 1201 N microseconds after the Zero_Cross_Detect interrupt. The Full illumination is achieved when the dimming delay=1. Illumination decreases proportionally as the delay increases. A dimming delay=0 is reserved to indicate the zone is Off.

Ceiling fan motor speed and direction control is implemented by repurposing two dimming zones. In an implementation, one dimming zone is designated as the Fan Speed Zone. A second dimming zone is designated as the Fan Direction Zone.

A lamp dimming zone is repurposed as a Fan Direction A.C. switch by setting the triac control signal 1201 to a steady state of either '1' or '0'. When the triac control signal is a '1', the zone output 1204 is OFF; When the triac control signal 1201 is a '0', the zone triac 1204 ON. The Fan Direction Zone control power to the coil of single pole double throw (S.P.D.T.) relay (not shown). The relay's Common contact is connected to the Fan Speed Zone. The relay's Normally Open and Normally Closed contacts are connected to the ceiling fan motor's forward and reverse direction windings. If the Fan Direction Zone is ON, the ceiling fan rotates in the one direction. If the Fan Direction Zone is OFF, the ceiling fan rotates in the opposite direction.

The Fan Speed Zone controls the ceiling fan motor speed in the same manner as dimming a lamp, i.e. the triac is turned on only during a portion of the A.C. cycle, reducing the average power applied to the motor. As the average power decreases, the motor speed decreases.

Figure 13:
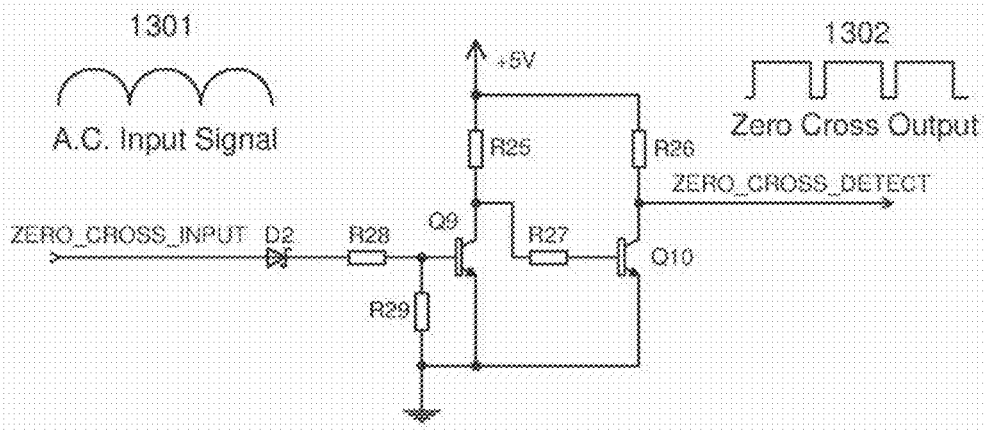
FIG. 13 shows an example of zero cross detection circuit used in the master dimming controller microprocessor circuit of FIG. 11.

The Zero Cross Detection Circuit in FIG. 13 generates a pulse 1302 every half cycle when the rectified A.C. voltage 1301 is above zero volts. Upon the rising edge of the Zero_Cross_Detect pulse, an interrupt is generated within the microcontroller indicating the beginning of each dimming control cycle.

Figure 14:
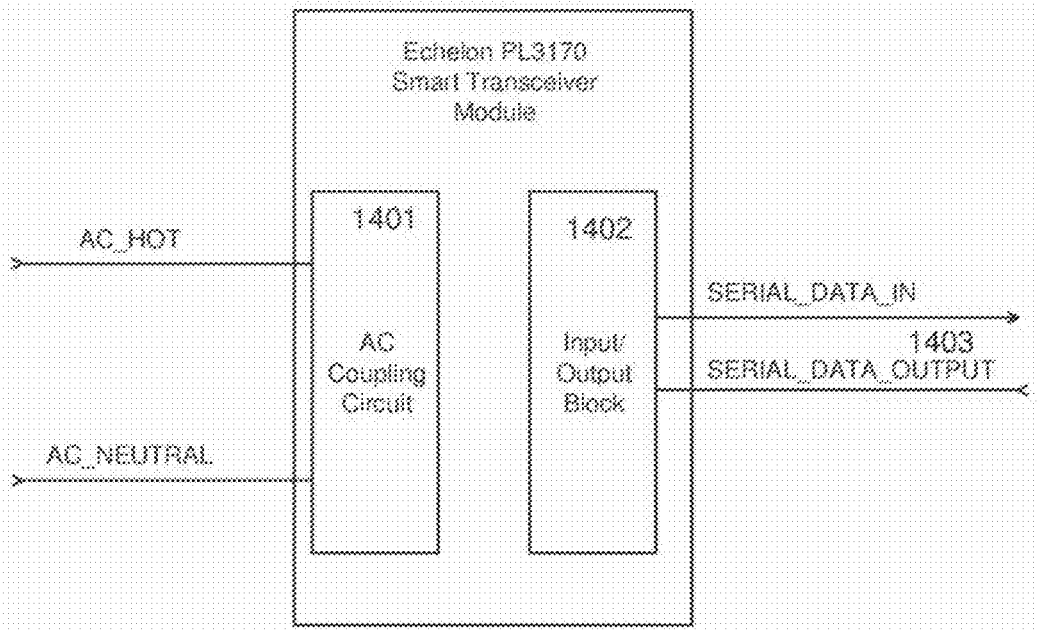
FIG. 14 shows an example of a powerline communications module for use in the master dimming controller of FIGS. 3 and 4.

FIG. 14 is an implementation of the Master Dimmer Controller to use a Keypad communications link implemented using Echelon Corporation's Power Line Communications technology, Echelon P/N PL3170. The PL3170 module is coupled to the A.C. power line via an A.C. coupling circuit 1401 and is controlled by the keypad microcontroller via an industry standard SPI serial data I/O interface port 1402, 1403.

Figure 15:
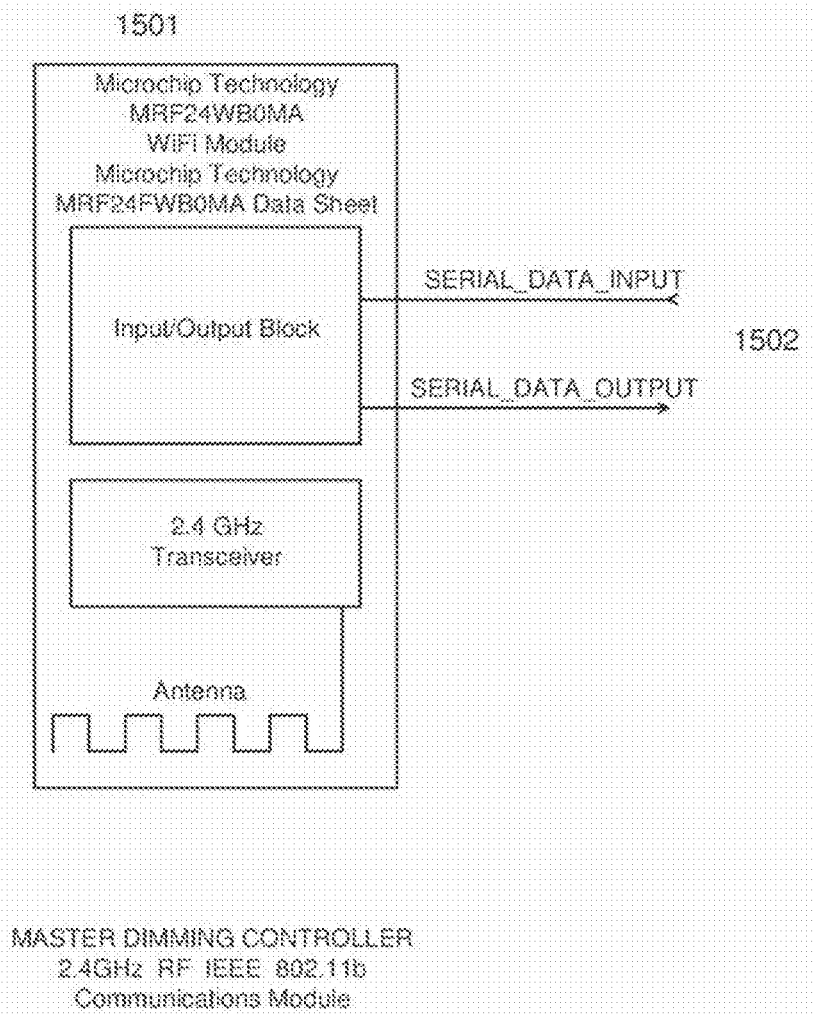
FIG. 15 shows an example of a wireless communications module for use in the master dimming controller of FIGS. 3 and 4.

FIG. 15 is an implementation of the Master Dimmer Controller to use a Keypad communications link using an industry standard Wi-Fi 802.11b communications module 1501, Microchip Technology part number MRFWB0MA. The MRFWB0MA module is controlled by the keypad microcontroller 601 via an industry standard SPI serial data I/O interface port 1502.

Figure 16:
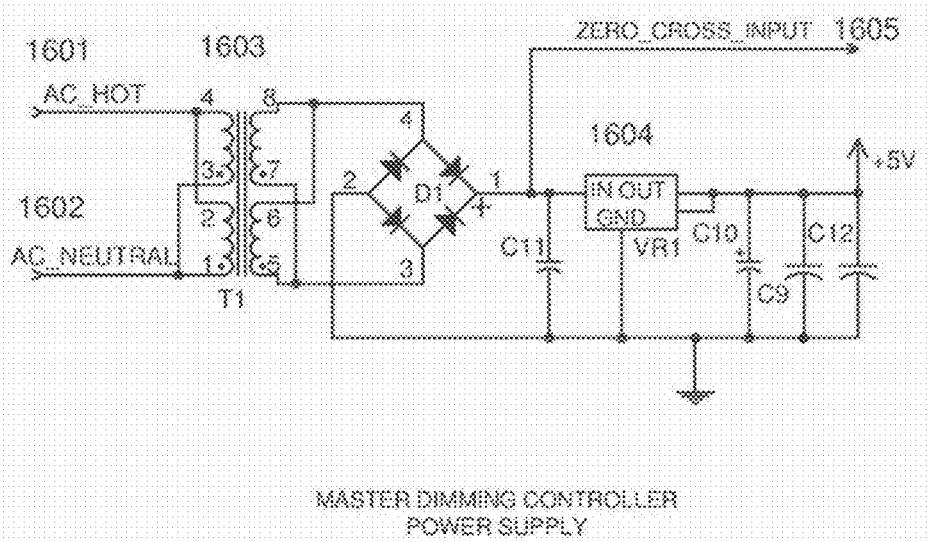
FIG. 16 shows an example of a power supply for use in the master dimming controller of FIGS. 3 and 4.
Figure 17:
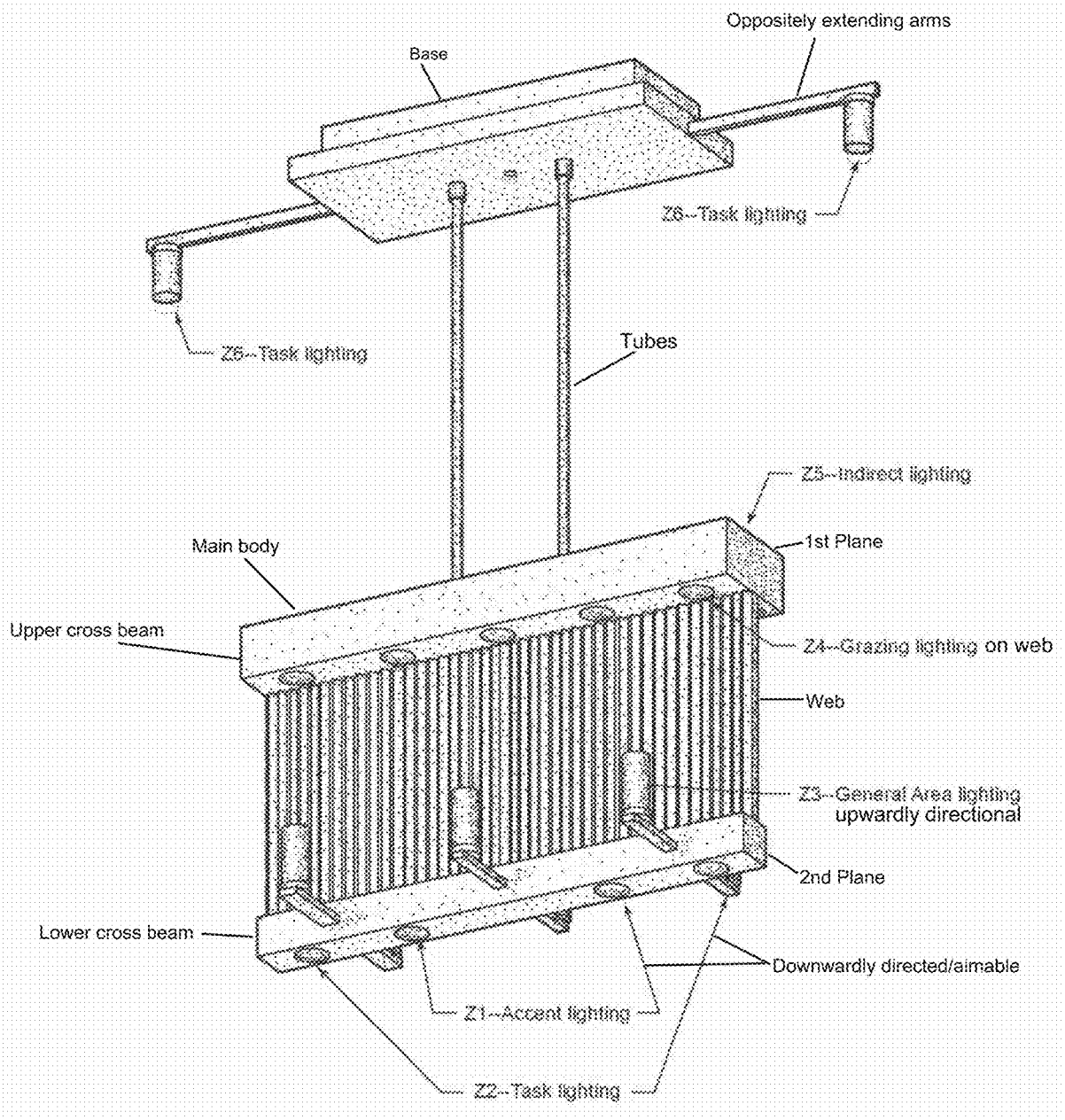
FIG. 17 is a perspective view of one embodiment of a lighting device, in this case a modern-style chandelier, incorporating multiple zones of lighting in a single support structure to create different scenes based on different combinations of the various zones and their settings in accordance with various embodiments.
Figure 18:
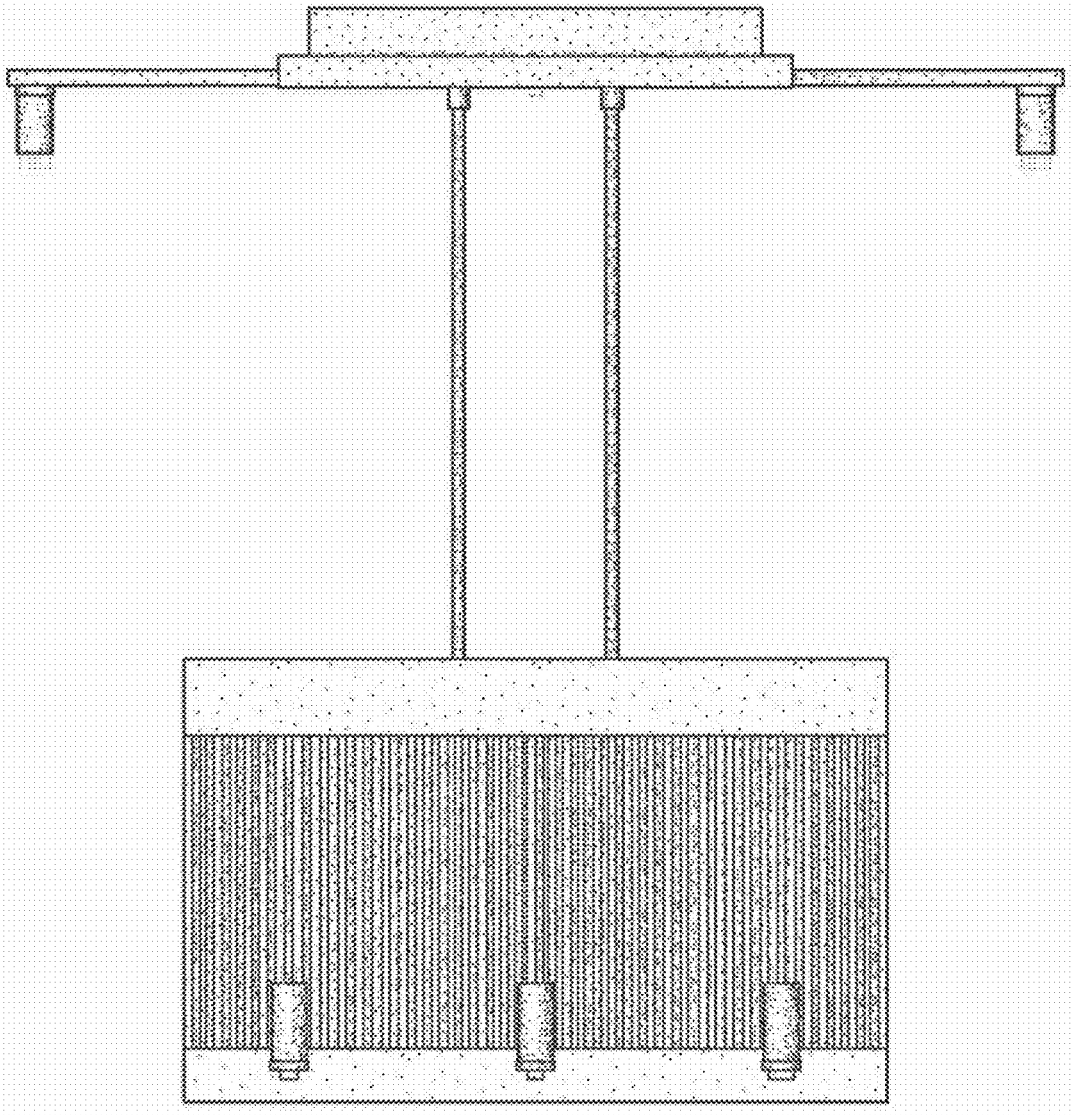
FIGS. 18 and 19 are side and end elevation views of the lighting device of FIG. 17.
Figure 19:
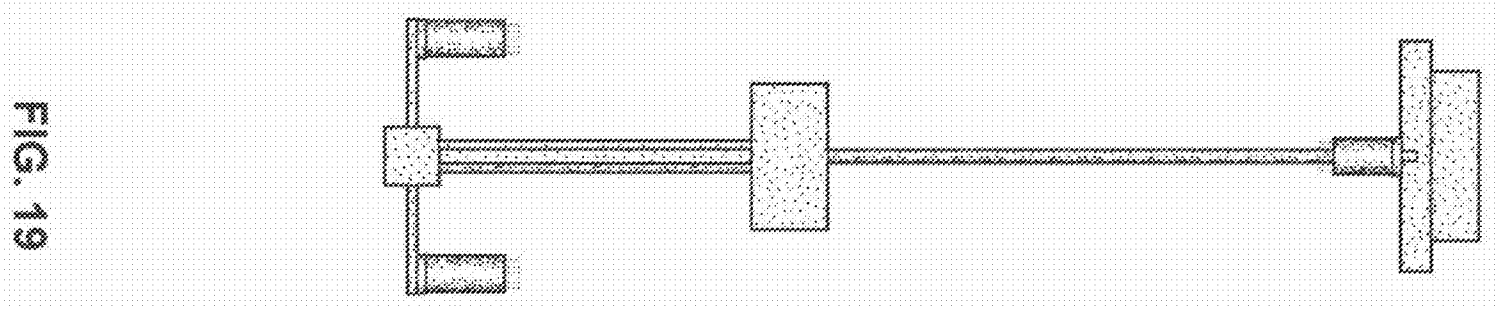
Figure 20:
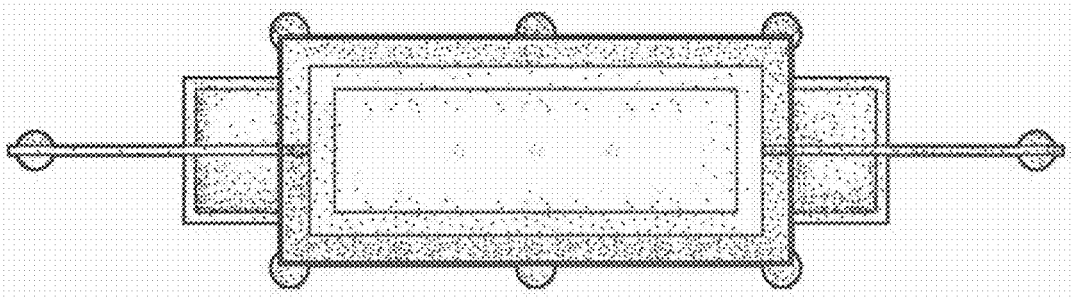
FIGS. 20 and 21 are top and bottom plan views of the lighting device of FIG. 17.
Figure 21:
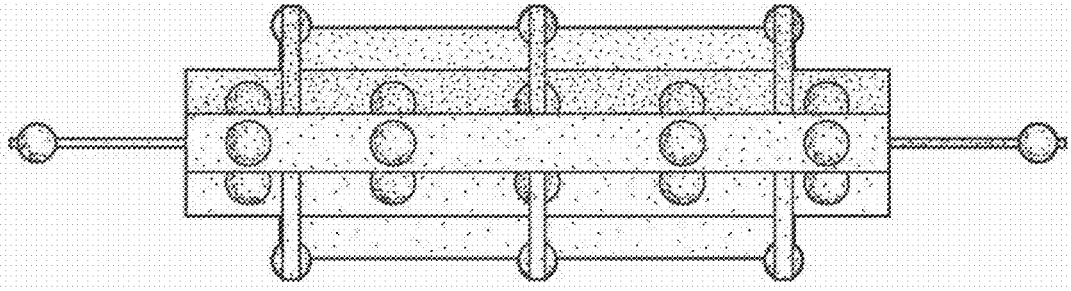
Figure 22:
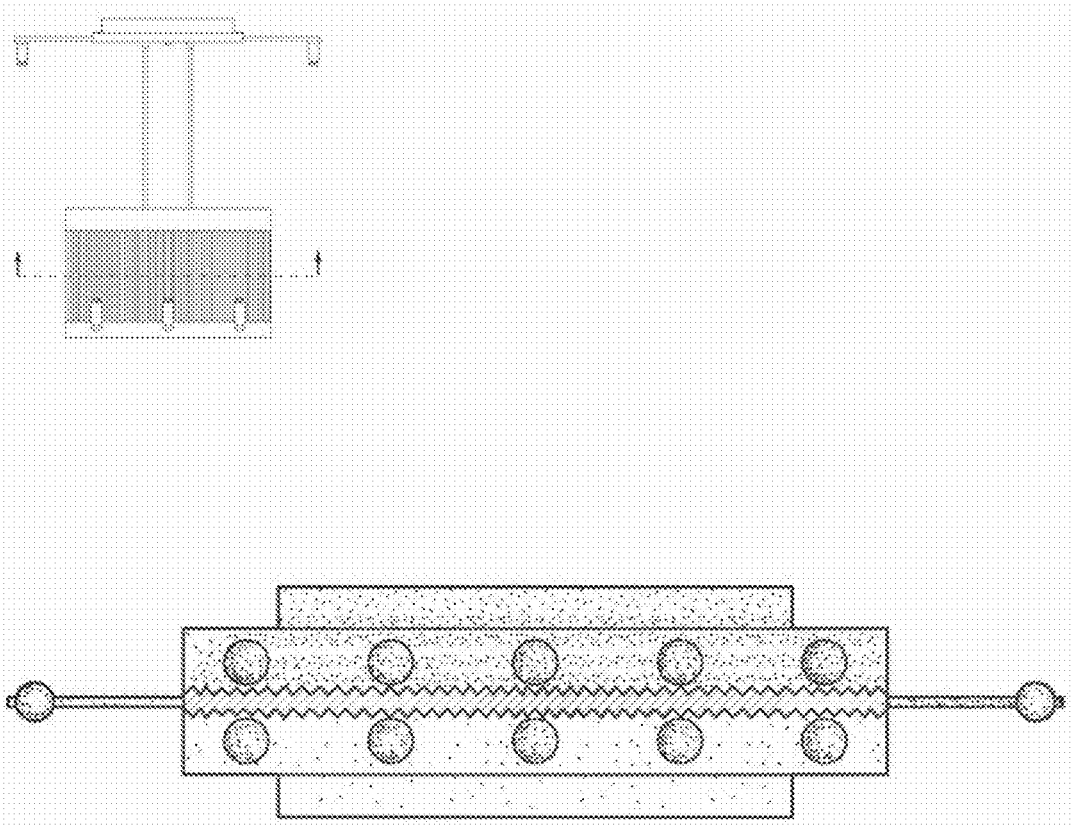
FIG. 22 is a cross-sectional view of the lighting device of FIG. 17.
Figure 23:
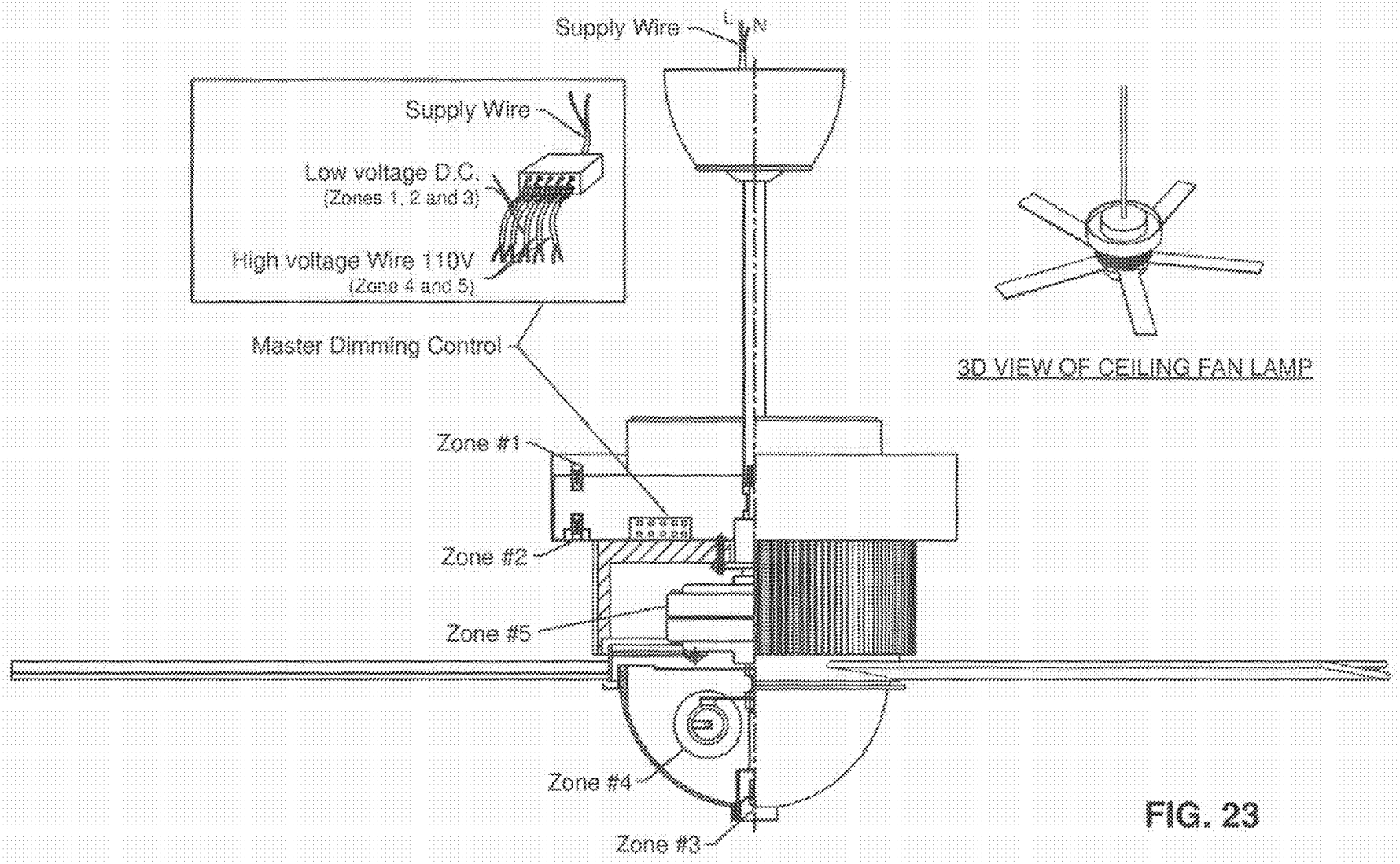
FIG. 23 is a side-elevation view of a second embodiment of a lighting device according to various embodiments, where the support structure of a ceiling fan-lamp, with partial cutaways to show interior structure.
Figure 24:
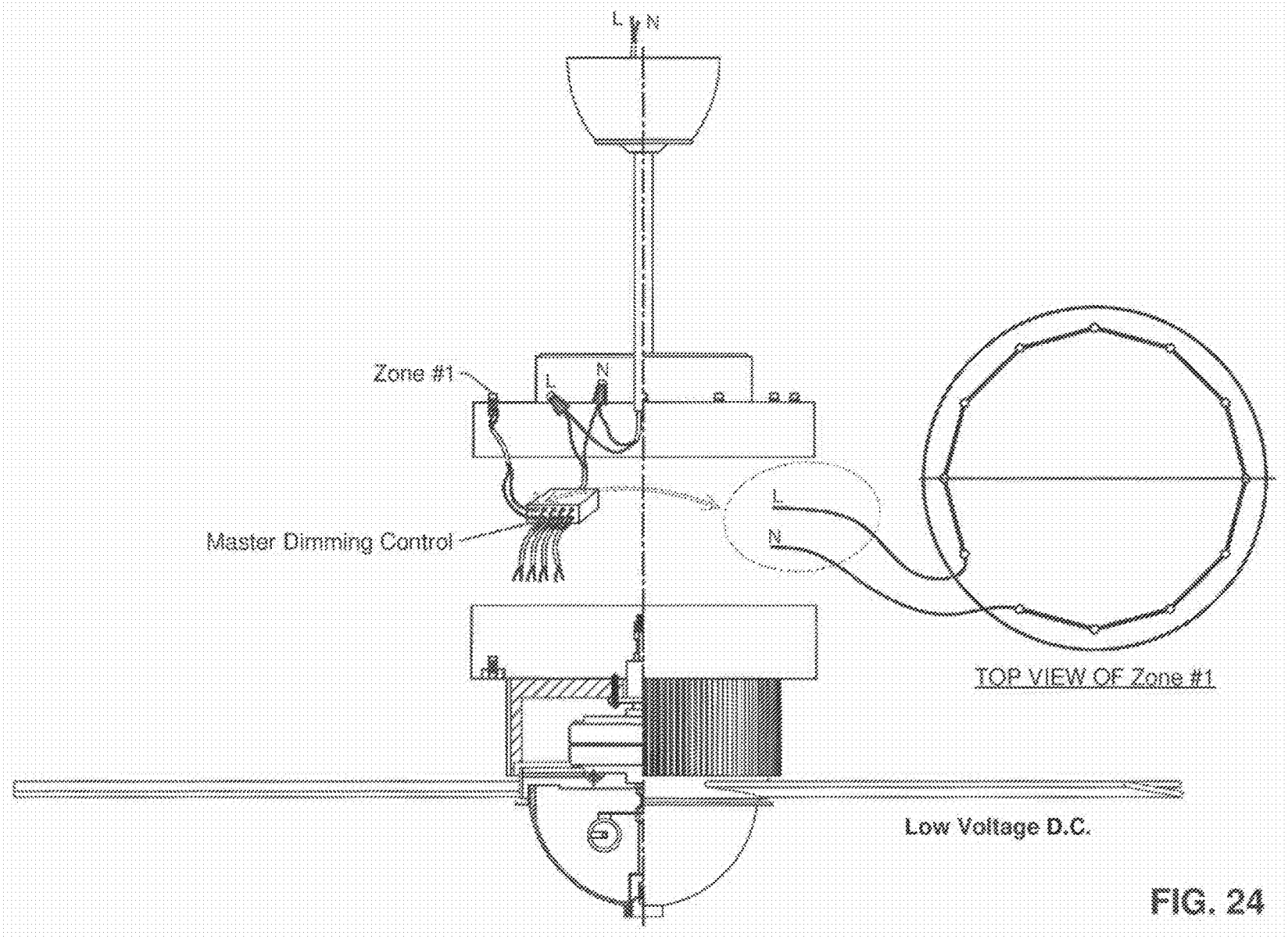
FIGS. 24-28 are elevation views similar to FIG. 23 showing details of wiring from the master dimming controller to each of the zones.
Figure 25:
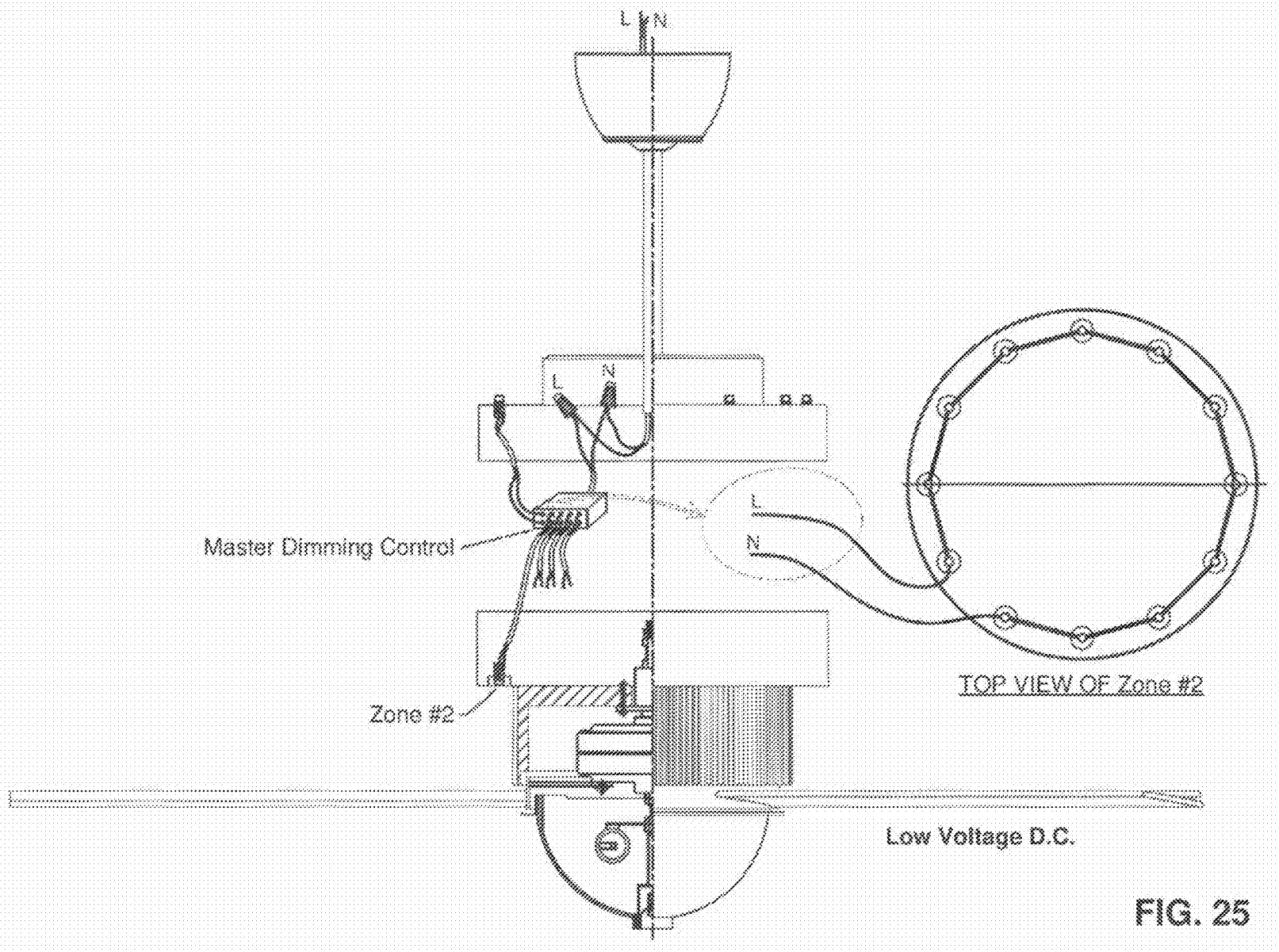
Figure 26:
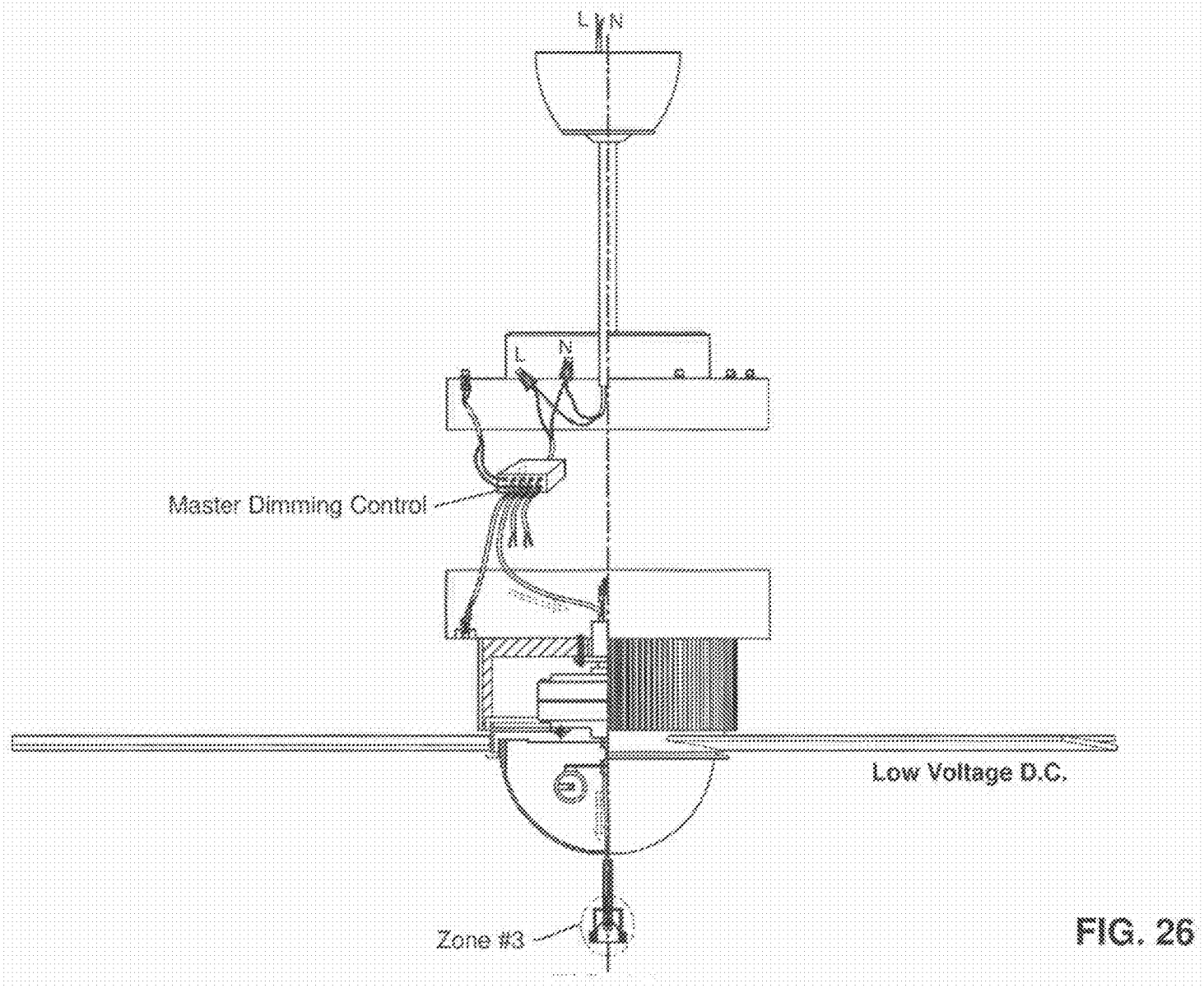
Figure 27:
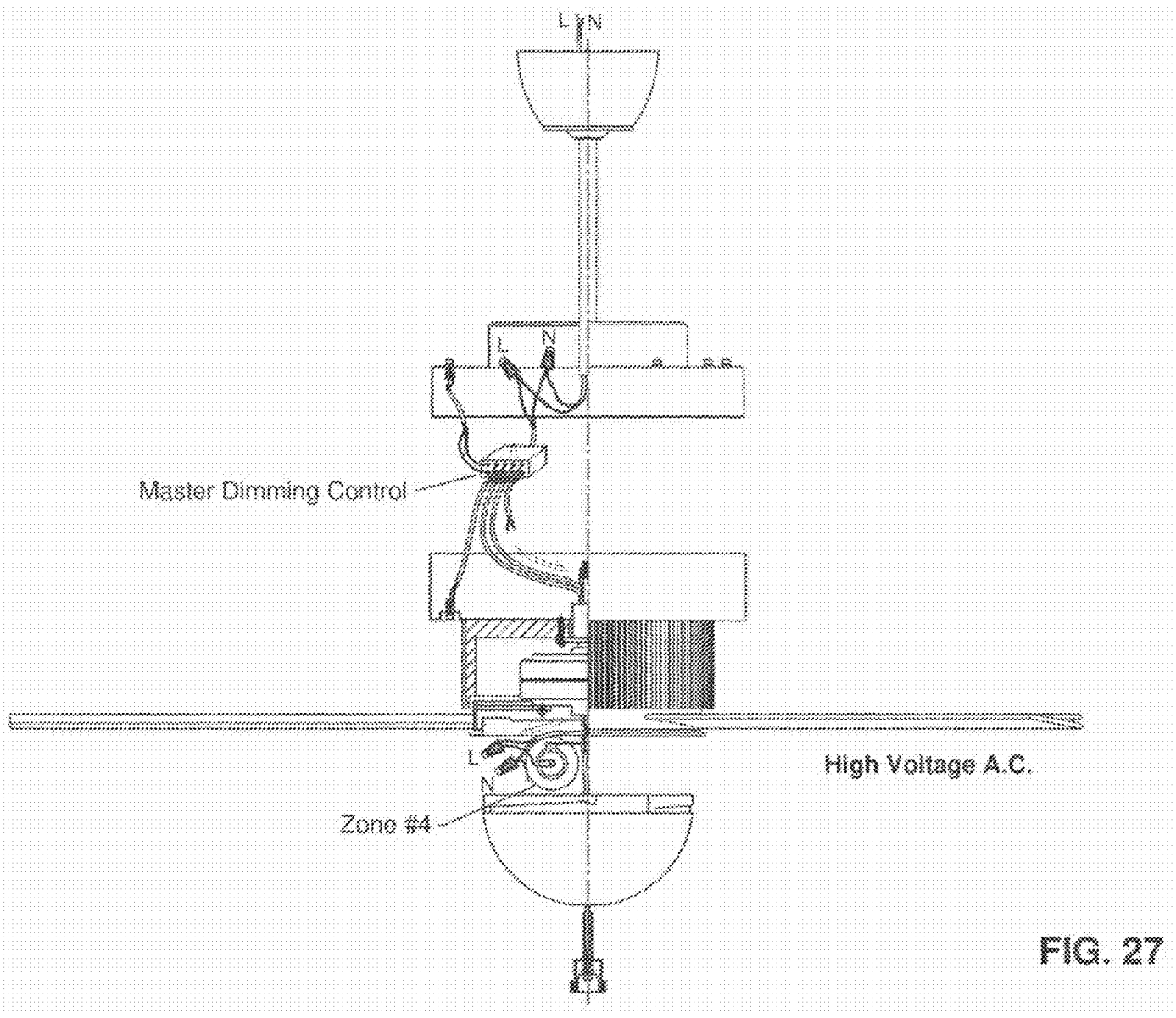
Figure 28:
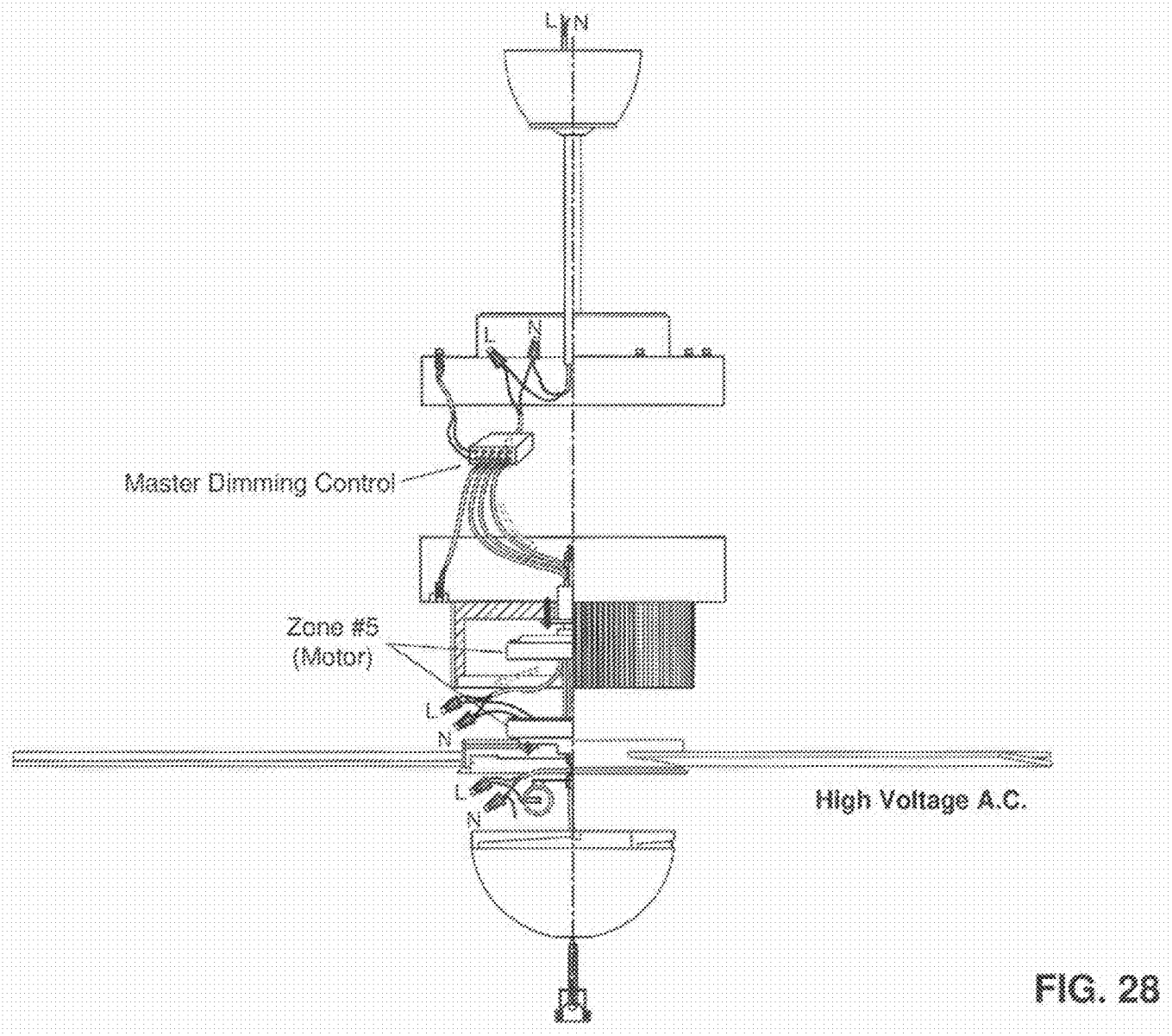
Figure 29:
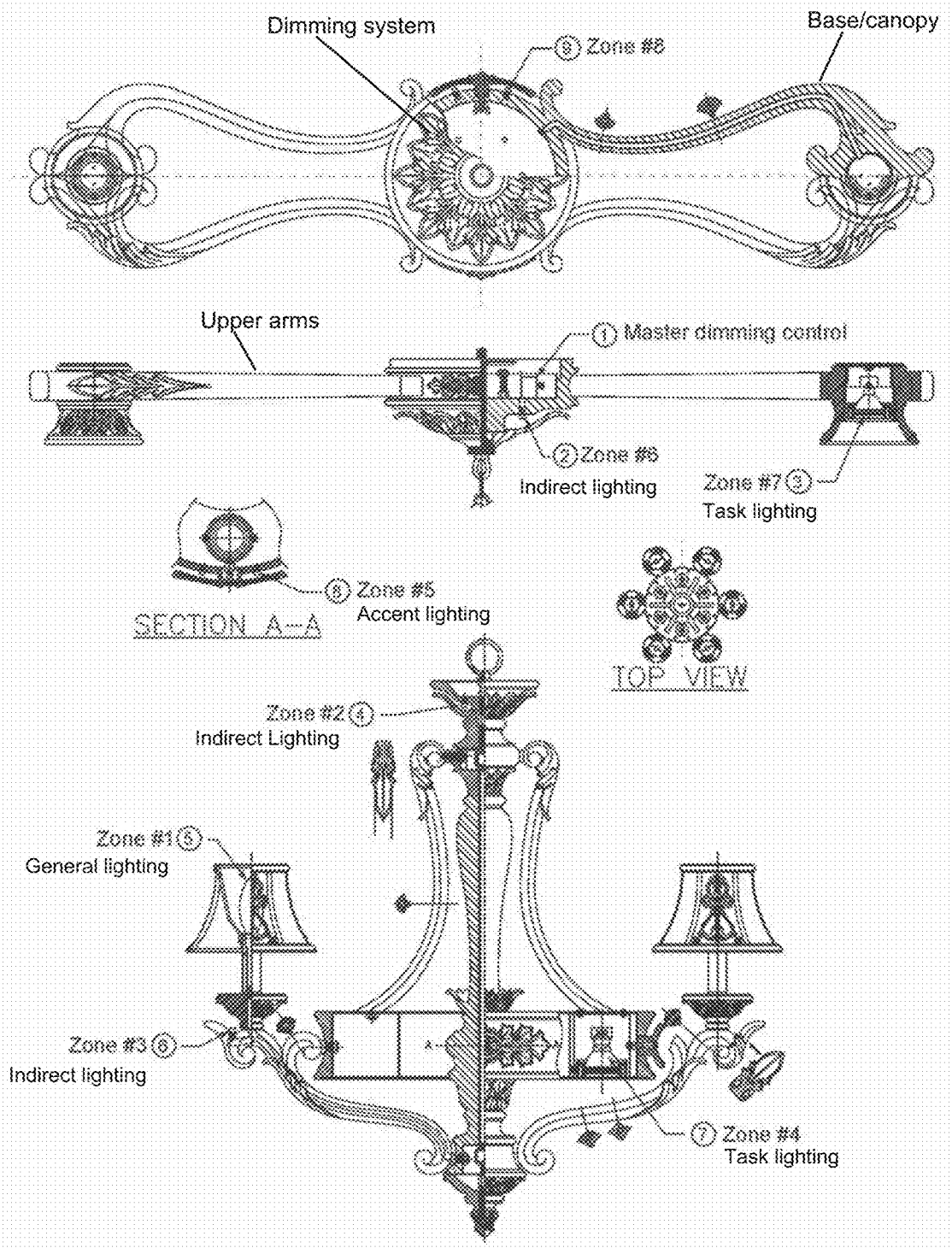
FIG. 29 is a composite of elevation and plan views of the elements of a third embodiment of a lighting device, in this case a classical-style chandelier, incorporating multiple zones of lighting in a single support structure, with partial cutaways to show interior structure.

FIG. 16 is a commonly used power supply implementation that can be used in the disclosed lighting device. Transformer 1603 reduces the 110 volt A.C. input via lines 1601, 1602 to 10 volts. A.C. Bridge rectifier 1604 and capacitor C11 convert the A.C. voltage to an unregulated D.C. voltage. The linear voltage regulator 1605 converts the unregulated D.C. voltage to a fixed +5 volt output to power the remaining keypad components. A zero-crossing input signal 1605 is output from the rectifier for use as signal 1301 in FIG. 13.

In each embodiment of the lighting device there are lighting zones. These zones can be included in any combination to create a plurality of scenes, preferably four to six scenes. For example, in a dining room application, it is common for the house wiring to allow for only one chandelier in the room, providing general lighting. When operated at full brightness, this chandelier causes an excessive amount of glare. It would be desirable to pre-set the general lighting function of the chandelier at less than full brightness to reduce glare while also providing accent lighting, indirect lighting and/or task lighting from the same chandelier.

Each remote controller has numerous scene buttons. By selecting a specific scene on one of the remote controllers, one or more zones are dimmed or one or more zones are raised in light intensity and one or more zones are turned on or off, one or more zones are dimmed or turned off while other zones increased in light intensity. Each of the scenes and fade rates of each of the scenes is pre-programmed at the factory but can be re-programmed via the remote controller.

Another desired option is a display mode, in which the scenes cycle, staying a pre-determined time such as 15 seconds at each scene and then fading to the next scene. Another option would be a security mode which could be programmed to come on at certain times of the night or a pre-selected scene would come on 30 seconds after outside motion lights or sensors were activated. This would only happen in the away mode.

2. Multi-Lighting Zone Examples

Following are three examples of lighting devices implementing according to the various embodiments herein.

Example 1 is illustrated by FIGS. 17-22. FIGS. 17-22 show a modern-style chandelier incorporating six zones of lighting fixtures. Each of these zones is connected to and controlled by a master dimming controller, as previously described, mounted in the ceiling base. Zone 6 Task lighting is powered from the controller through A.C. power lines extending through the base and the oppositely extending arms to the fixtures. Zones 1 through 5 are powered by separate lines extending from the master dimming controller in the base through tubes that suspend the main body of the chandelier from the base. The main body of the chandelier in this example has upper and lower cross beams interconnected by a web. Zones 1 and 2 are downwardly directed lamps, which may be aimable, to provide accent lighting and task lighting. Zone 3 has six upward-directed lamps to provide general area lighting. The upper bar includes ten Zone 4 lamps, best seen in FIG. 22, that are downward directed and spaced close to the web to providing grazing lighting on the face of the web which may be grooved to create artistic light effects. The upper bar also includes Zone 5 lamps, best seen in FIG. 21 that are upward directed to illuminate the surrounding ceiling and thereby provide indirect lighting.

Example 2 is illustrated by FIGS. 23-28. FIGS. 23-28 show a ceiling fan lamp incorporating five zones: four zones of lighting fixtures (Zones 1-4) plus one zone (Zone 5) for the fan motor. Zones 1, 2 and 3 utilize low voltage lighting fixtures, which can be LEDs or high intensity lamps to provide different illumination effects, and are controlled by low voltage outputs from the master dimming control. Zone 4 is a high voltage zone to provide general illumination from an incandescent lamps. Zone 5 is the fan motor circuit, for which the master dimming controller can provide speed and direction controlled power signals.

Example 3 is illustrated by FIGS. 29-38. FIGS. 29-38 show another example of a chandelier with a master control dimming system. In this particular embodiment, the dimming system is in the base or canopy of the light fixture mounted to the fire-plate. In this embodiment, the chandelier uses the Echelon power line Smart Transceivers to communicate between the chandelier and a remote control dimmer, mounted in a wall box. A wireless handheld remote can also communicate with the master dimming control mounted within the canopy. (It is understood that other companies in addition to Echelon offer power line technology.)

In FIGS. 29-38, the chandelier has 8 different zones. Each zone performs a different lighting effect such as in zone 1 general area lighting (see e.g., FIG. 31); in zone 2 indirect lighting near the top of the body of the chandelier (see e.g., FIG. 32); in zone 3 indirect lighting behind the decorative badges around the center decorative ring (see e.g., FIG. 33); in zone 4 task lighting (see e.g., FIG. 34); in zone 5 accent lighting under the chandelier's decorative ring (see e.g., FIG. 35); in zone 6 indirect lighting around and on the bottom side of the canopy (see e.g., FIG. 36); in zone 7 task lights on the upper arms extend in opposite directions from the canopy beyond the diameter of the body of the chandelier (see e.g., FIG. 37); and in zone 8 indirect lighting within the canopy (see e.g., FIG. 38).

The lights on the ends of the ceiling canopy arms (Zone 7) extend beyond the diameter of the chandelier so that their light beams are not blocked by the chandelier.

Figure 30:
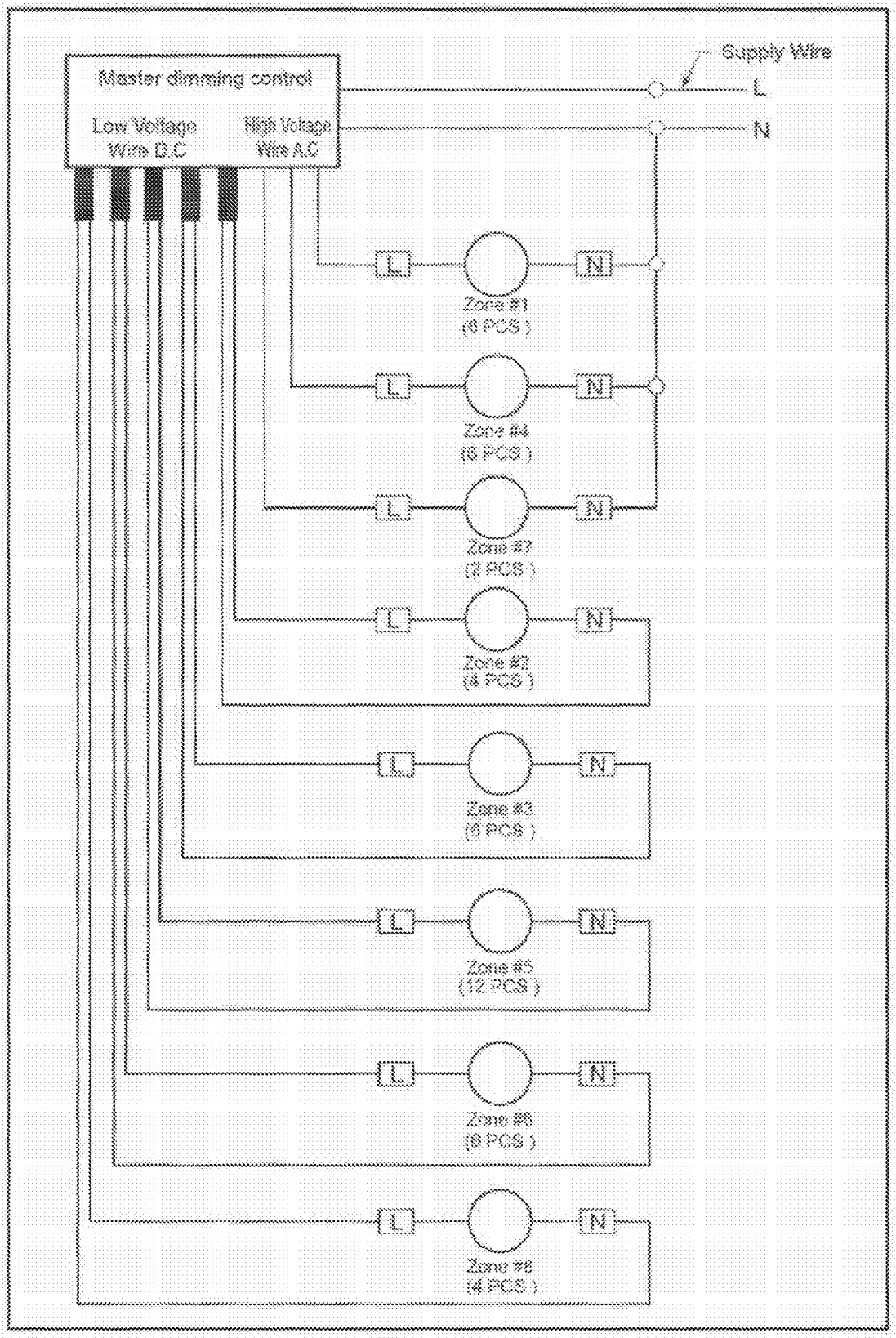
FIG. 30 is a wiring diagram for the lighting device of FIG. 29.

FIG. 30 is a schematic of wiring from the master dimming control to the various zones.

One hot wire from the master dimming control to each of the high voltage zones in the chandelier (Zones 1 and 4) plus one neutral wire and a ground wire are laced through the chain and fed through the screw collar loop and pipe nipple. The wires pass out of the pipe nipple in the electrical box and are connected to the master dimming control. One hot wire from each of the high voltage zones in the ceiling canopy (Zone 7) plus one neutral wire and a ground wire are also connected to the master dimming control. Wire connections could be completed with wire nuts or a quick-connect device. Each of the low voltage zones (Zones 2, 3, 5, 6 and 8) are connected to the low voltage terminals of the master dimming control via DC wire pairs.

Figure 31:
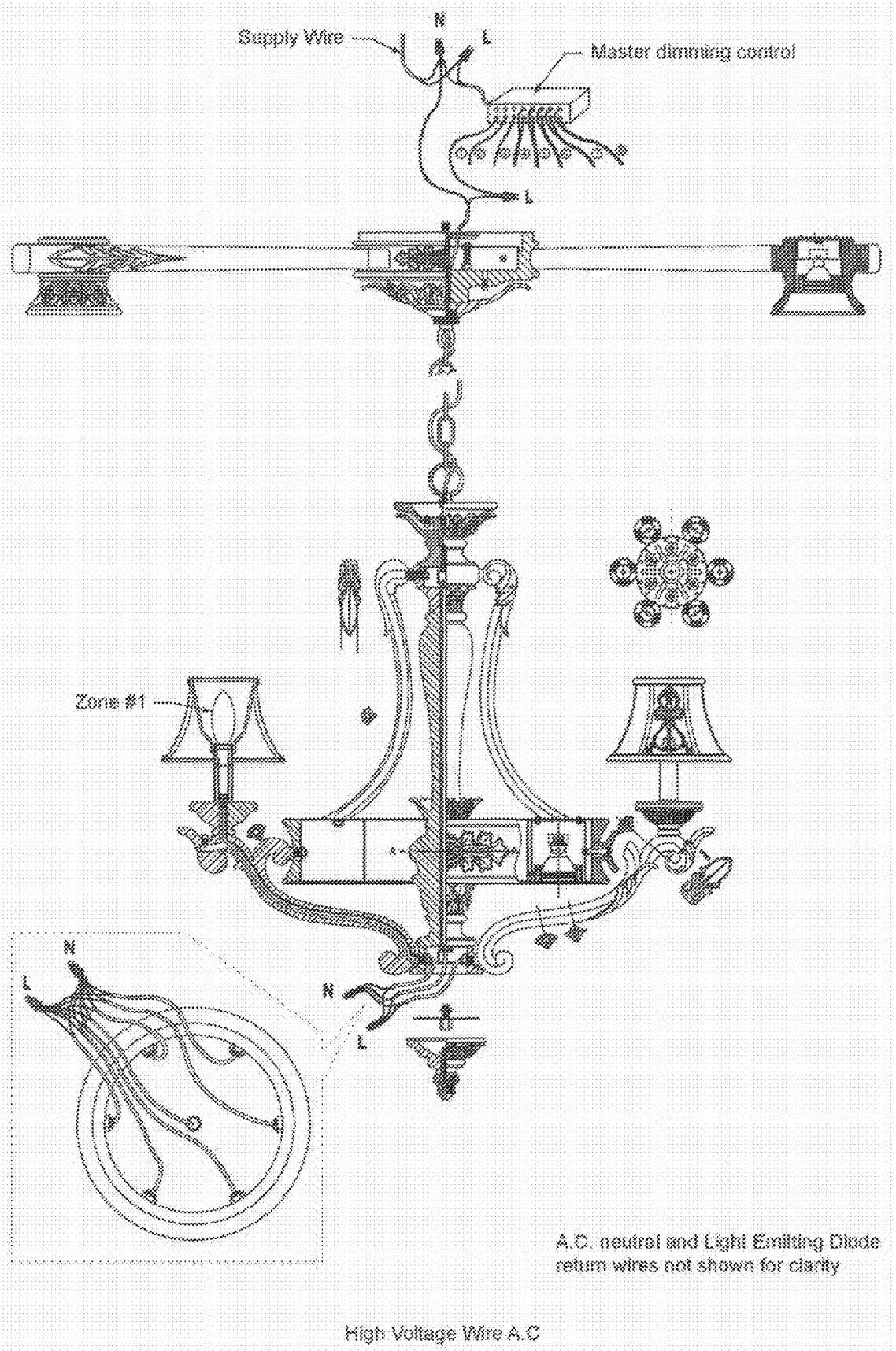
FIGS. 31-38 are elevation views of the lighting device of FIG. 29 showing details of wiring from the master dimming controller to each of the zones.
Figure 32:
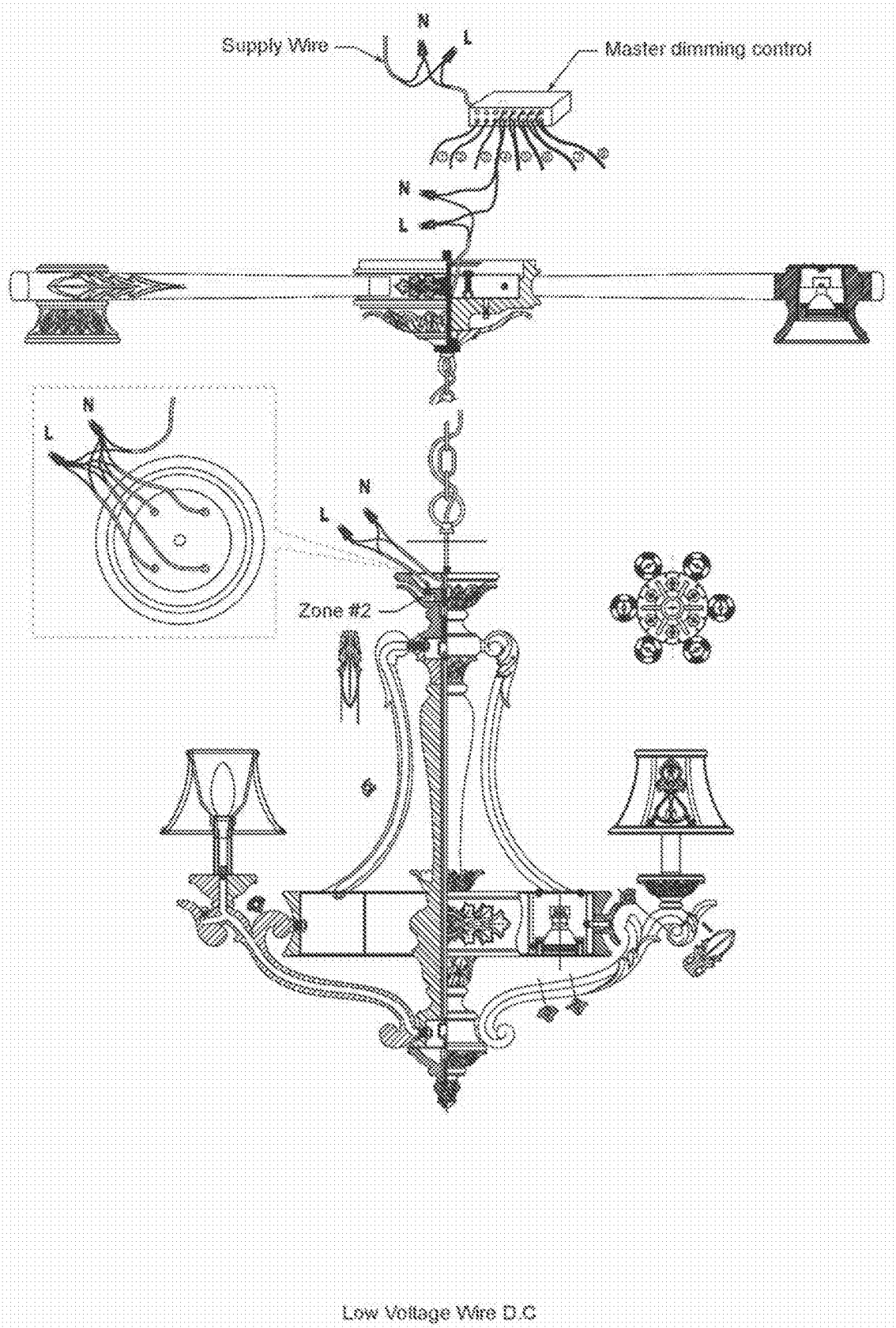
Figure 33:
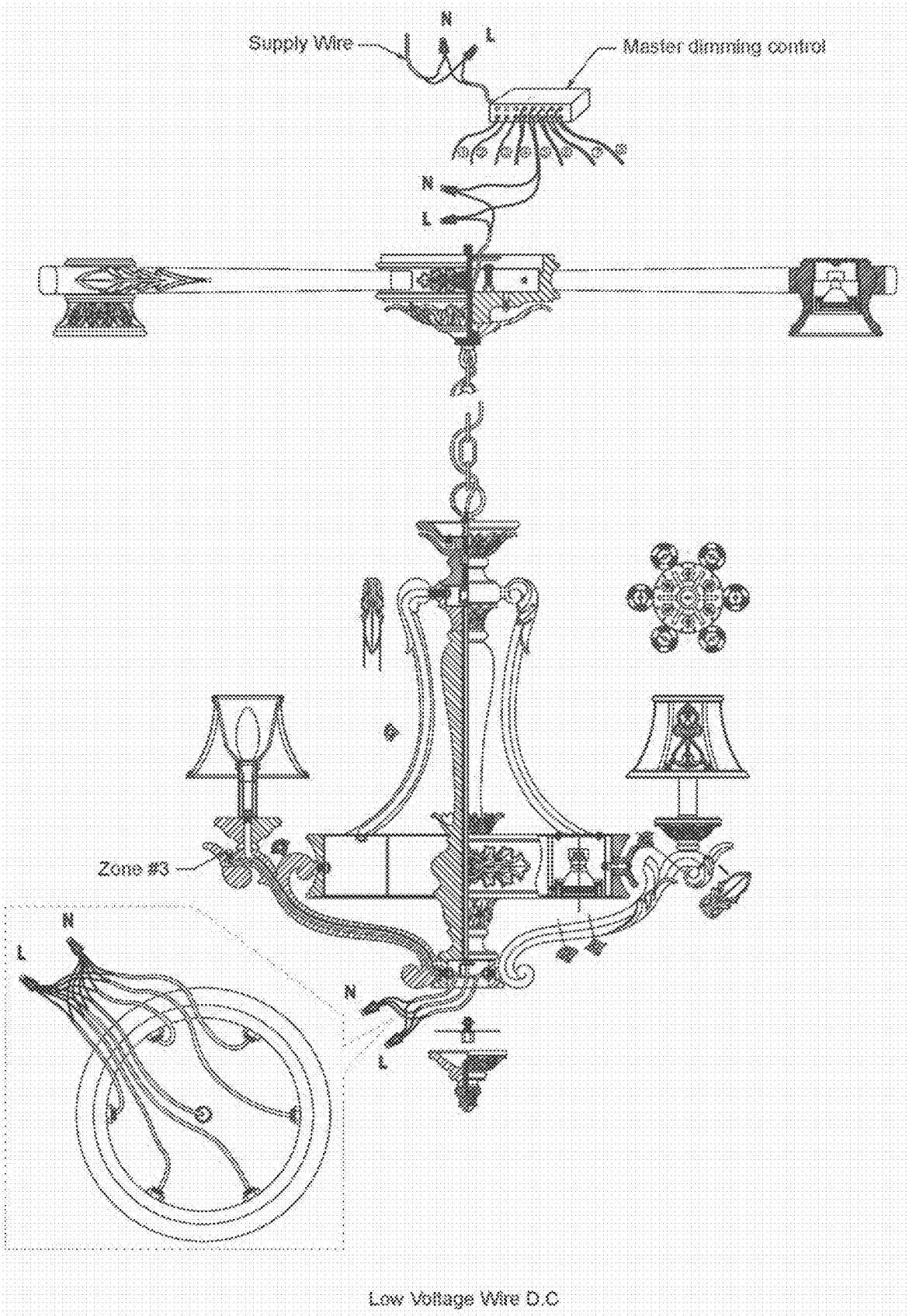
Figure 34:
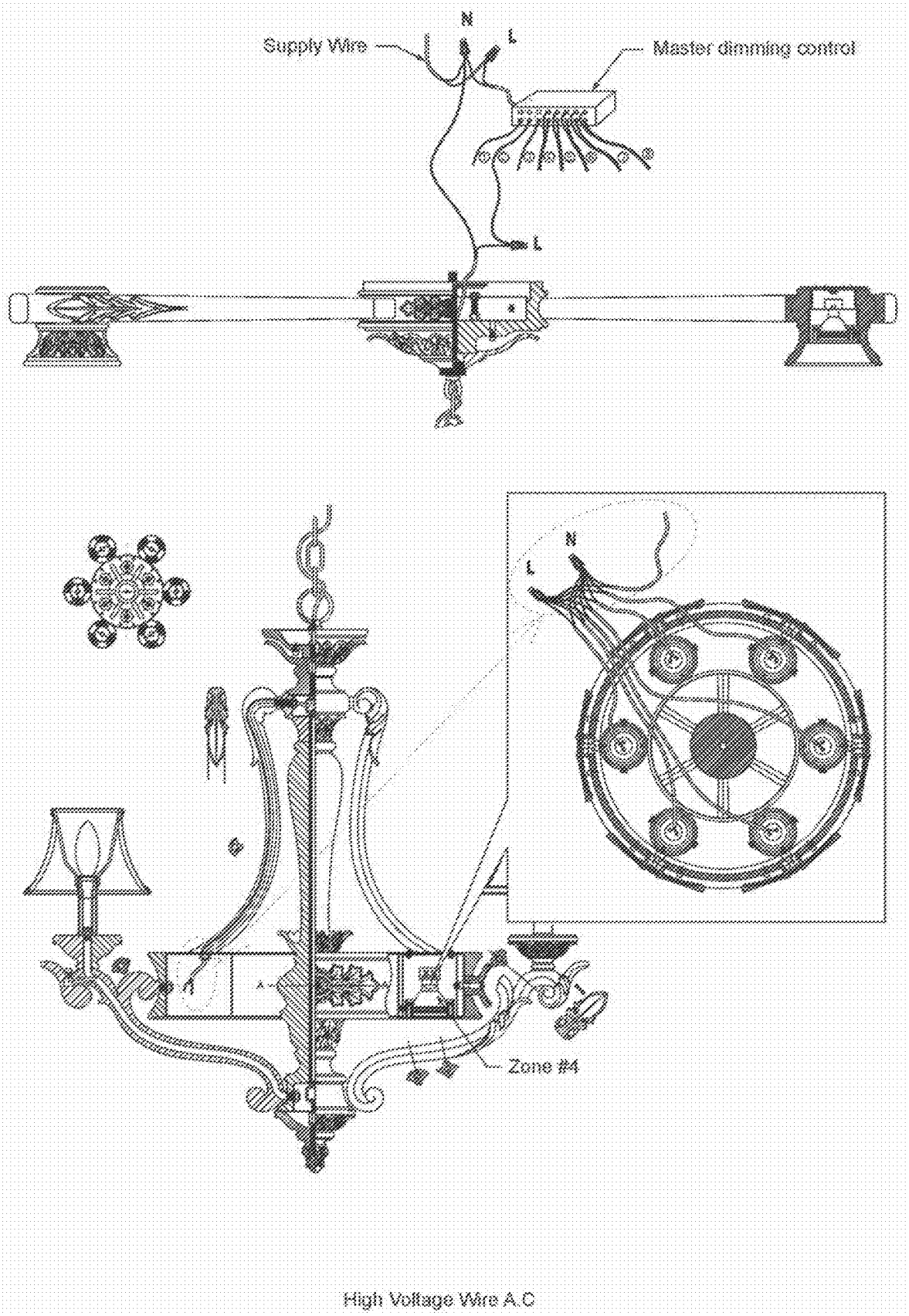
Figure 35:
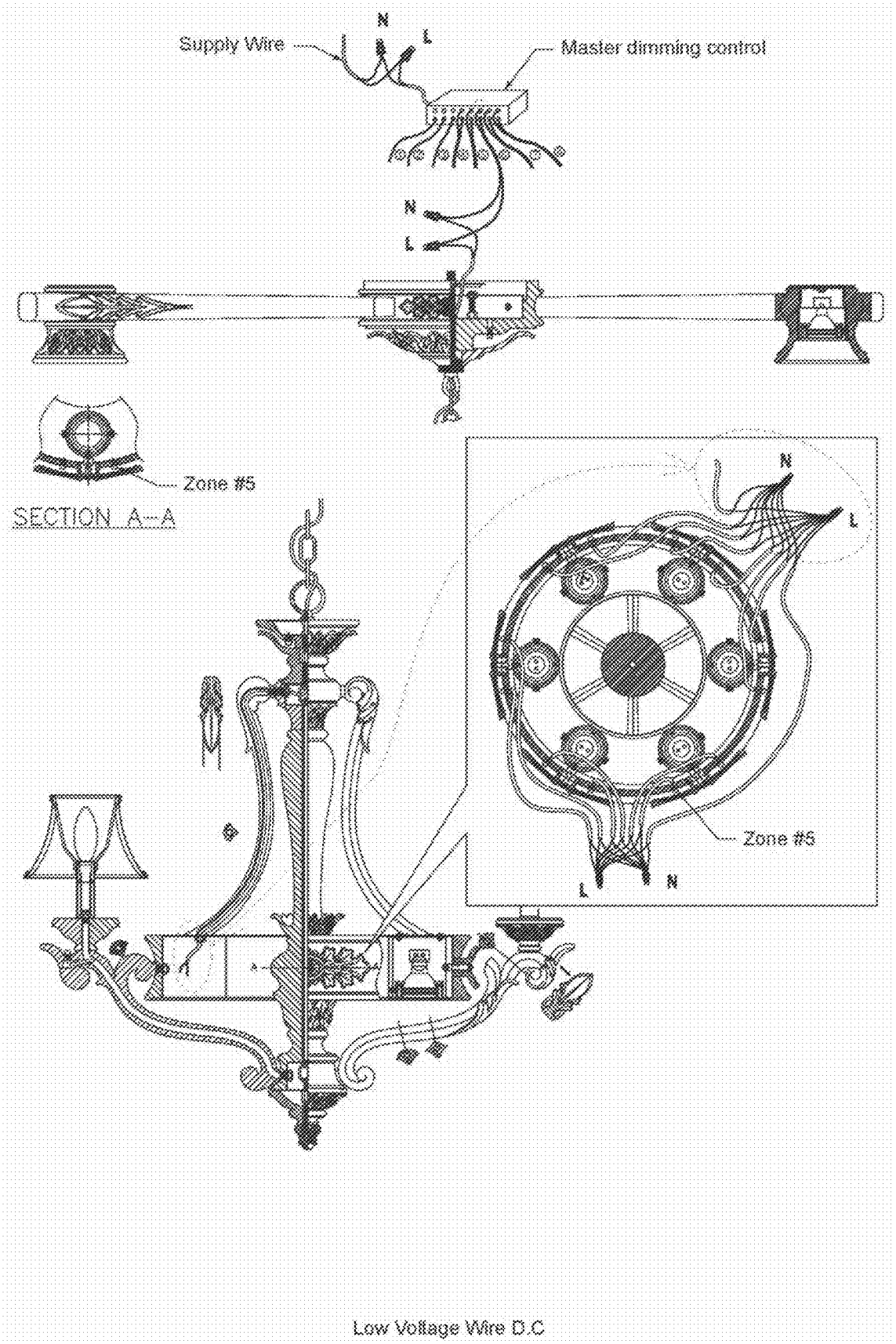
Figure 36:
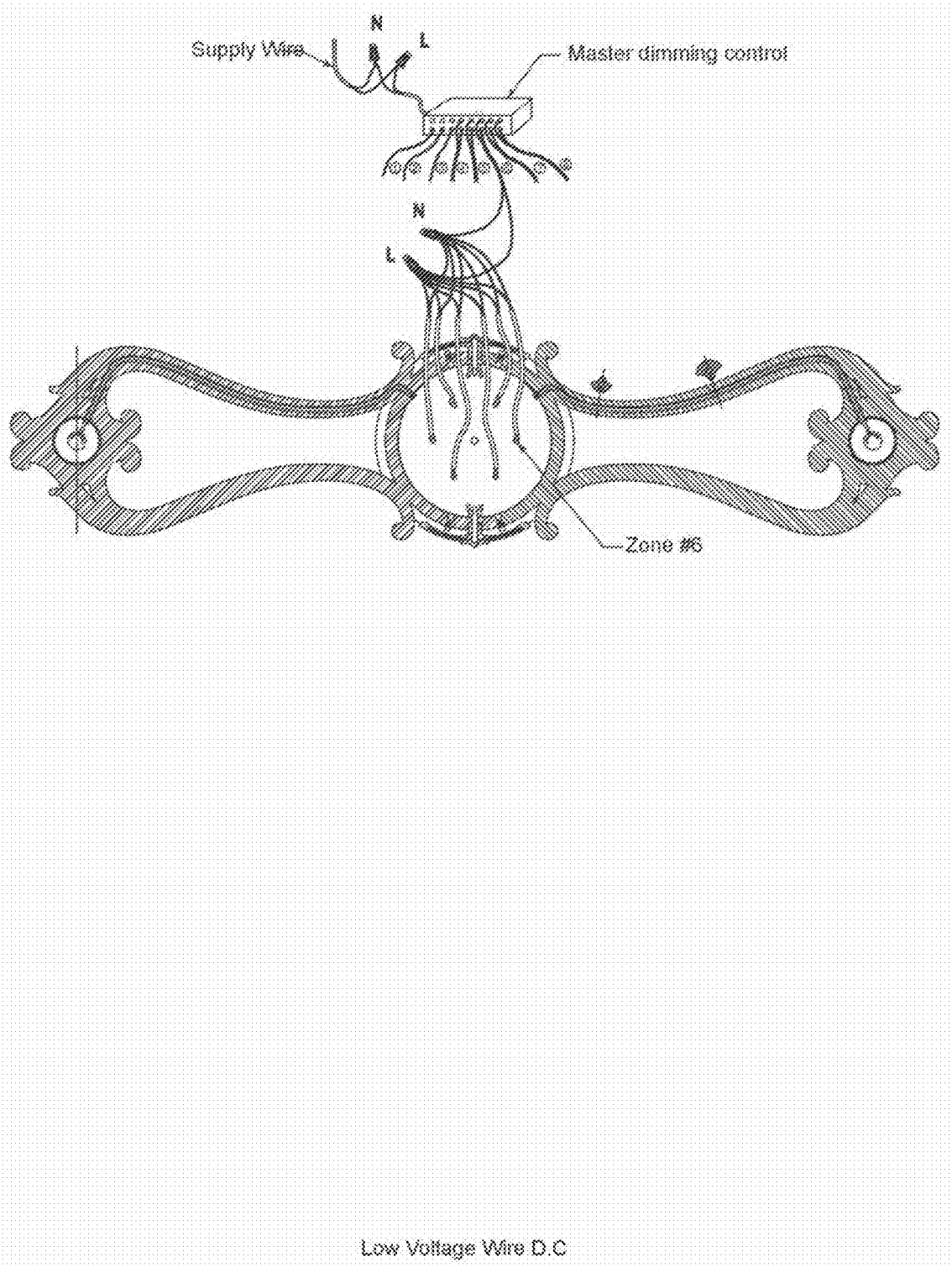
Figure 37:
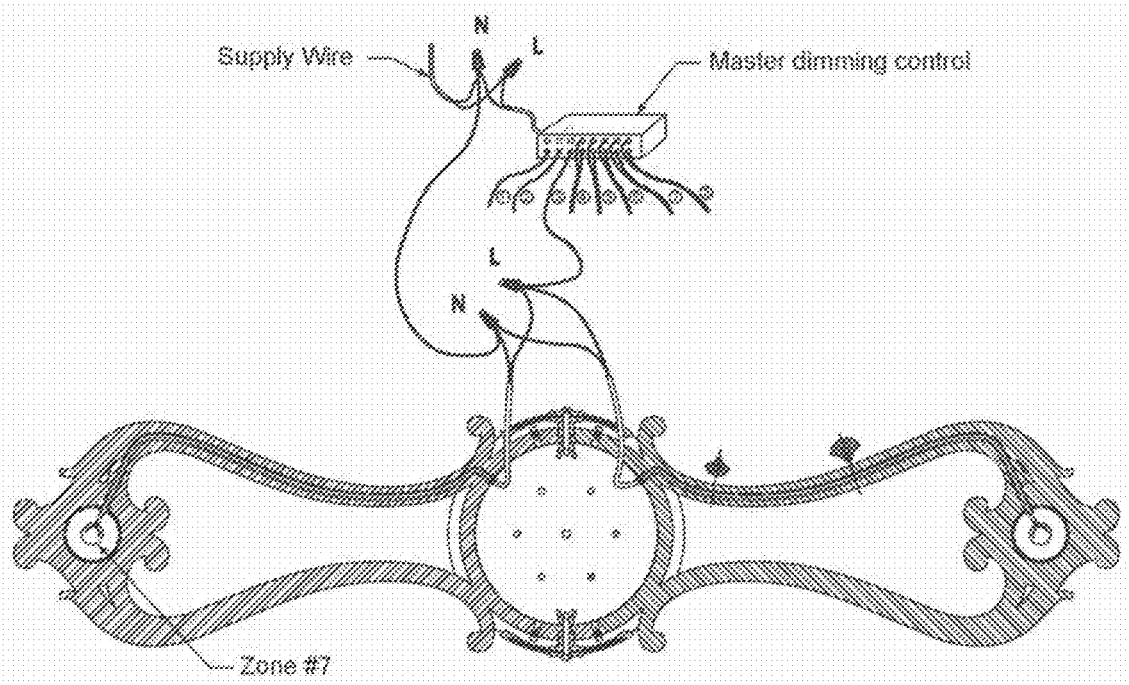
Figure 38:
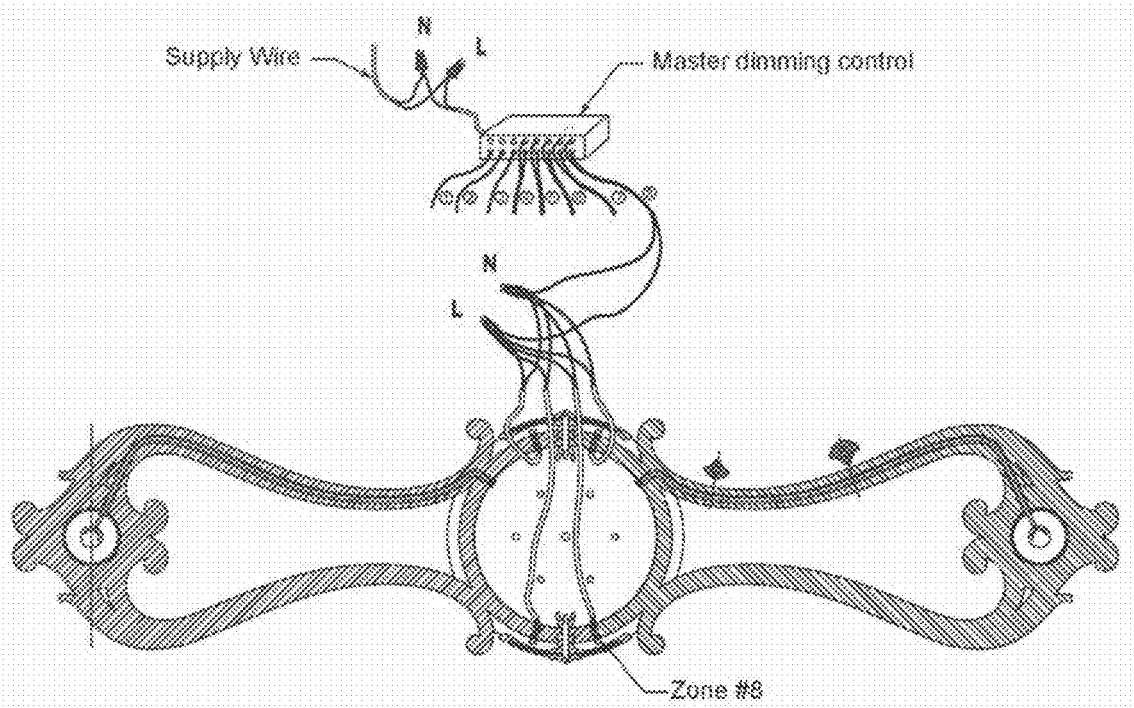
Figure 39:
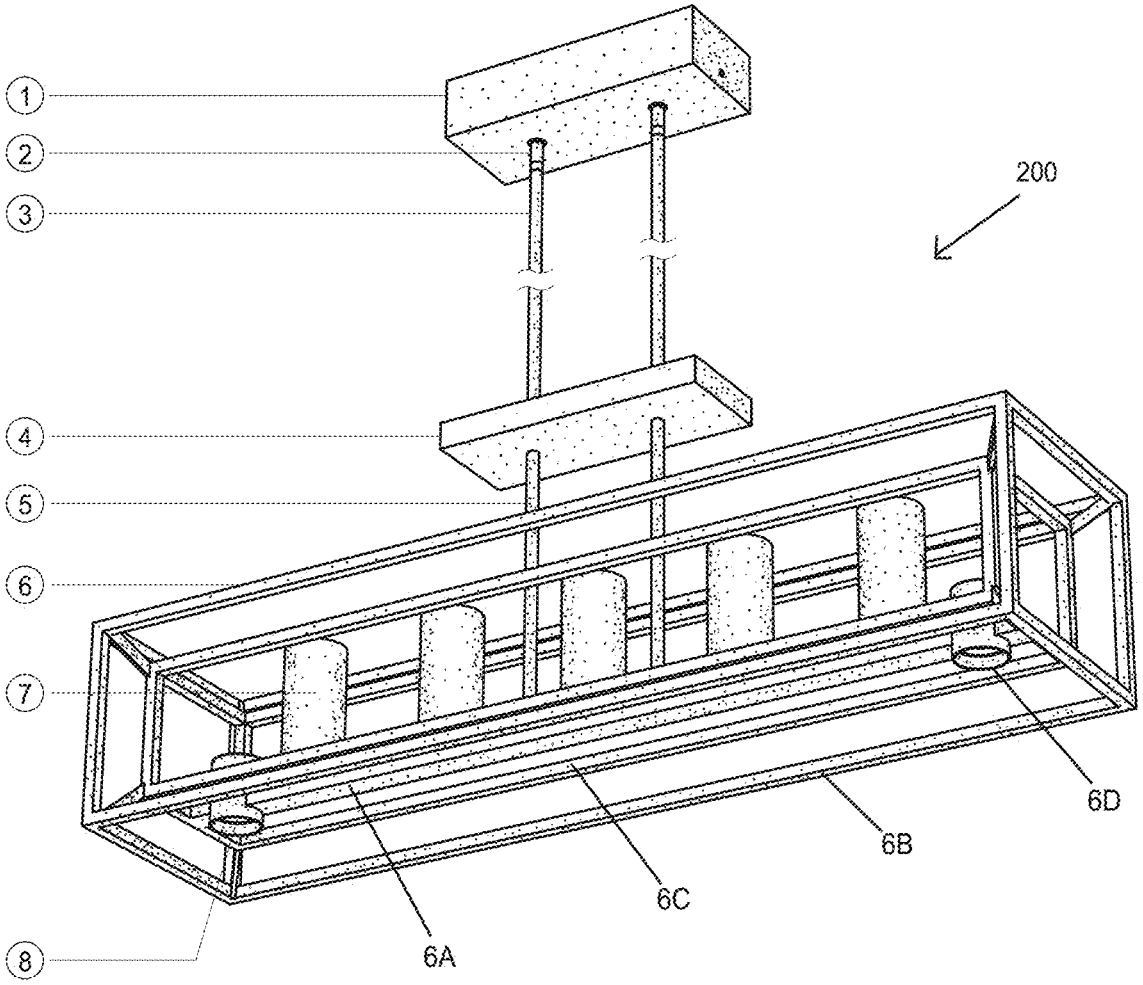
FIG. 39 is a perspective view of another multi-zone lighting device.
Figure 40:
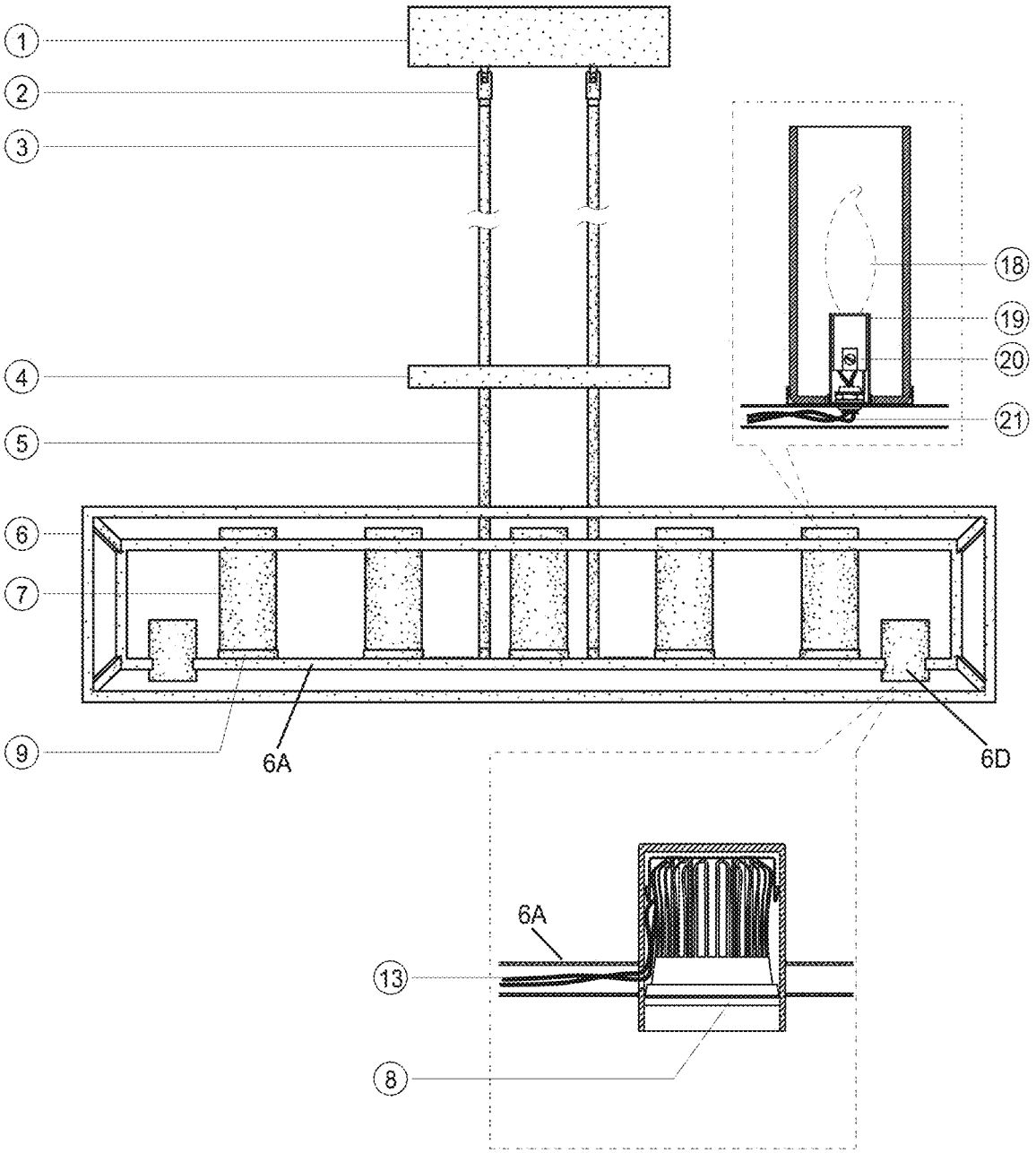
FIG. 40 is a side view of the lighting device of FIG. 39.
Figure 41:
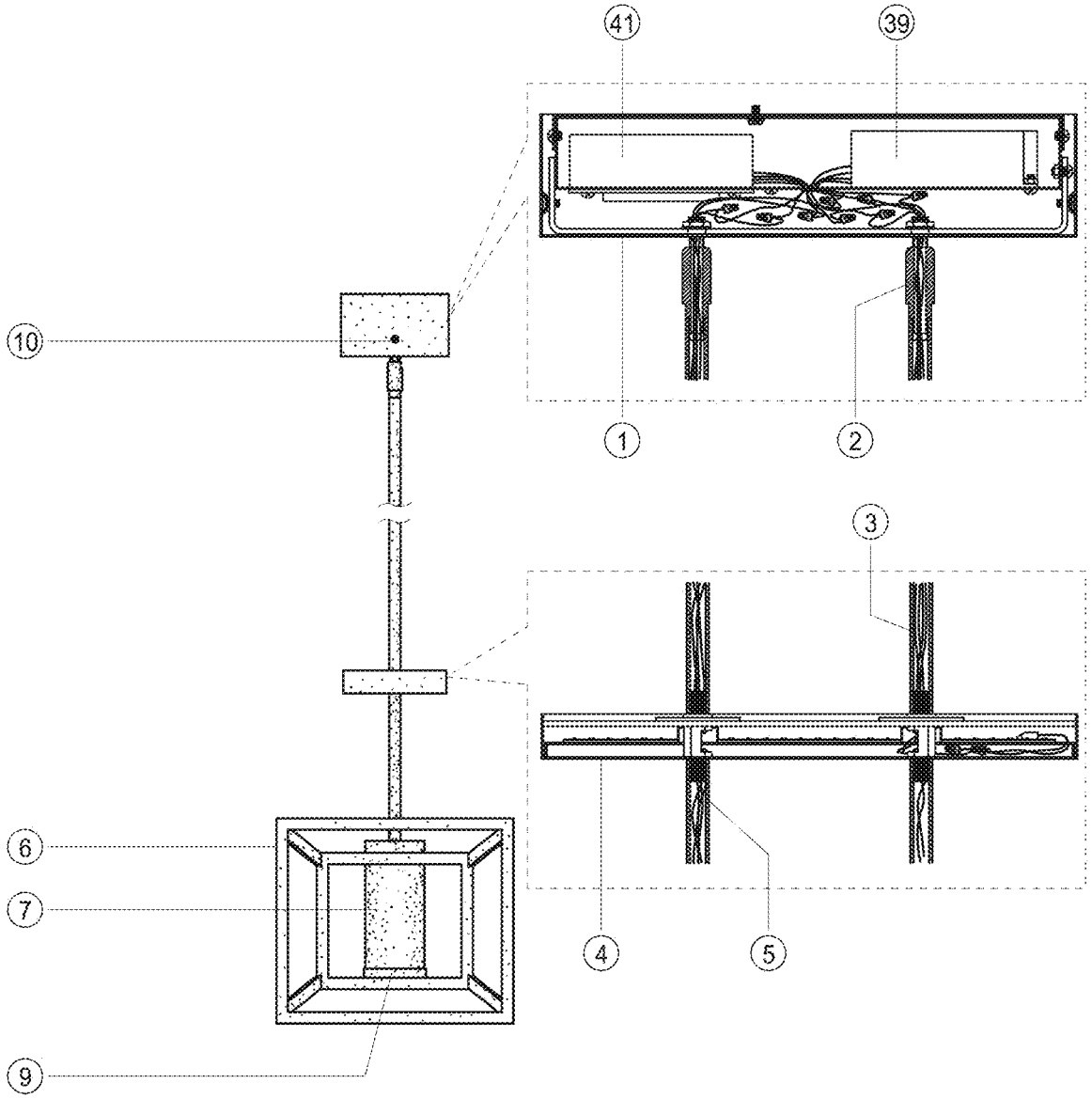
FIG. 41 is an end view of the lighting device of FIG. 39 and side sectional views of a canopy and an indirect up-lighting housing for the lighting device.
Figure 42:
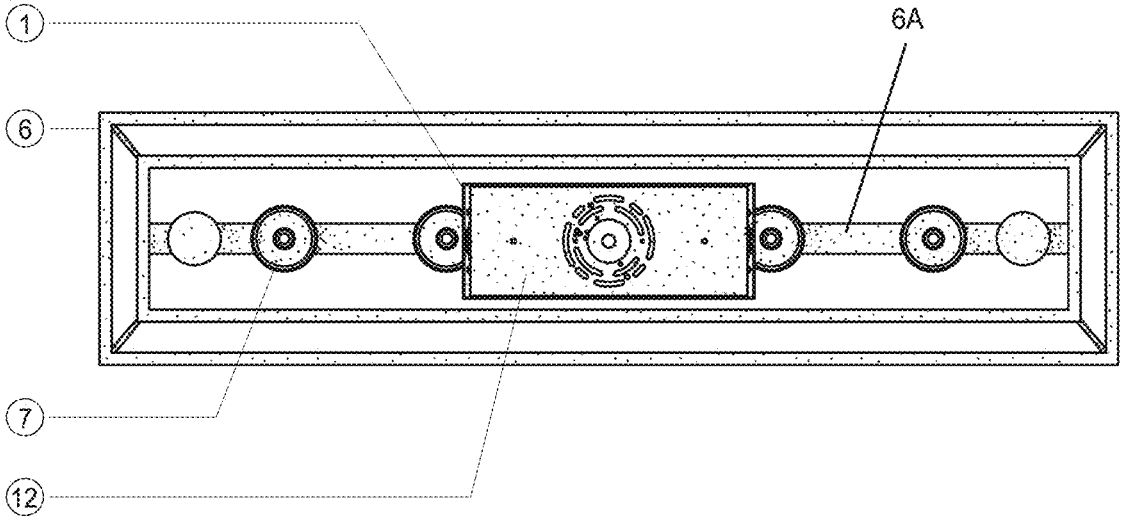
FIG. 42 is a top view of the lighting device of FIG. 39.
Figure 43:
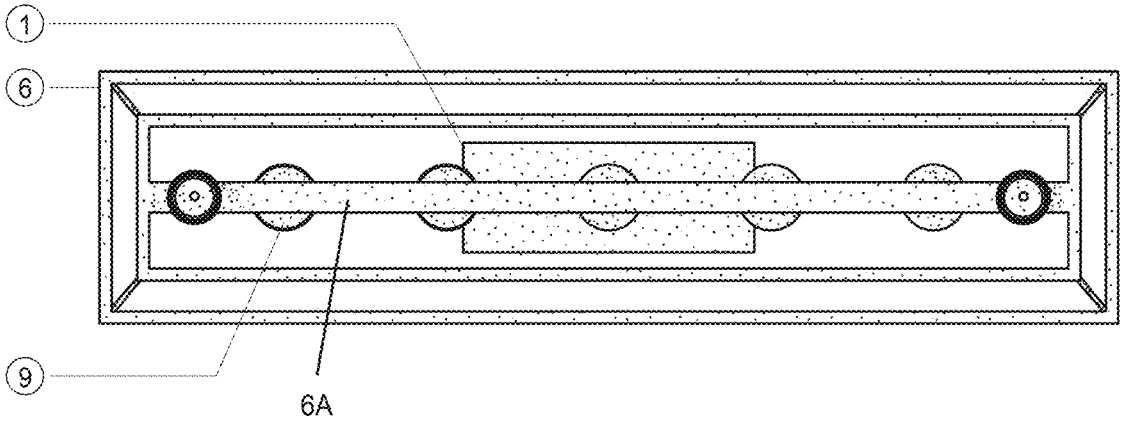
FIG. 43 is a bottom view of the lighting device of FIG. 39.
Figure 44:
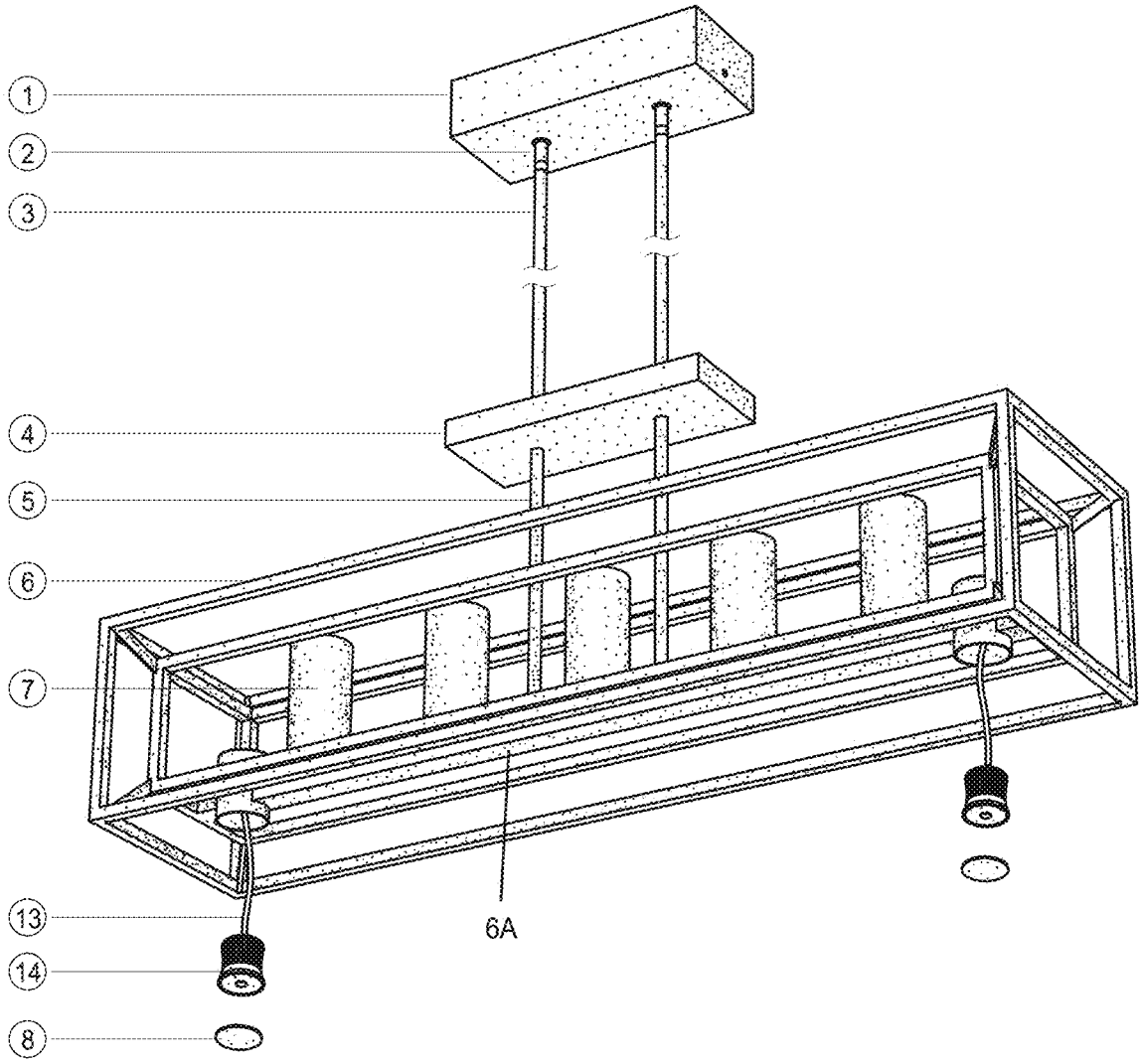
FIG. 44 is a perspective view of the lighting device of FIG. 39 with exploded down-lighting light source modules.

A single AC power supply wire comes into the master dimming control in the canopy and power is distributed to the various zones from there. FIG. 31 shows exemplary high voltage wiring from the Zone 1 output of the master dimming control to the six lighting fixtures of Zone 1. Similar high voltage connections are shown in FIGS. 34 and 37 for Zones 4 and 7. FIG. 32 shows exemplary low voltage wiring from the master dimming control to the four low voltage lighting fixtures of Zone 2. Similar low voltage connections are shown in FIGS. 33, 35, 36 and 38 for Zones 3, 5, 6 and 8.

As used in this application and its claims, a "wall-box dimmer" is a dimmer that is sized to fit in a standard single-gang or multi-gang switchbox, defined by the USA's National Electric Code. A wall-box dimmer could also be a single master dimmer control that fits in to a standard electrical multi-gang switchbox. Example wall-box dimmers are shown in shown in patents U.S. Pat. Nos. 5,905,442; 5,530,322; and 4,733,158. Examples of commercially available wall-box dimmers are the GRAFIK EYE®, RADIORA® 2, and CASÉTA® dimmers provided by Lutron Electronics Co., Inc., 7200 Suter Road, Coopersburg, Pa. 18036; the MULTISET PRO dimmers provided by Genlyte Thomas Group LLC, 3 Burlington Woods Drive, Burlington, Mass. 01803 under the LIGHTOLIER® brand; and the ADORNE® collection dimmers provided by Legrand North America, Inc., 60 Woodlawn Street, West Hartford, Conn. 06110. There are many other commercially available wall-box dimmers, as well.

Each of the wall-box dimmers may configured to control a corresponding lighting zone of a lighting fixture. Thus, for example, the zone dimmer 308 (FIG. 3) and the zone dimmer 405 (FIG. 4) may be wall-box dimmers. Each lighting zone includes one or more lighting sources or lamps. Also, each of the wall-box dimmers may be configured to receive activation instructions from a remote controller, such as the remote control device 312 (FIG. 3), and utilize those activation instructions to effect a corresponding setting to the corresponding lighting zone.

Thus, for example, a user may select a particular scene by activating one or more buttons on a controller that is remote from the lighting fixture. As noted above, the remote controller may be a mobile device, such as a smartphone. Hence, the buttons may be virtual buttons on a touchscreen of the mobile device. The mobile device may then send activation instructions to the lighting fixture. The activation instructions, which may be transmitted wirelessly, include settings for one or more of the lighting zones of the lighting fixture. Thus, for example, the activation instructions may include instructions about which lighting sources or lighting zones should be fully on and lit, which should be partially on (that is, dimmed), or which should be off. Each wall-box dimmer receives the activation instructions from the remote controller and effects a corresponding setting to the lighting zone that corresponds to the wall-box dimmer, thus creating the selected scene.

3. Multi-Zone Linear Chandelier/Fixture Embodiments

FIGS. 39-70 show additional examples of multi-zone linear chandeliers/fixtures that may include indirect up lighting, general area lighting, and down lighting. There may be three or more wall box dimmers installed in the canopy, one controlling each zone of lighting communicating with a wireless remote and/or smart bridge, such as a Lutron Caseta dimming system. As described above, each zone of lighting can be mixed to create different scenes.

FIGS. 39-52 show a lighting device 200. A rectangular shaped canopy 1 may attach to a ceiling. Swivels 2 attach to the bottom ends of canopy 1 and are used on a vaulted ceiling so fixture 6 will hang straight. Upper stems 3 are attached between canopy 1 and a rectangle shaped indirect up-light housing 4. Indirect up-lighting housing 4 is suspended from upper stems 3 between canopy 1 and fixture 6.

Lower stems 5 are attached at upper ends to upper stems 3 and extend from the bottom of up-light housing 4 to a rectangle shaped bar 6A. Bar 6A forms part of fixture 6 and may be hollow to retain and conceal wiring.

Fixture 6 includes a linear rectangle cage or frame that is open on all sides. In one example, fixture 6 may include an outer rectangular cage 6B with open ends and sides that encapsulates an inner rectangular cage 6C with open ends and sides.

A frame can be any structure with any shape that directly or indirectly holds one or more light sources. A frame may include open or closed structures that may or may not include shades, diffusers, or any other lighting source accessory.

Translucent tubular shaped shades 7 fit over general area light bulbs 18. Lenses 8 snap into round tubes 6D formed into bar 6A. Lenses 8 can enlarge a light pattern or alter the shape of the light pattern output from light source modules 14 attached up inside tubes 6D. Shades 7 fit into and are supported by round fitters 9 that are attached to the top of bar 6A.

Figure 45:
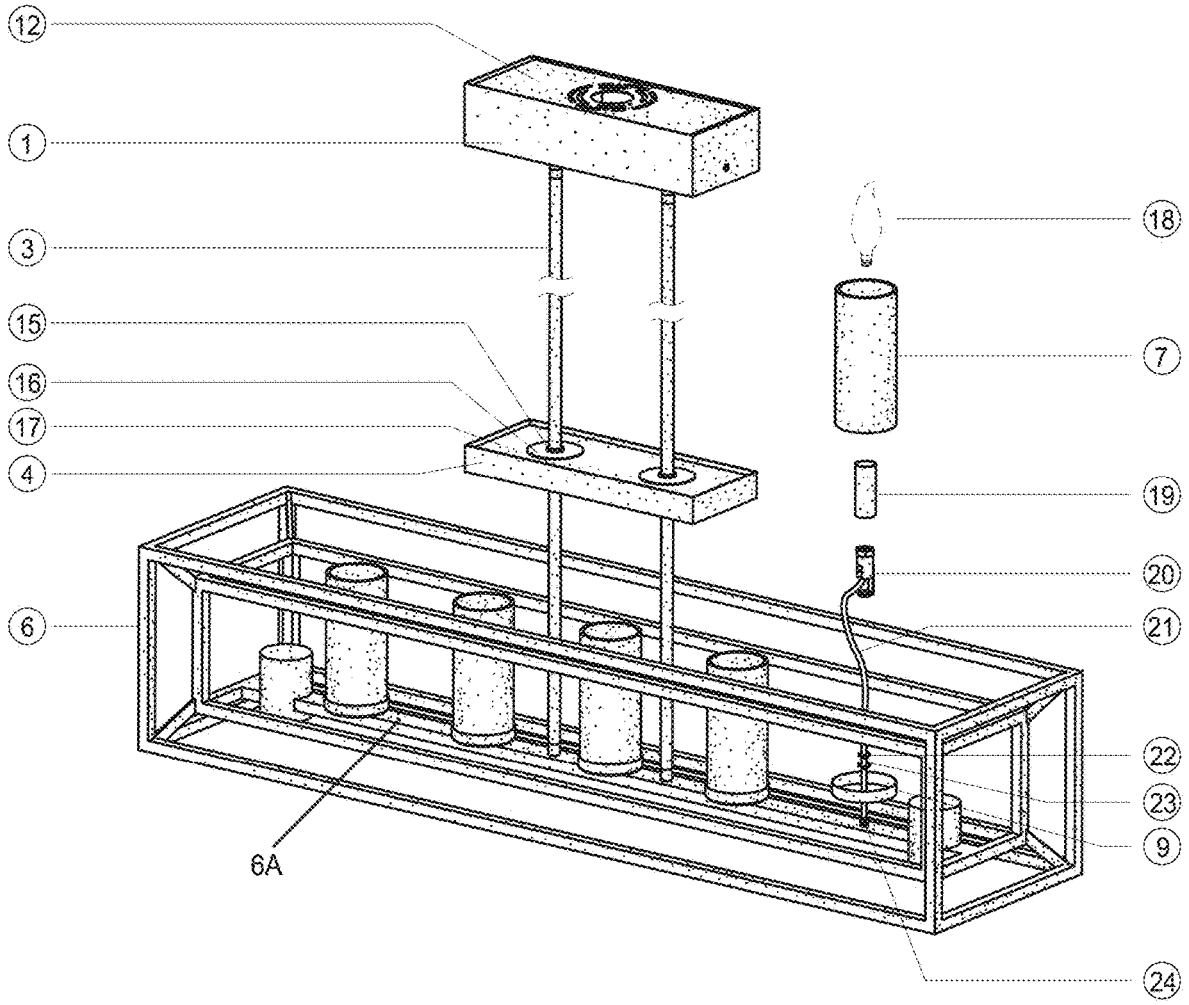
FIG. 45 is a top perspective view of the lighting device of FIG. 39 with an exploded general lighting fixture.
Figure 46:
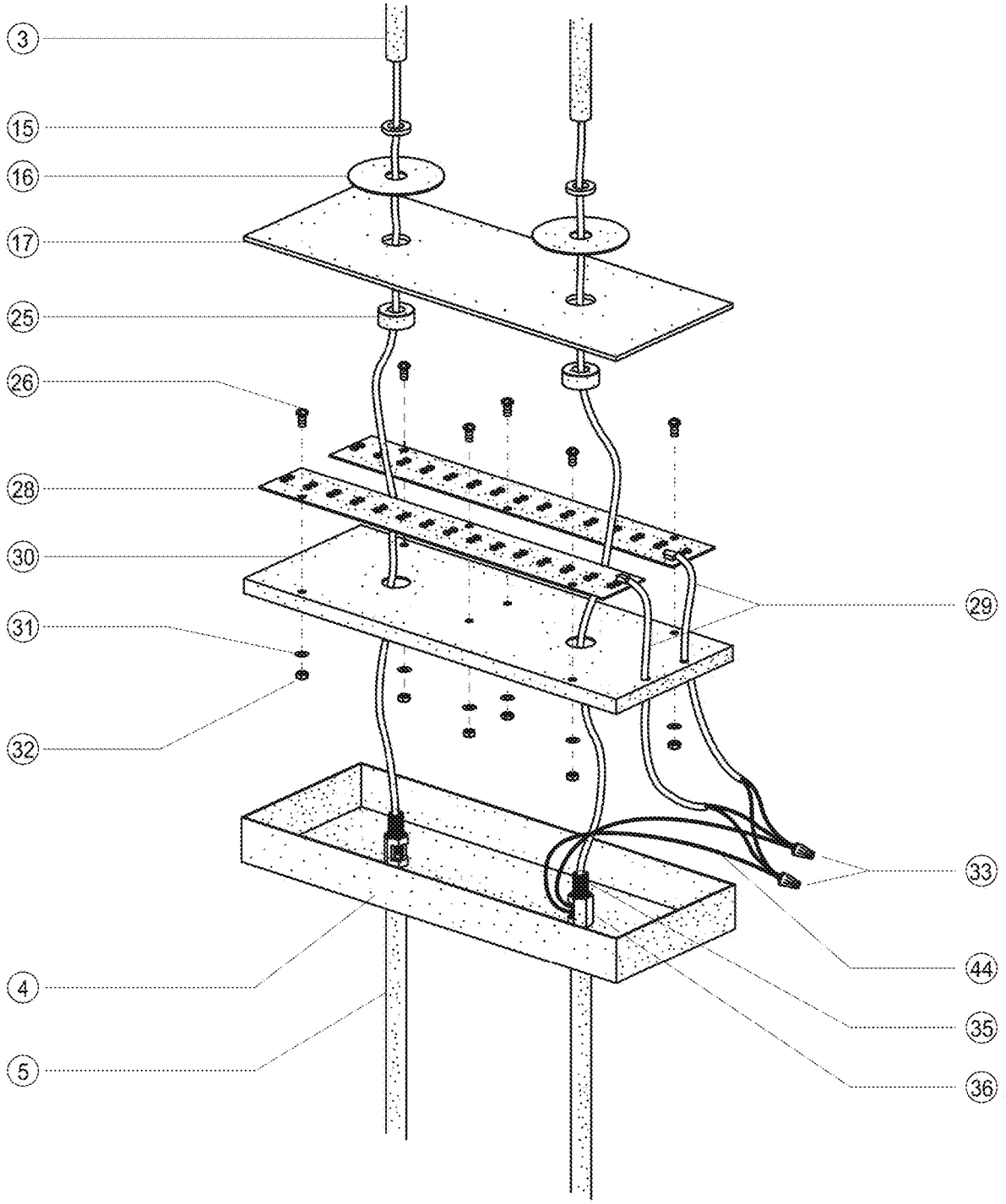
FIG. 46 is an exploded top perspective view of an up-lighting assembly for the lighting device of FIG. 39.
Figure 47:
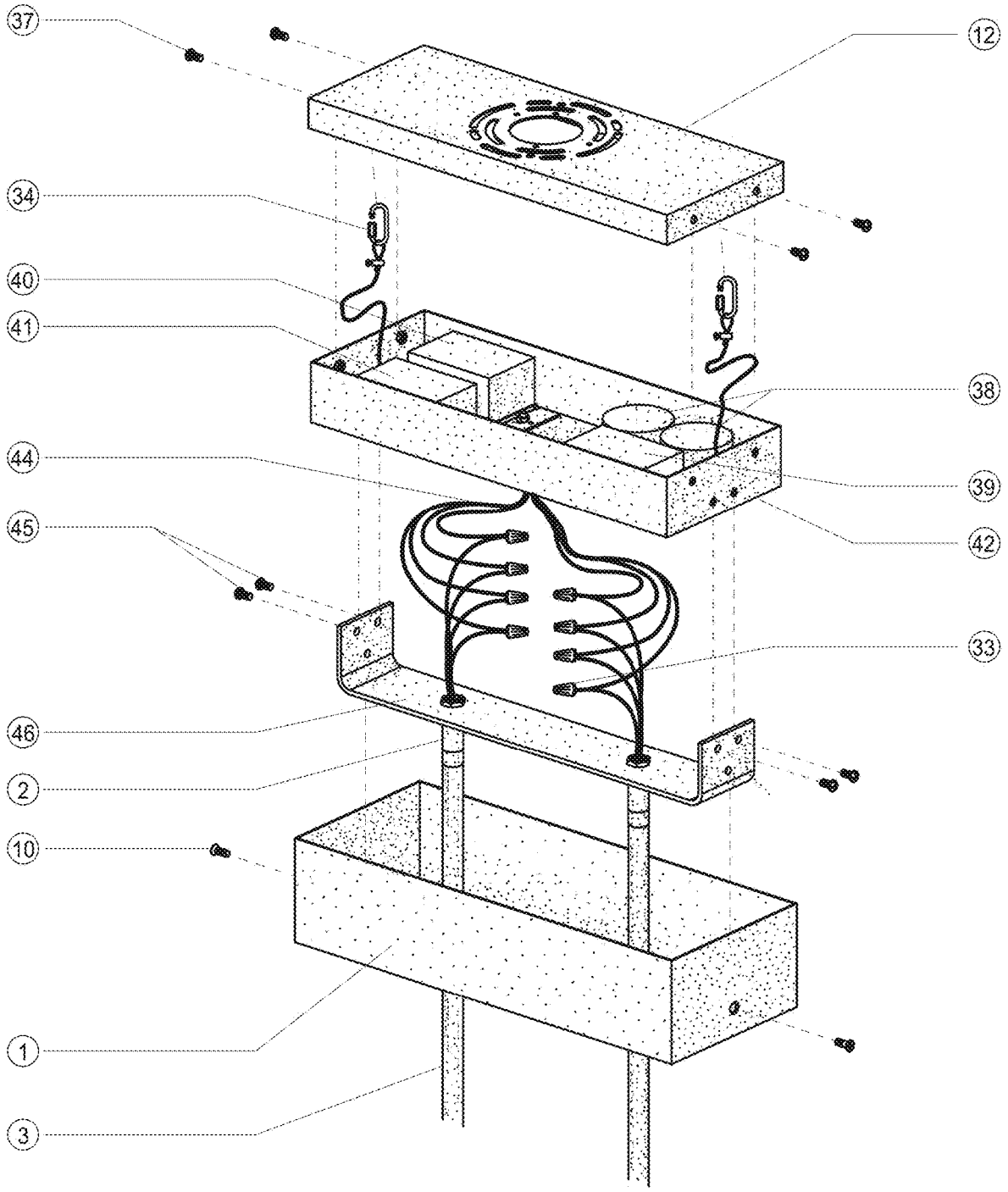
FIG. 47 is an exploded top perspective view of a canopy for the lighting device of FIG. 39.
Figure 48:
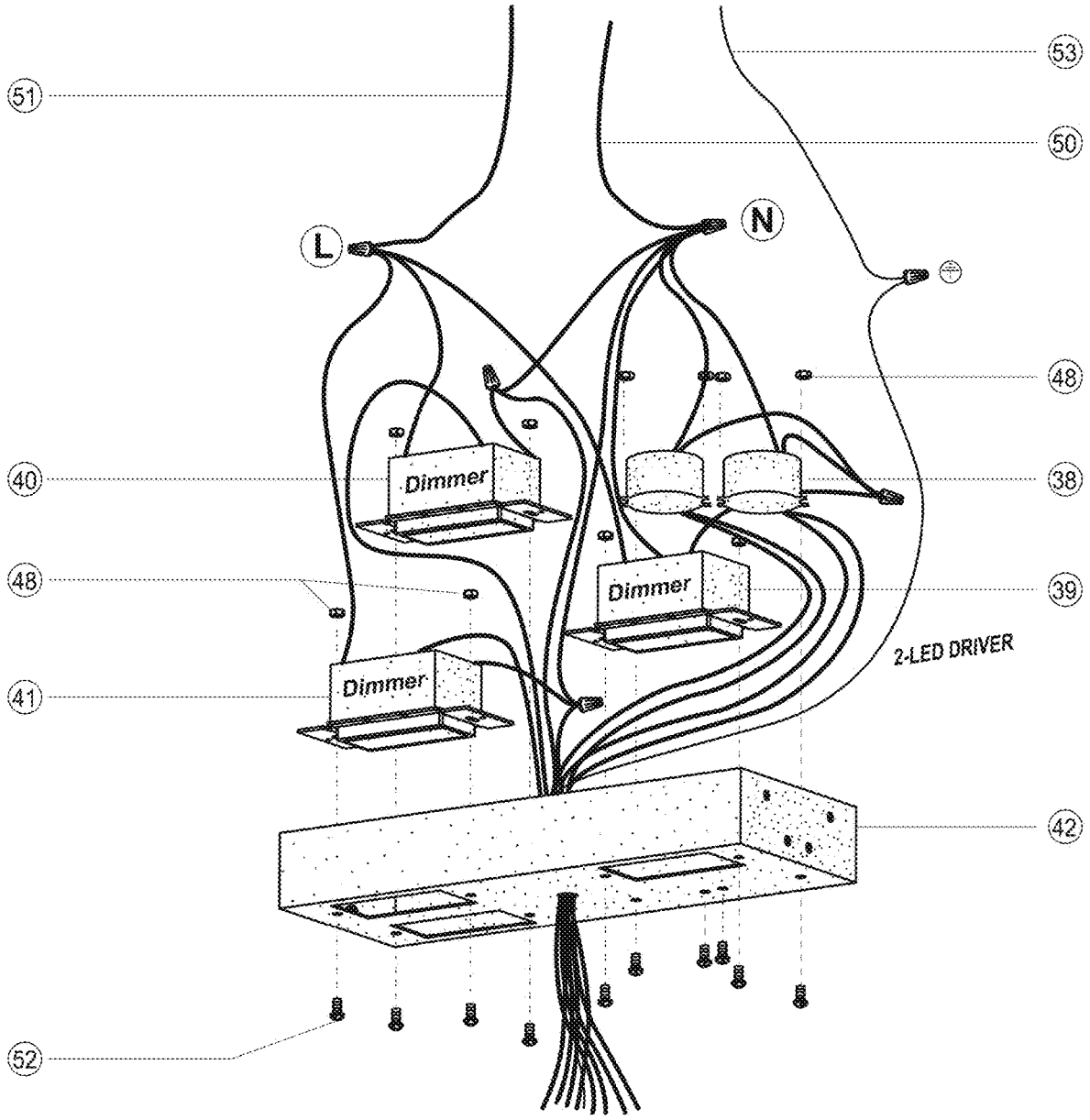
FIG. 48 is an exploded perspective view of dimmers and drivers located in the canopy of FIG. 47.

Light bulbs 18 insert into sockets 20 and provide general area lighting for a first light zone. Socket sleeves 19 slide over and covers sockets 20. Sockets 20 are attached and extend up from hollow bar 6A. Wiring 21 as shown in FIG. 45 extends through bar 6A and connects to sockets 20 for operating general area lights 18. Nipples 24 extend through bar 6A and engage with lock nuts 22, and lock washers 23 located under lock nuts 22, to secure fitters 9 to bar 6A.

Installation screws 10 extend into rectangle shaped canopy 1 and screw onto a U shaped bracket 46. Swivels 2 attach at top ends to U shaped bracket 46 and attach at bottom ends to upper stems 3. Swivels 2 allow fixture 6 to hang straight on vaulted ceilings.

Fire plate 12 attaches over a wire box 42 that inserts into canopy 1. Fire plate 12 includes stamped out universal mounting strap holes for attaching to an outlet box 43. Wiring 13 extends through stems 3 and 5 and bar 6A and connects to down light modules 14. light source modules 14 are inserted into round receptacles 6D and extend downward to provide down lighting for a second light zone.

LED up light modules 28 are mounted on top of plate 30 and under diffuser 17. A lock nut 15 and a washer 16 are located between a diffuser 17 and the bottom ends of upper stems 3 and block some upwardly directed light from lighting upper stems 3. Diffuser 17 may be a rectangular piece of translucent plastic that diffuses up lighting from LEDs 28. Round ring shaped spacers 25 are located in between diffuser 17 for up lighting and plate 30 that supports light source up lights 28. Screws 26 attach light source up lights 28 to plate 30.

Wire leads 29 are connected to light source up lights 28 and are connected to wires that extend down into lower stems 5. Plate 30 inserts into housing 4 and supports light source up lights 28. Washers 31 are located above locknuts 32 and threadingly receive screws 26 to secure light source up lights 26 to plate 30. Wire nuts 33 secure wire leads 29 to wires 44 that connected to dimmers and drivers located in canopy 1. Pipe nipple 35 extends up from the top of hickey 36 allowing wiring 44 from the dimmers to connect with up lights 28.

Figure 49:
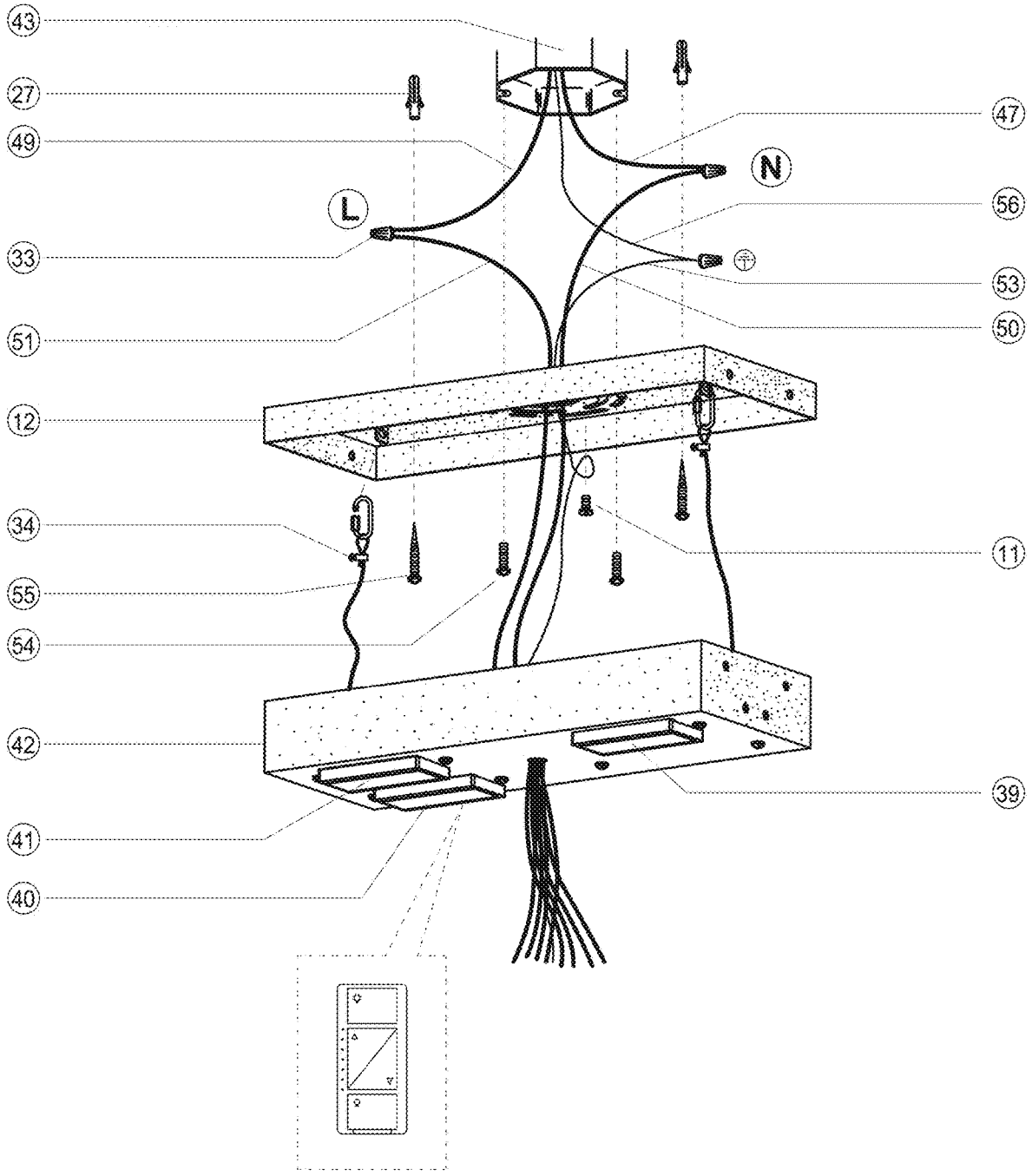
FIG. 49 is an exploded perspective view of wiring between an outlet box and a wire box within the canopy of FIG. 47.

A ground screw 11 in FIG. 49 is used to attach a ground wire 53 to fire plate 12 located inside of canopy 1. Wall anchors 27 in FIG. 49 insert into the ceiling of a room. Screws 55 screw into wall anchors 27 mounting fire plate 12 to the ceiling. Safety & installation cables and hooks 34 attach wire box 42 to pad eyes extending down from the bottom of fire plate 12. Cables 34 hold wire box 42 to fire plate 12 during installation and prevent wire box 42 from falling if ever detached from fire plate 12.

Screws 37 insert into and attach the sides of fire plate 12 to wire box 42. Dimmers 39-41 and drivers 38 are located inside of wire box 42. light source drivers 38 are coupled to and activate light source lights 14. Dimmer 39 controls drivers 38 for dimming down lights 14, dimmer 40 controls dimming for up lights 28, and dimmer 41 controls dimming for general area lights 18.

Light dimmers 39, 40, and 41 are shown located in canopy 1 but also may be located in up-lighting housing 4 or located in fixture 6. Wire box 42 sits into and attaches to a U shaped bracket 46 that is connected to swivels 2 that attach to the top ends of upper stems 3. Wires 44 from dimmers 39-41 and light source drivers 38 extend down through wire box 42 and into the top ends of upper stem 3. Screws 45 attach U shaped bracket 46 onto the outside walls of wire box 42. U shaped bracket 46 threadingly receives the top ends of swivels 2.

Outlet box 43 is recessed inside of the ceiling of the room. Neutral power supply wire (N) 47 extends down from outlet box 43 and connects to neutral fixture wire (N) 50 that extends down into fixture 6. Line/hot wire (L) 49 extends down from outlet box 43 and connects with line/hot fixture wire (L) 51 that extends down into fixture 6. Ground wire (G) 56 extends down from outlet box 43 and attaches to fixture ground wire (G) 53. Fixture ground wire 53 extends down through wire box 42 and stems 3 and 5 into fixture 6. Screws 54 attach fire plate 12 onto outlet box 43. Wood screws 55 attach fire plate 12 to wall anchors 27. Locknuts 48 in FIG. 48 threadingly attach to screws 52 to secure dimmers 39-41 and drivers 38 inside of wire box 42. Locknuts 48 in FIG. 48 threadingly attach to screws 52 to secure dimmers 39-41 and drivers 38 inside of wire box 42.

As described above, lighting system 200 includes a first set of one or more lights 18 providing general area lighting for a first light zone. A second set of one or more lights 14 provide down lighting for a second light zone. A third set of one or more lights 28 provide indirect up lighting for a third light zone.

Lighting system 200 includes an elongated fixture frame 6 configured to retain at least one of the first, second, or third set of lights. The first set of lights 18 extend longitudinally within fixture frame 6 and the second set of lights 14 extend down from opposite longitudinal ends of fixture frame 6.

Frame 6 includes a rectangular box shaped cage wherein top, bottom, sides, and ends of the cage have substantially open walls. In one example, frame 6 comprises an inner cage and an outer cage that encapsulates the inner cage, wherein top, bottom, sides, and ends of the outer cage also have substantially open walls.

Bar 6A extends longitudinally between opposite ends of frame 6. The first set of lights 18 extend upward from bar 6A. One or more upper stems 3 include top ends that attach to canopy 1. Lower stems 5 screw into upper stems 3 and include bottom ends that attach to bar 6A. The second set of lights 14 extend downward from bar 6A.

Canopy 1 is configured to attach to a ceiling. Upper stem 3 is configured to hang from canopy 1. Frame 6 is alternatively referred to as a fixture and is suspended from lower stems 5. Up-lighting housing 4 is suspended by upper stems 3 and lower stems 5, between canopy 1 and fixture 5. In one example, up-lighting housing retains the third set of lights 28.

Diffuser 17 is attached to a top side of up-lighting housing 4 to diffuse light from the third set of lights 28. The third set of lights may include one or more lightstrips, for example, a strip of light emitting diode (LEDs) attached to plate 30 located on the top end of the up-lighting housing 4.

Figure 50:
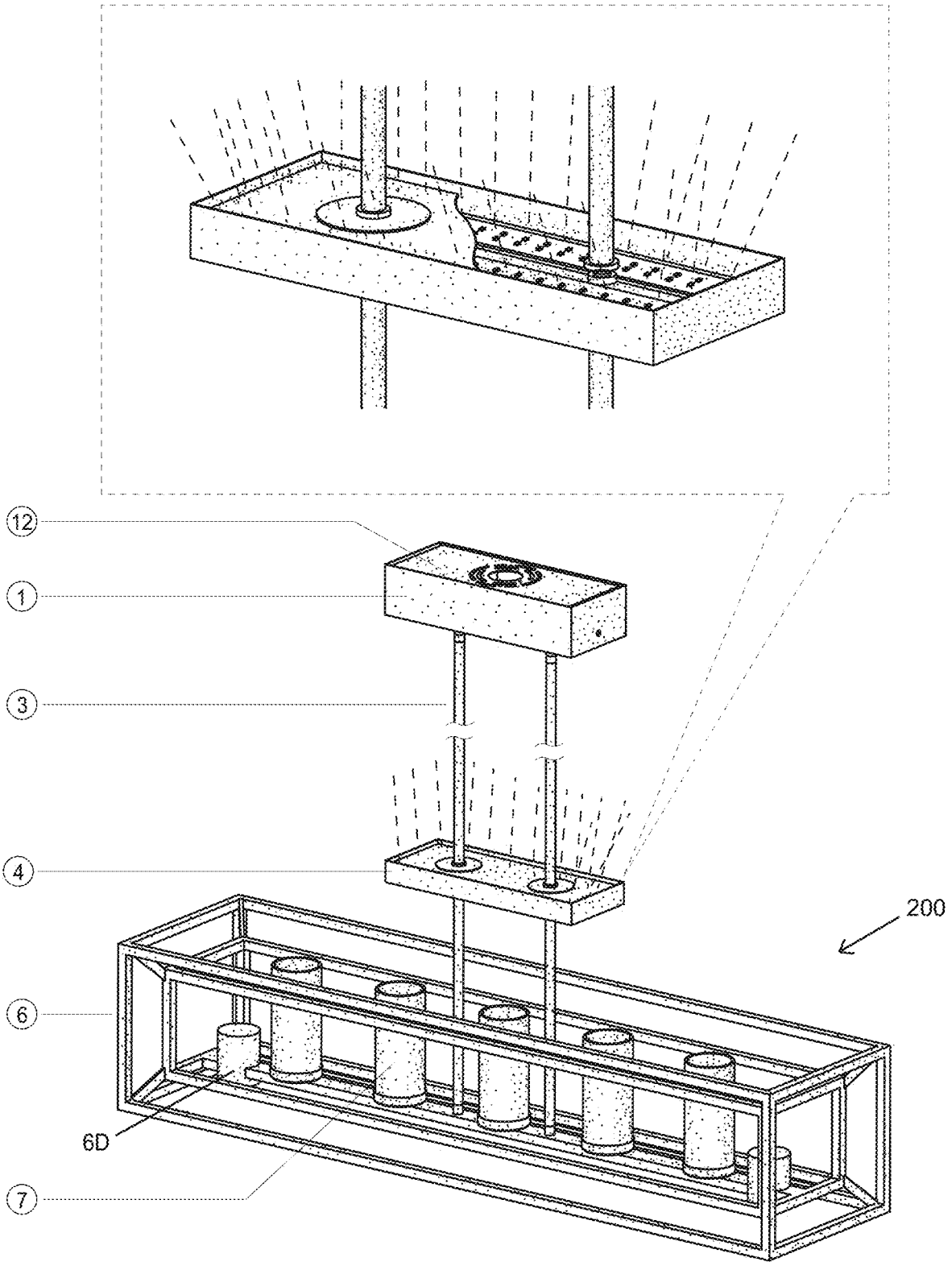
FIG. 50 is a perspective view of lighting device of FIG. 39 showing illumination from an up-lighting housing.
Figure 51:
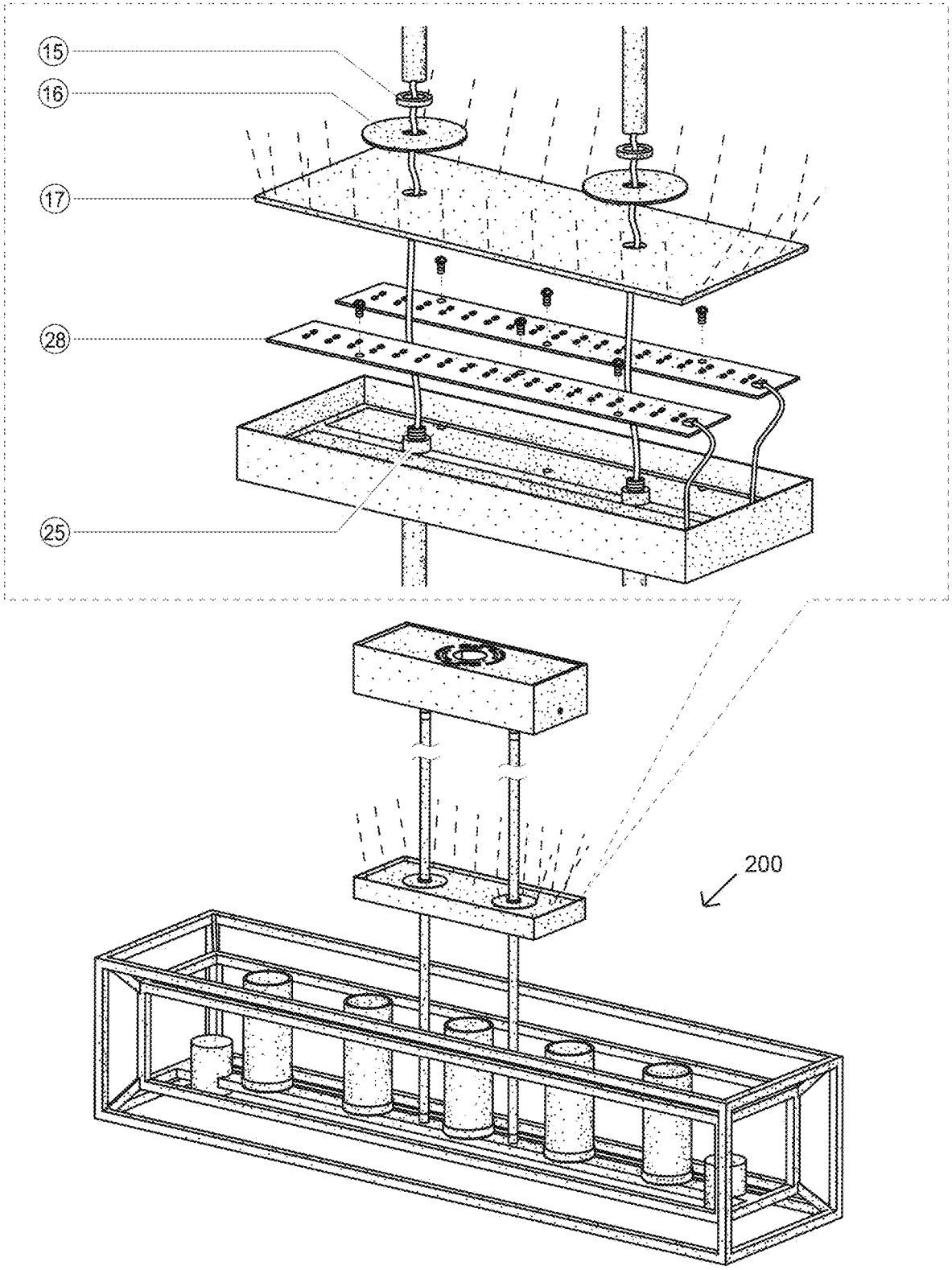
FIG. 51 is an exploded view of the up-lighting assembly of FIG. 50.

FIGS. 50 and 51 show in more detail the third lighting zone of light fixture 200. Lights 18 emit light radially out through translucent shades 7 providing the first general lighting zone. Lights 14 in receptacles 6D emit light downward providing the second light zone. The LEDs 28 on the top of up-lighting housing 4 emit diffused indirect light upward against a ceiling providing the third light zone.

Figure 52:
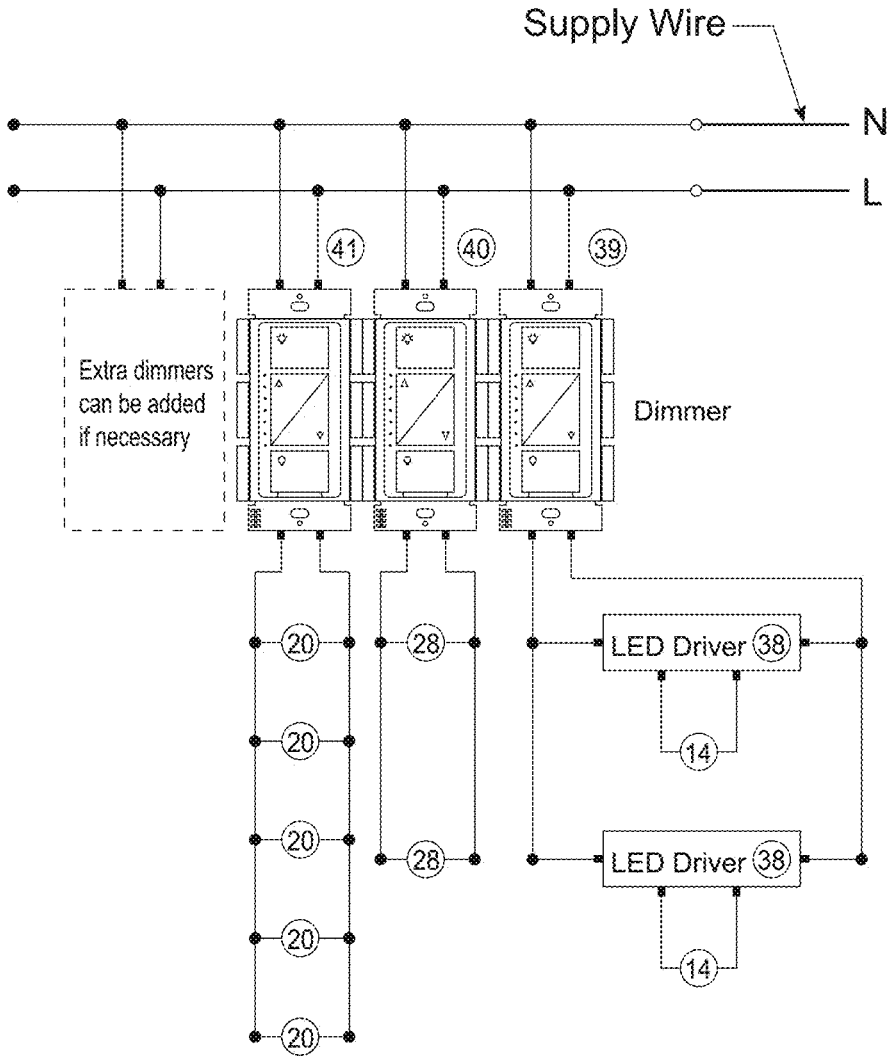
FIG. 52 is a schematic diagram showing wiring for the lighting device of FIG. 39.
Figure 53:
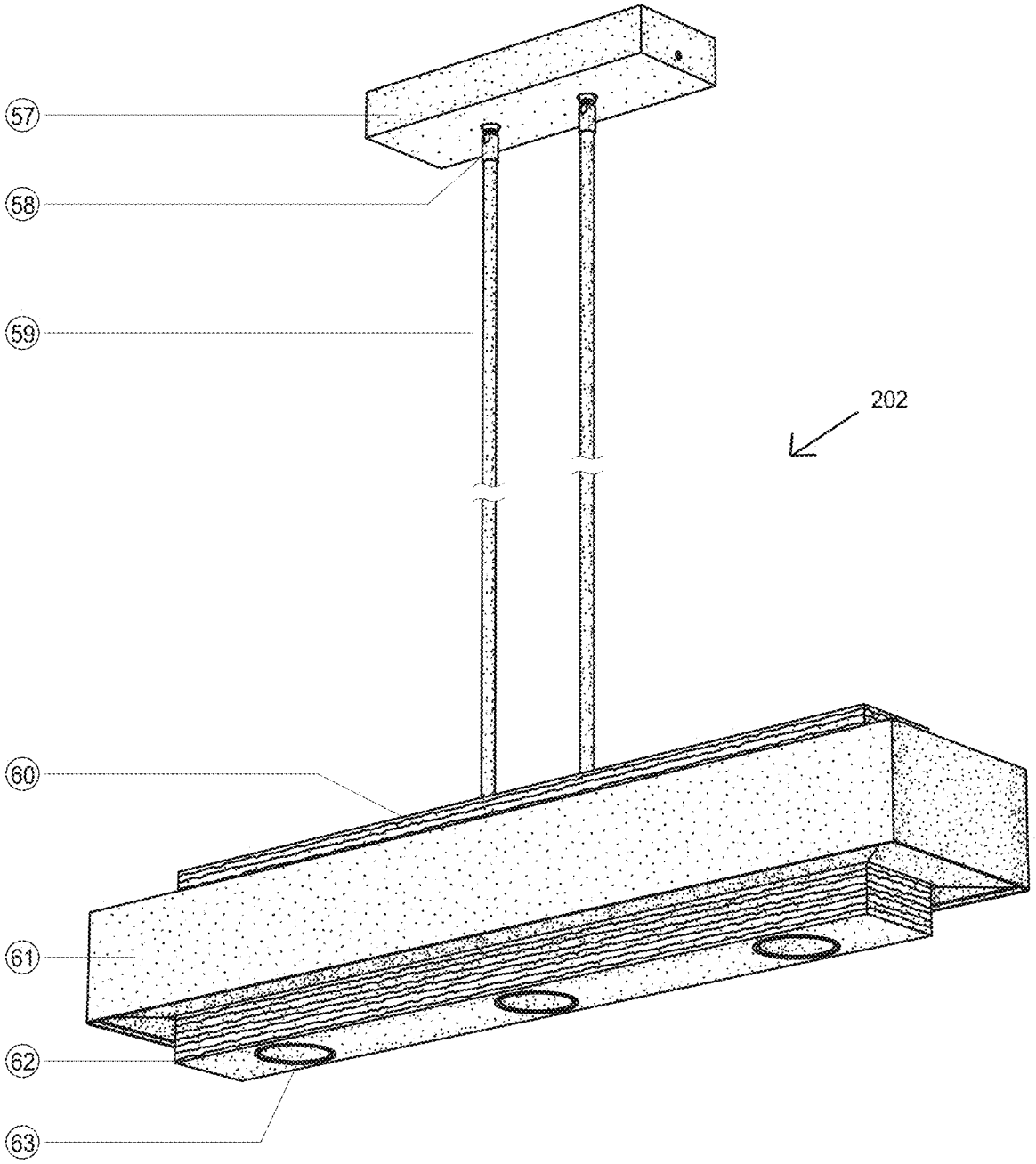
FIG. 53 is a perspective view of another multi-zone lighting device.
Figure 54:
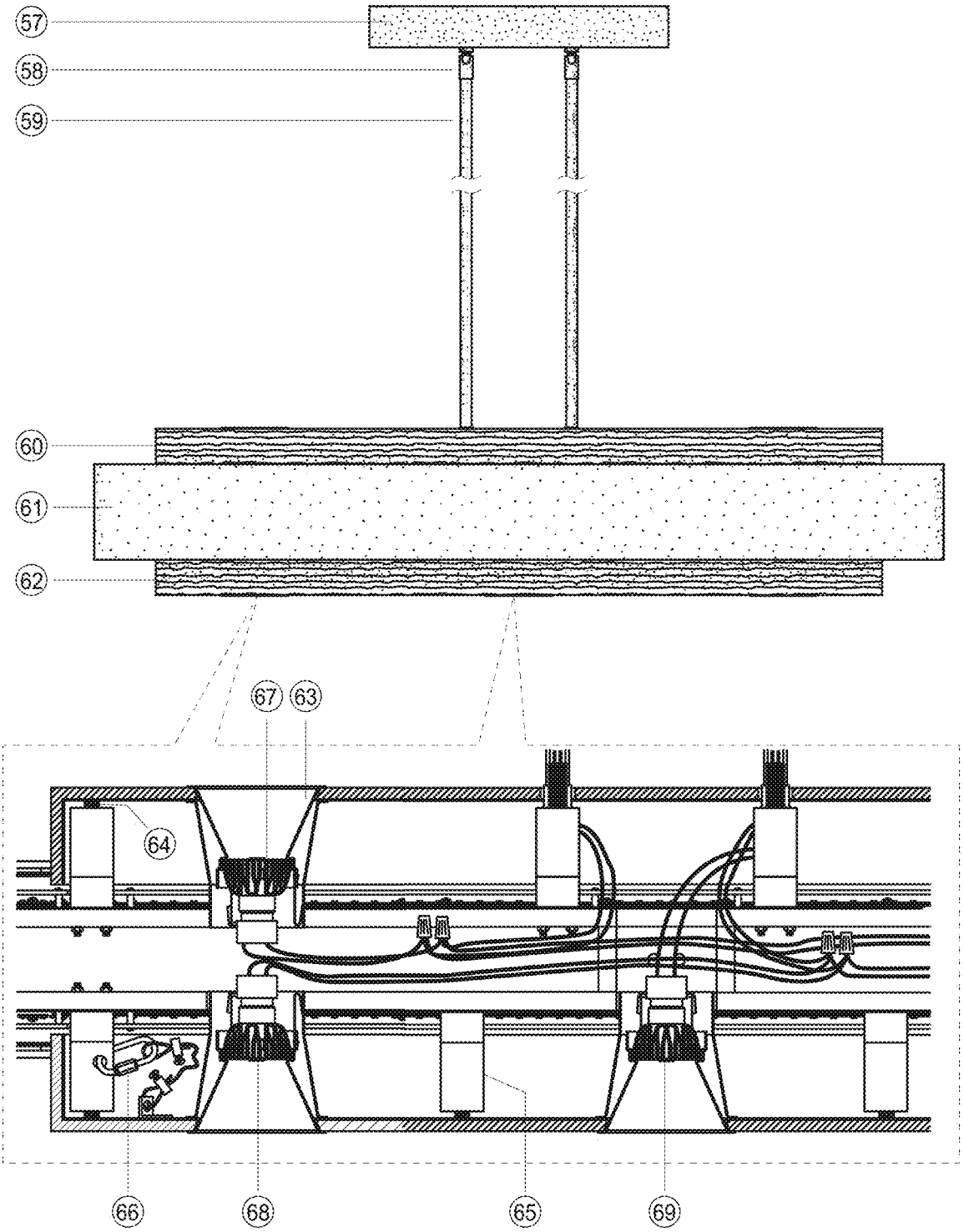
FIG. 54 is a side view and side section view of the lighting device of FIG. 53.
Figure 55:
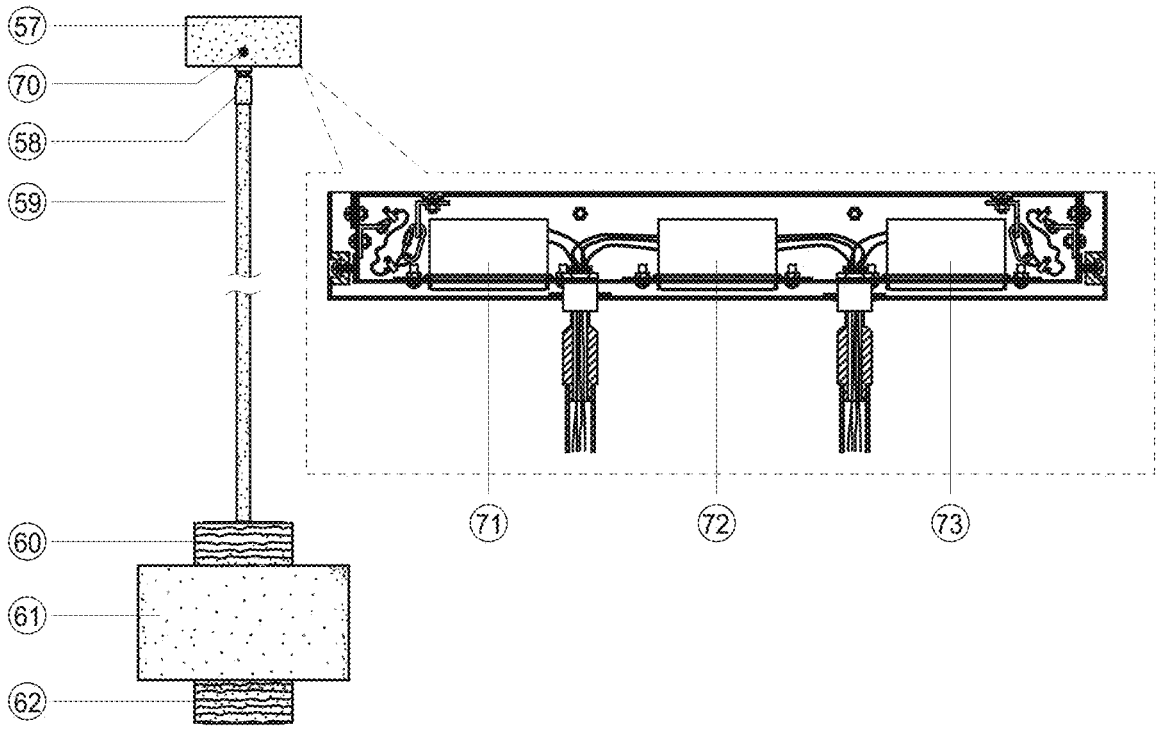
FIG. 55 is an end view the lighting device of FIG. 53 and a side sectional view of a canopy.
Figure 56:
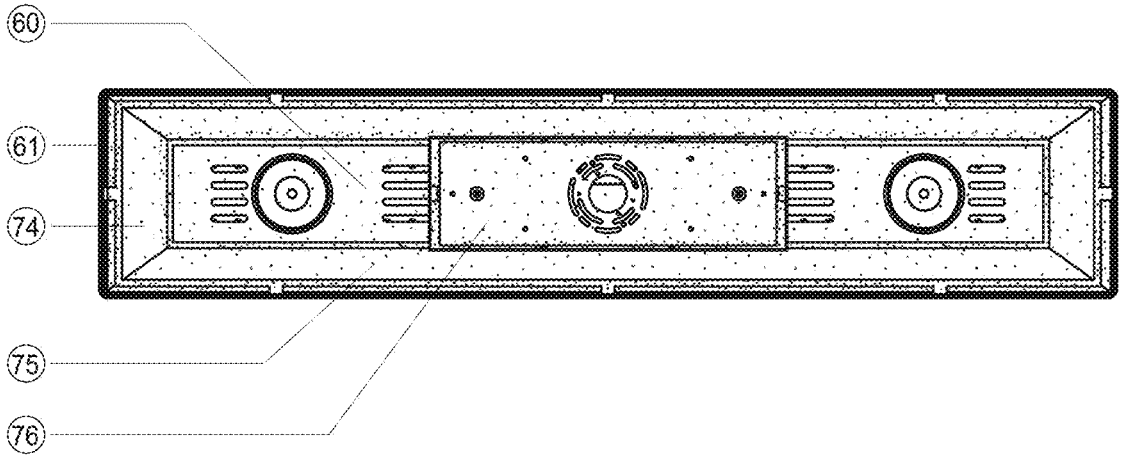
FIG. 56 is a top view of the lighting device of FIG. 53.
Figure 57:
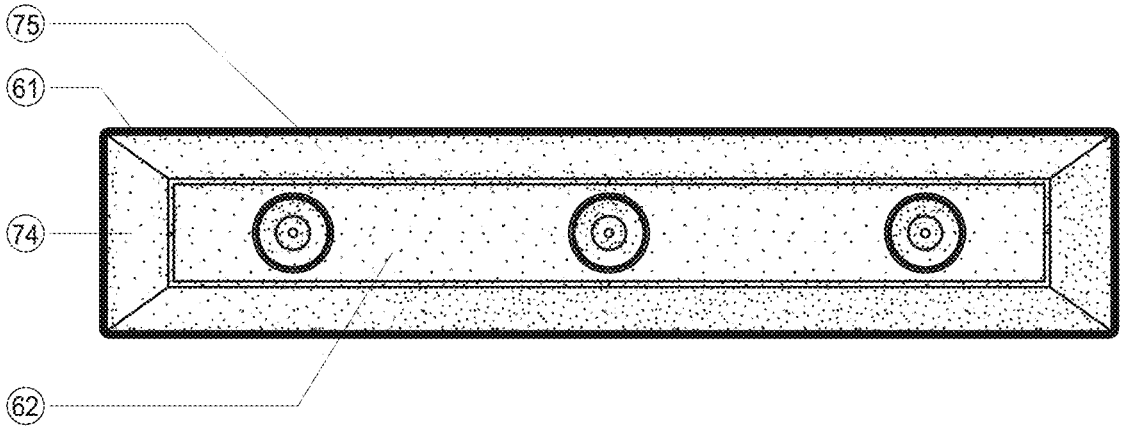
FIG. 57 is a bottom view of the lighting device of FIG. 53.
Figure 58:
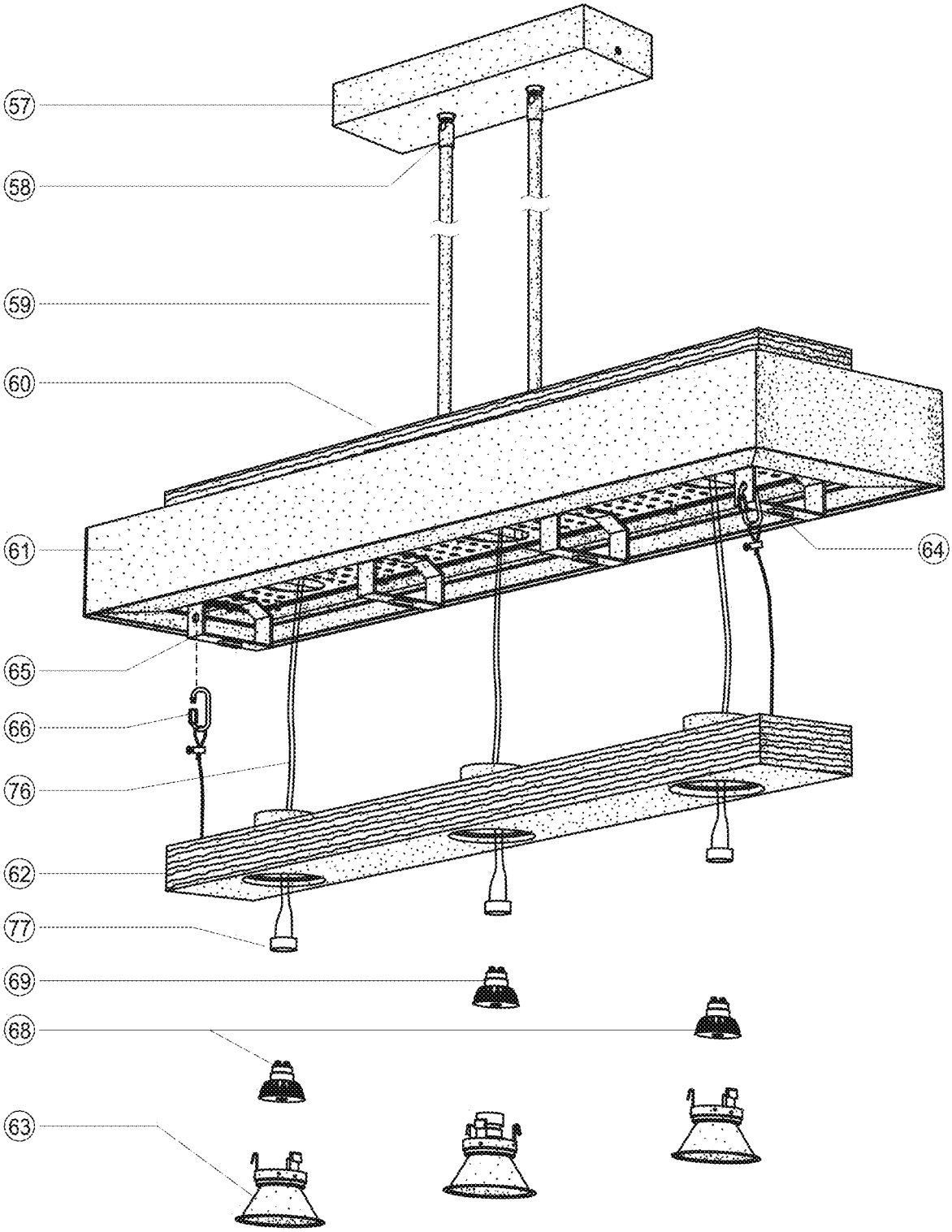
FIG. 58 is a perspective view of lighting device of FIG. 53 with an exploded down-lighting assembly.
Figure 59:
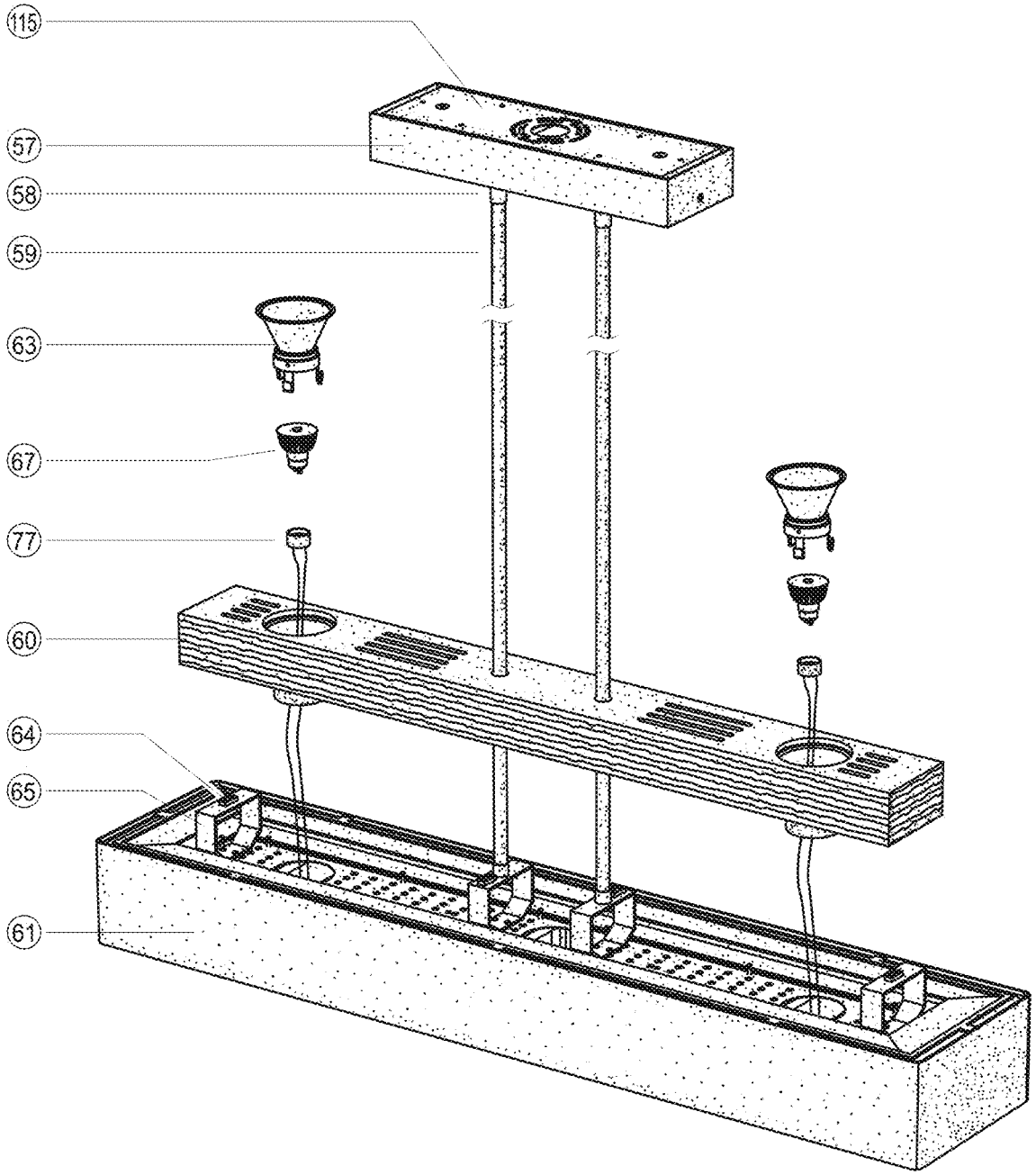
FIG. 59 is a top perspective view of the lighting device of FIG. 53 with an exploded up-lighting assembly.
Figure 60:
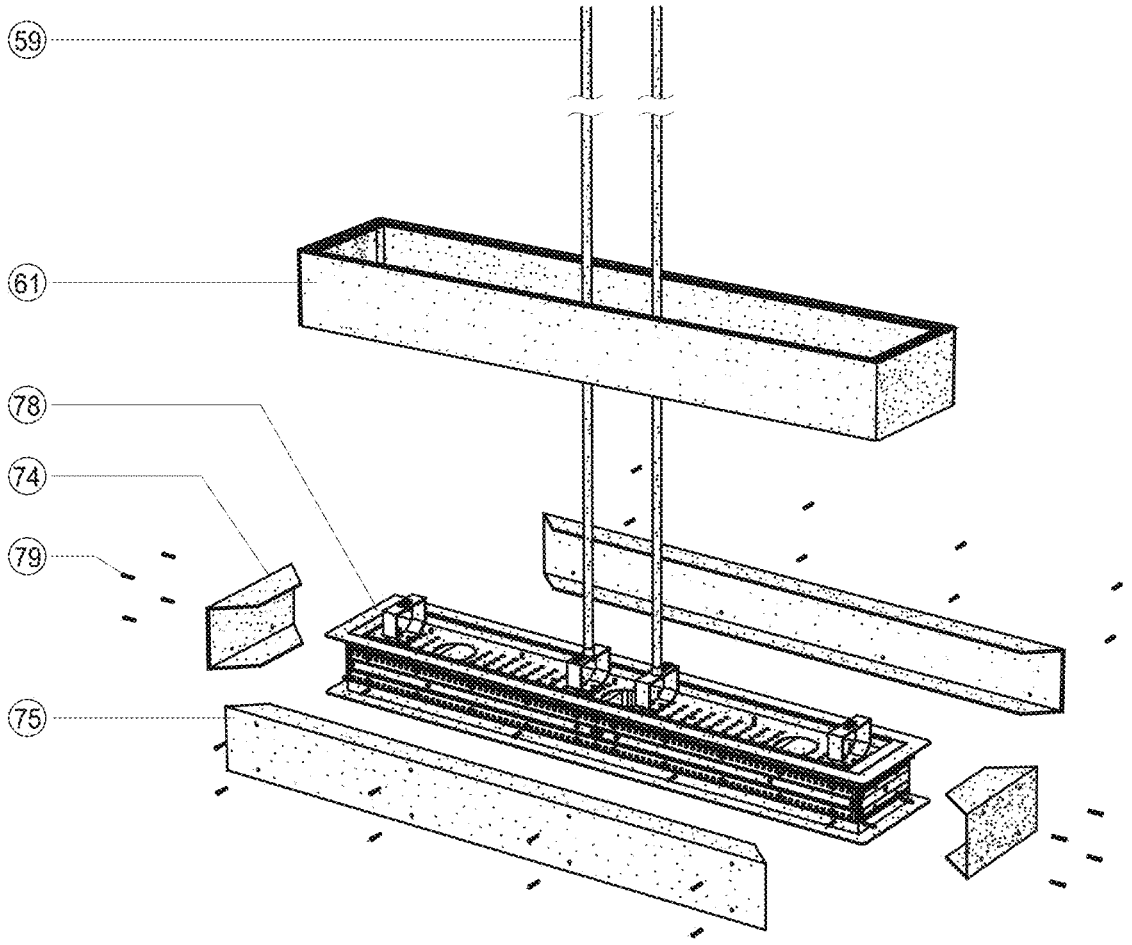
FIG. 60 is a perspective view of the light fixture of FIG. 53 with exploded shade and diffuser members.
Figure 61:
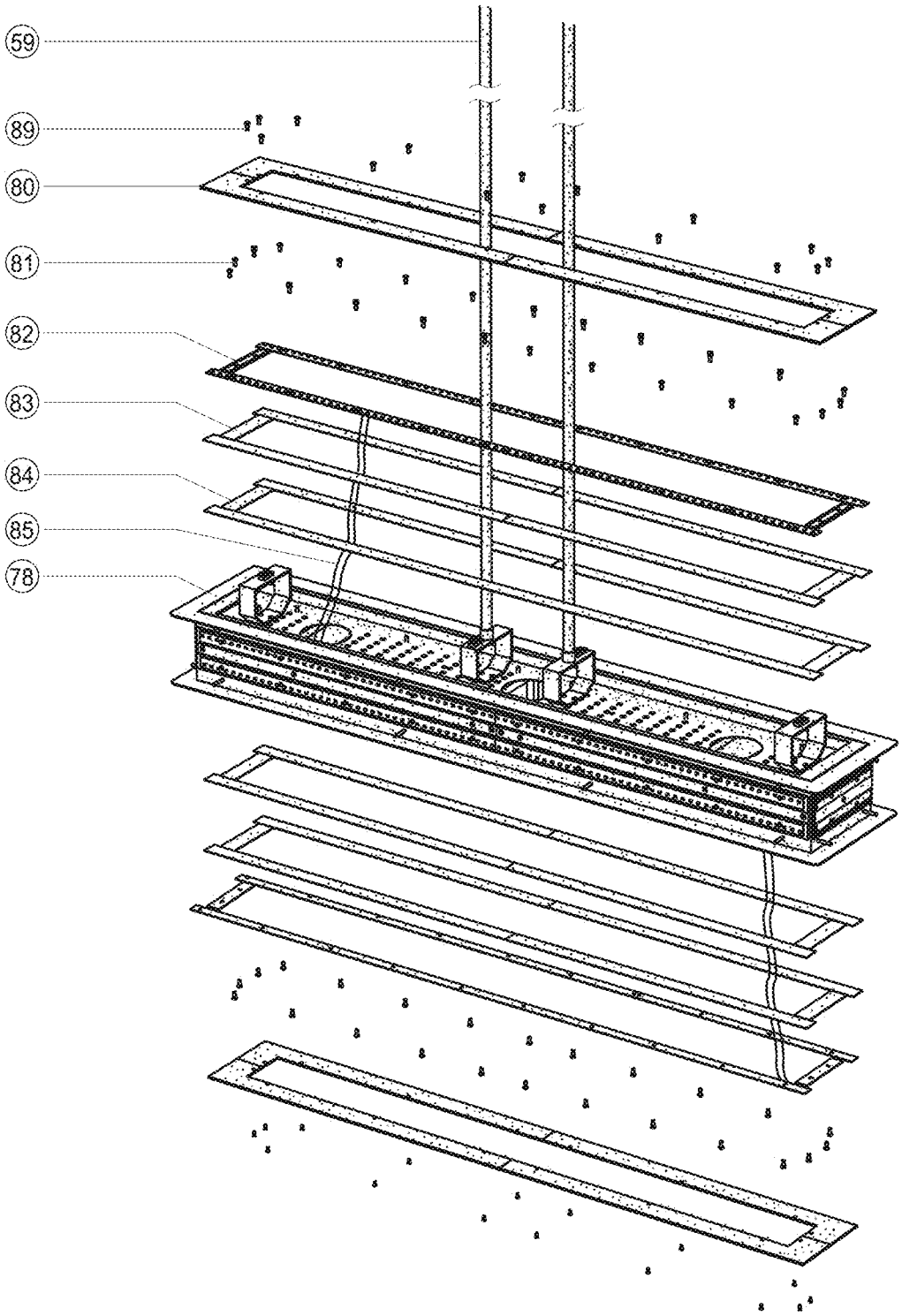
FIG. 61 is an exploded perspective view of upper and lower members attached to a fixture body of the lighting device of FIG. 53.
Figure 62:
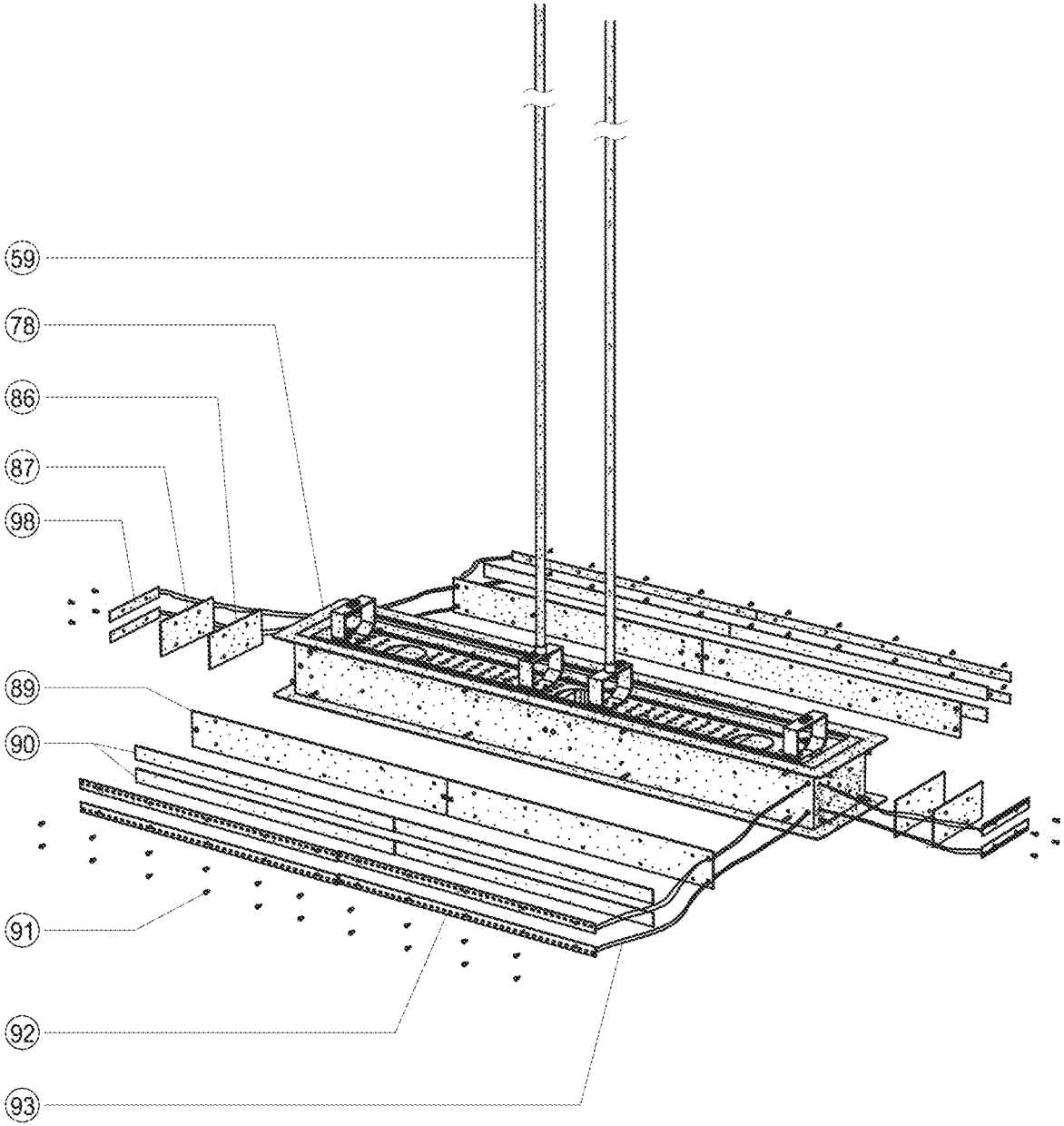
FIG. 62 is an exploded perspective view of side and end members attached to the fixture body of the lighting device of FIG. 53.
Figure 63:
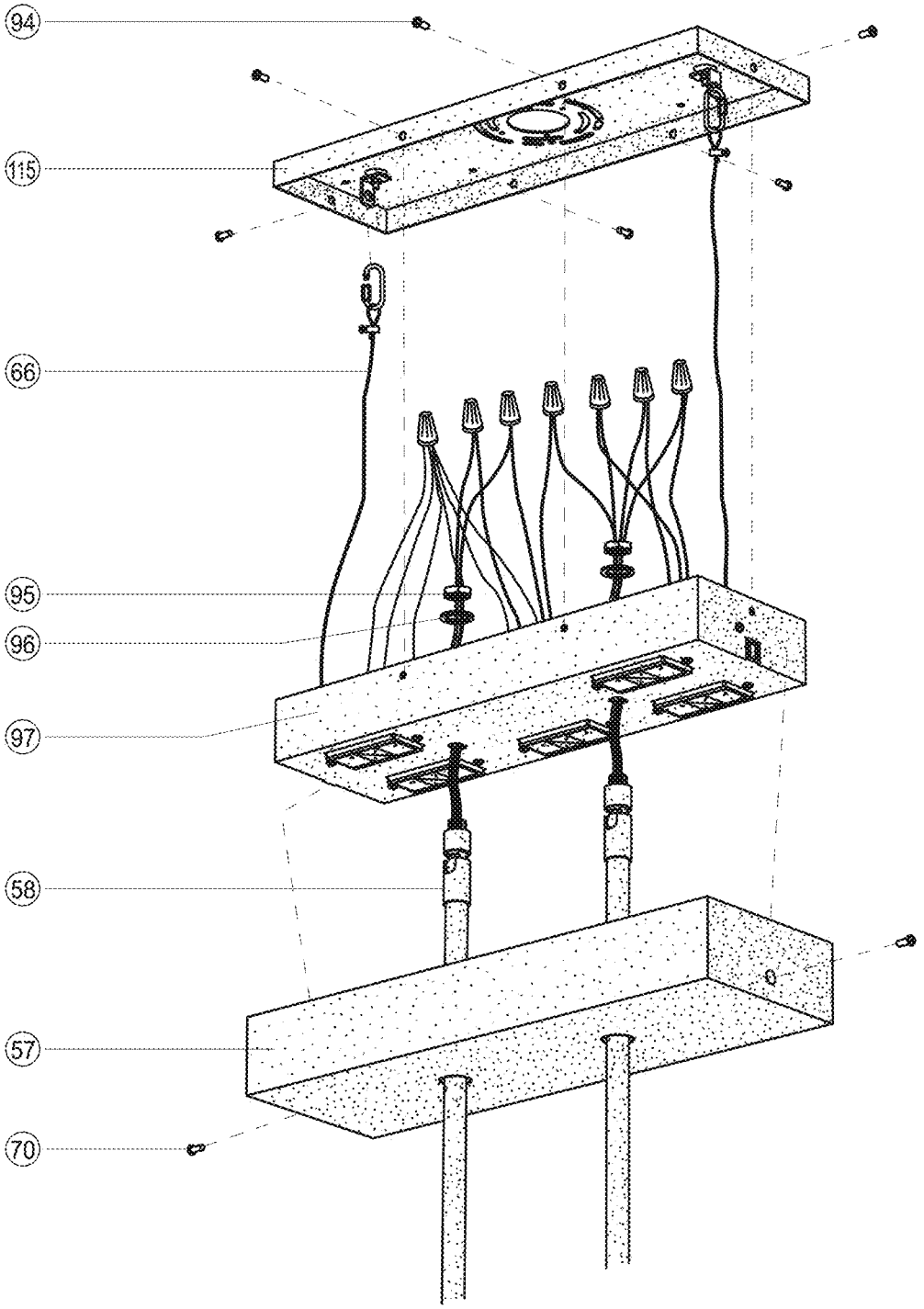
FIG. 63 is an exploded perspective view of a canopy used in the lighting device of FIG. 53.
Figure 64:
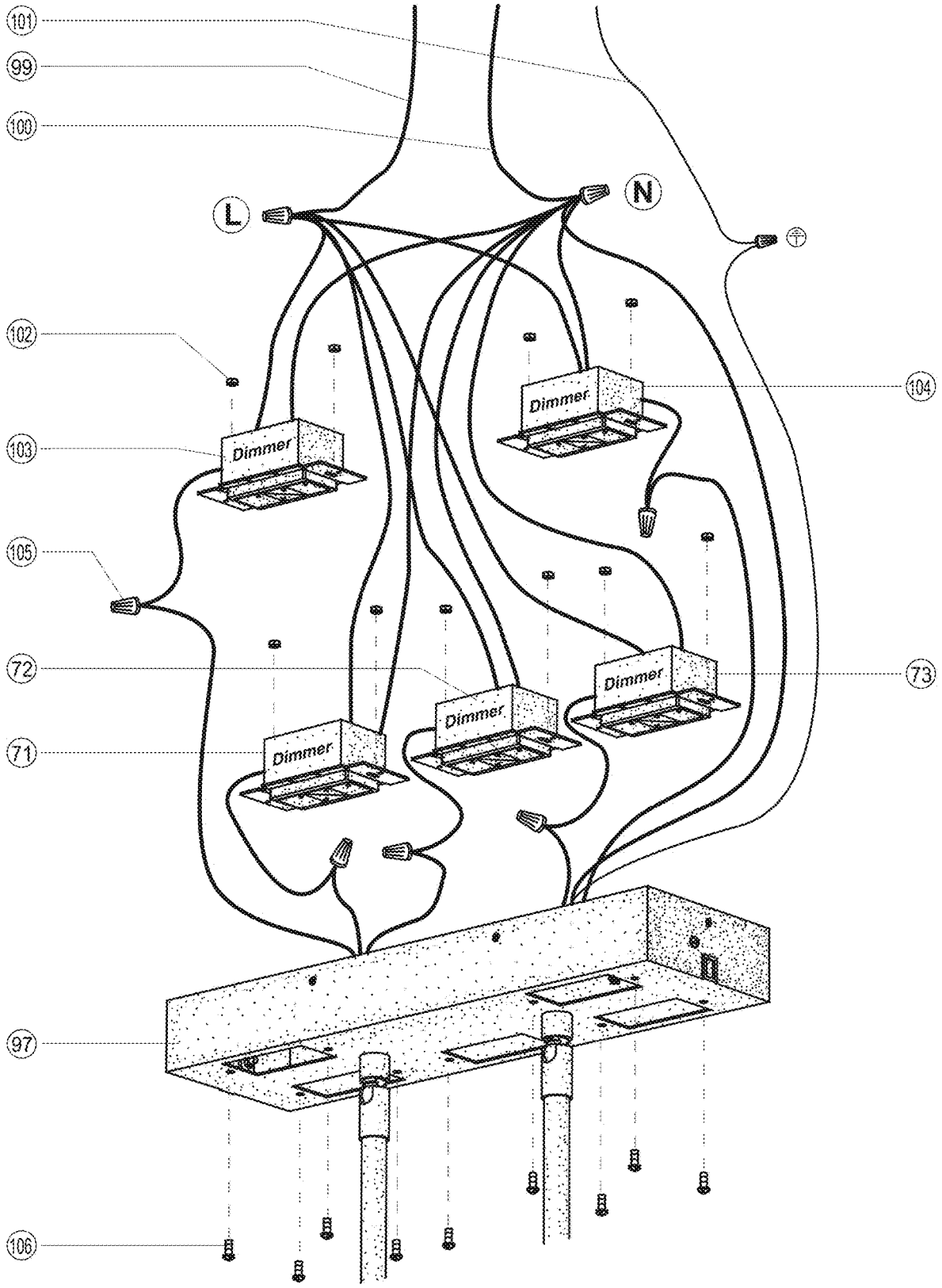
FIG. 64 is an exploded perspective view of dimmers located in a wire box of the canopy shown in FIG. 53.
Figure 65:
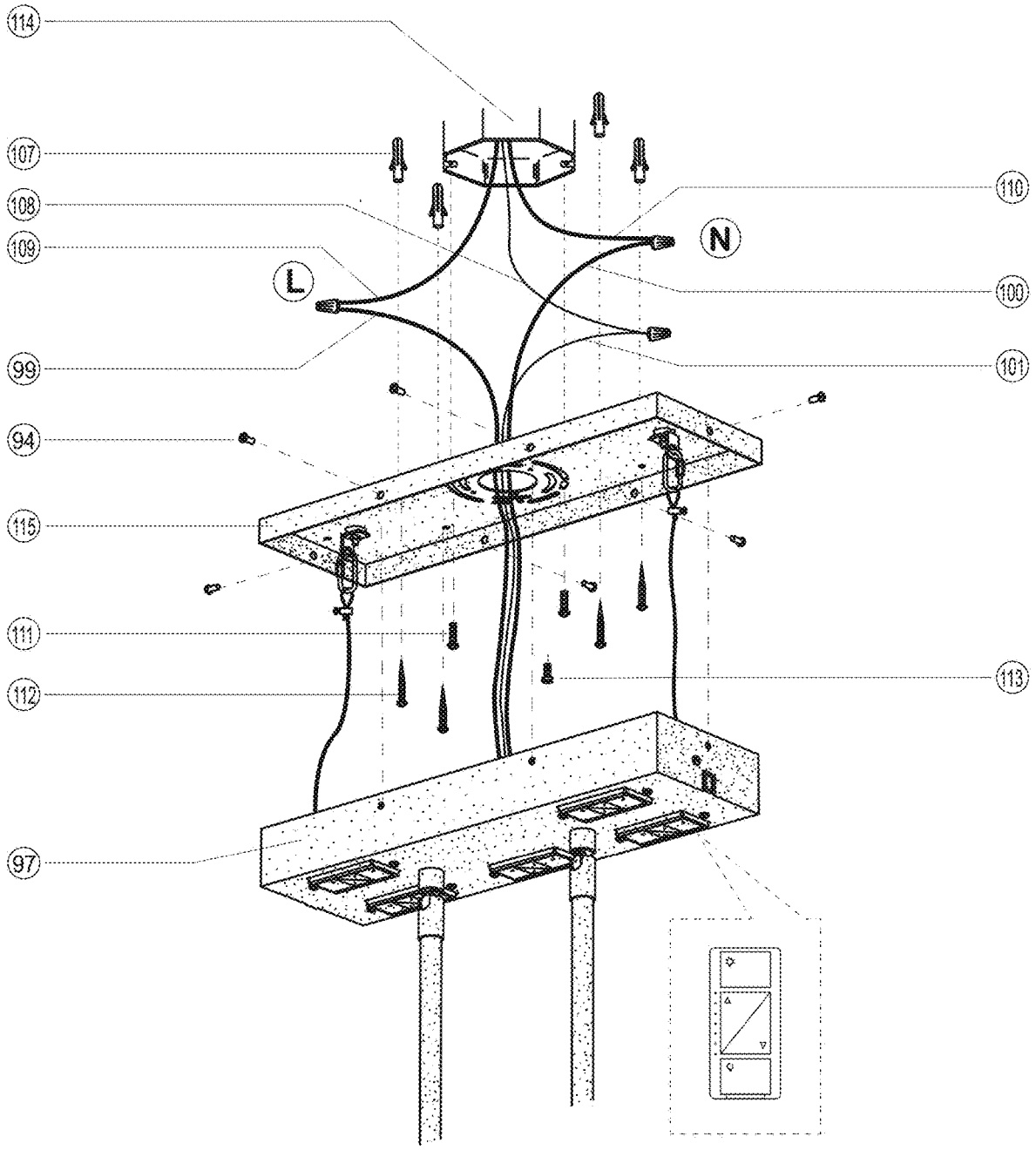
FIG. 65 is another exploded perspective view of the wire box shown in FIG. 63 showing wiring from an outlet box.
Figure 66:
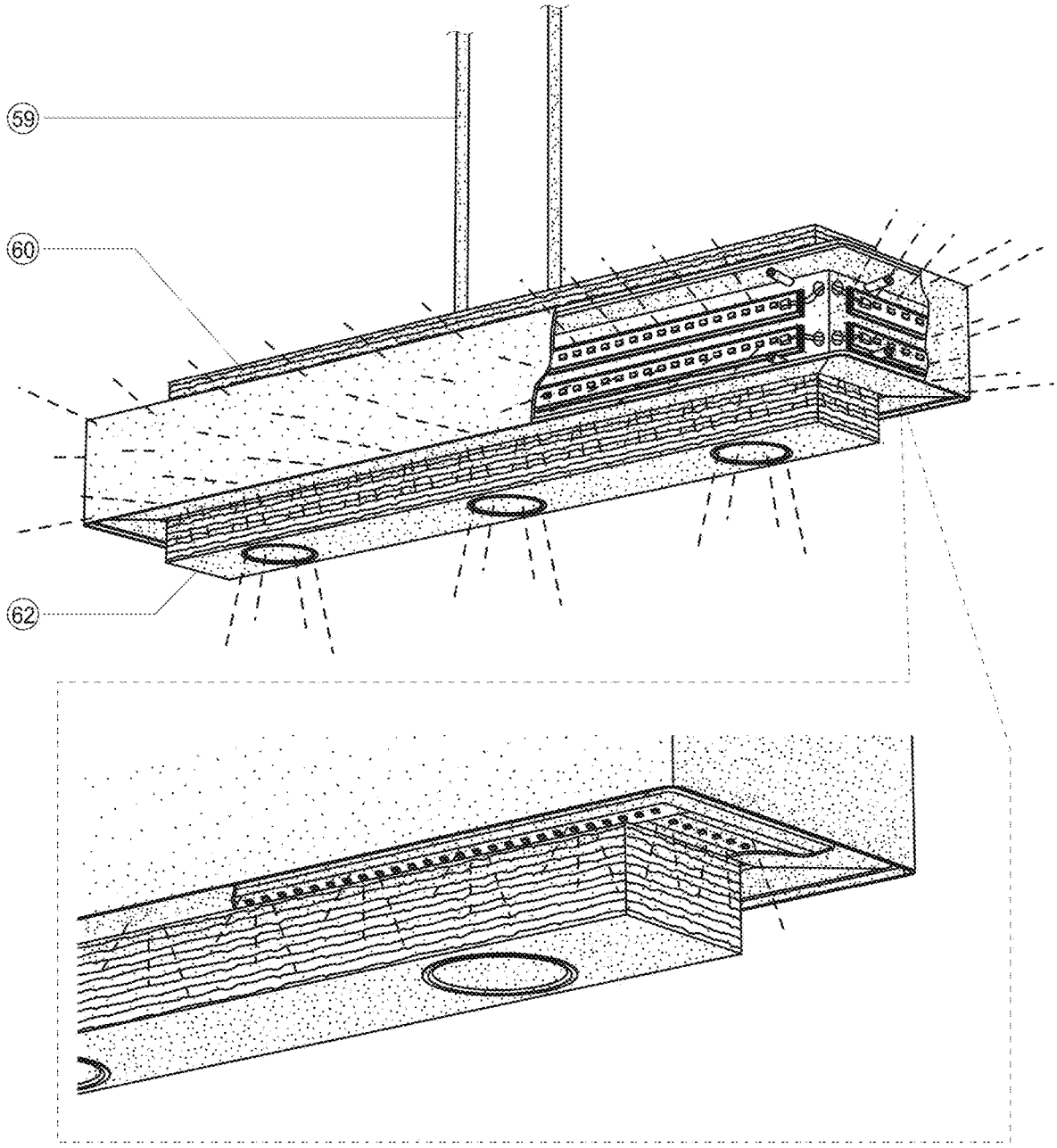
FIG. 66 are cutaway perspective views showing multi-zone illumination from the lighting device of FIG. 53.
Figure 67:
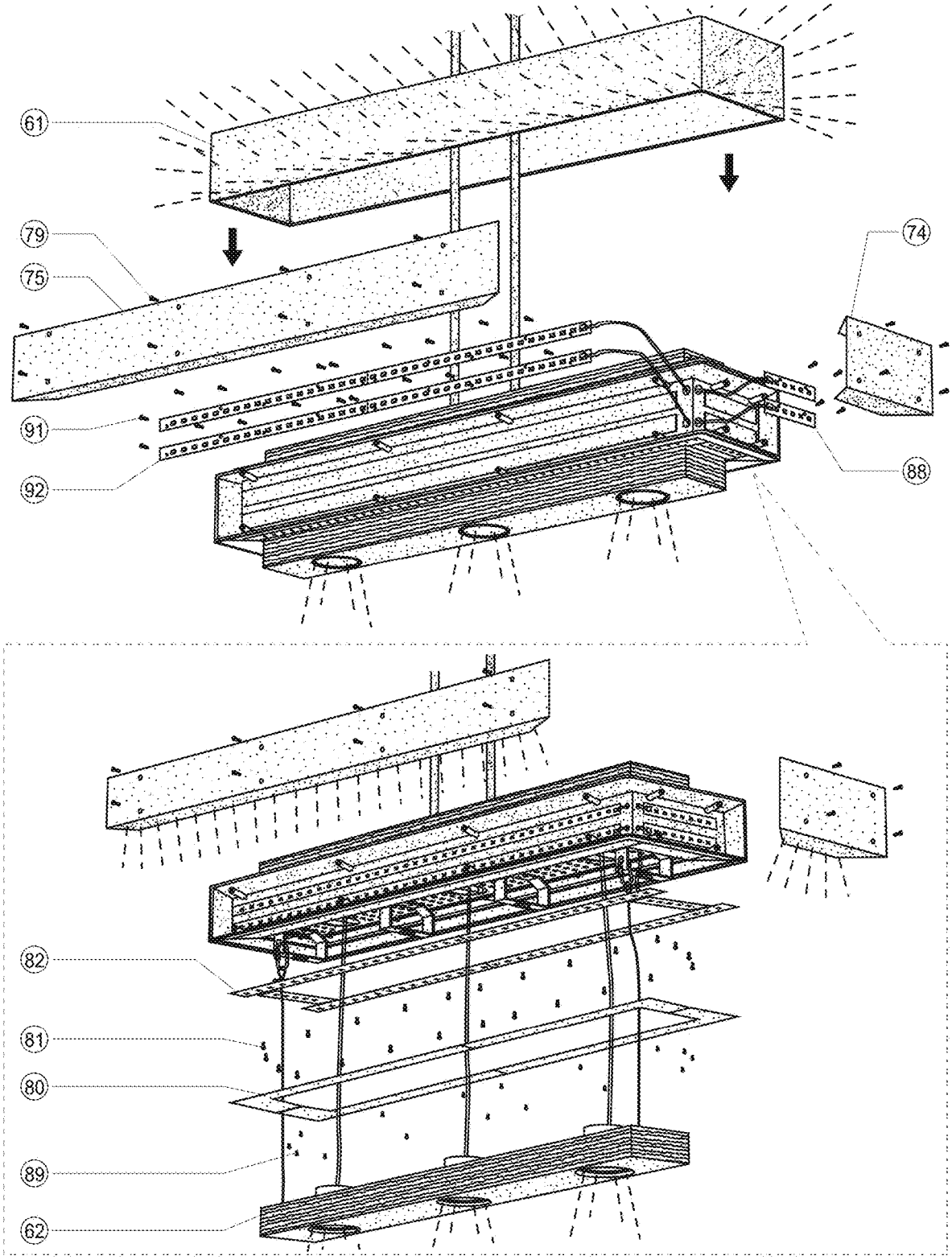
FIG. 67 are exploded views showing ambient, grazing, and down-lighting for the lighting device shown in FIG. 53.
Figure 68:
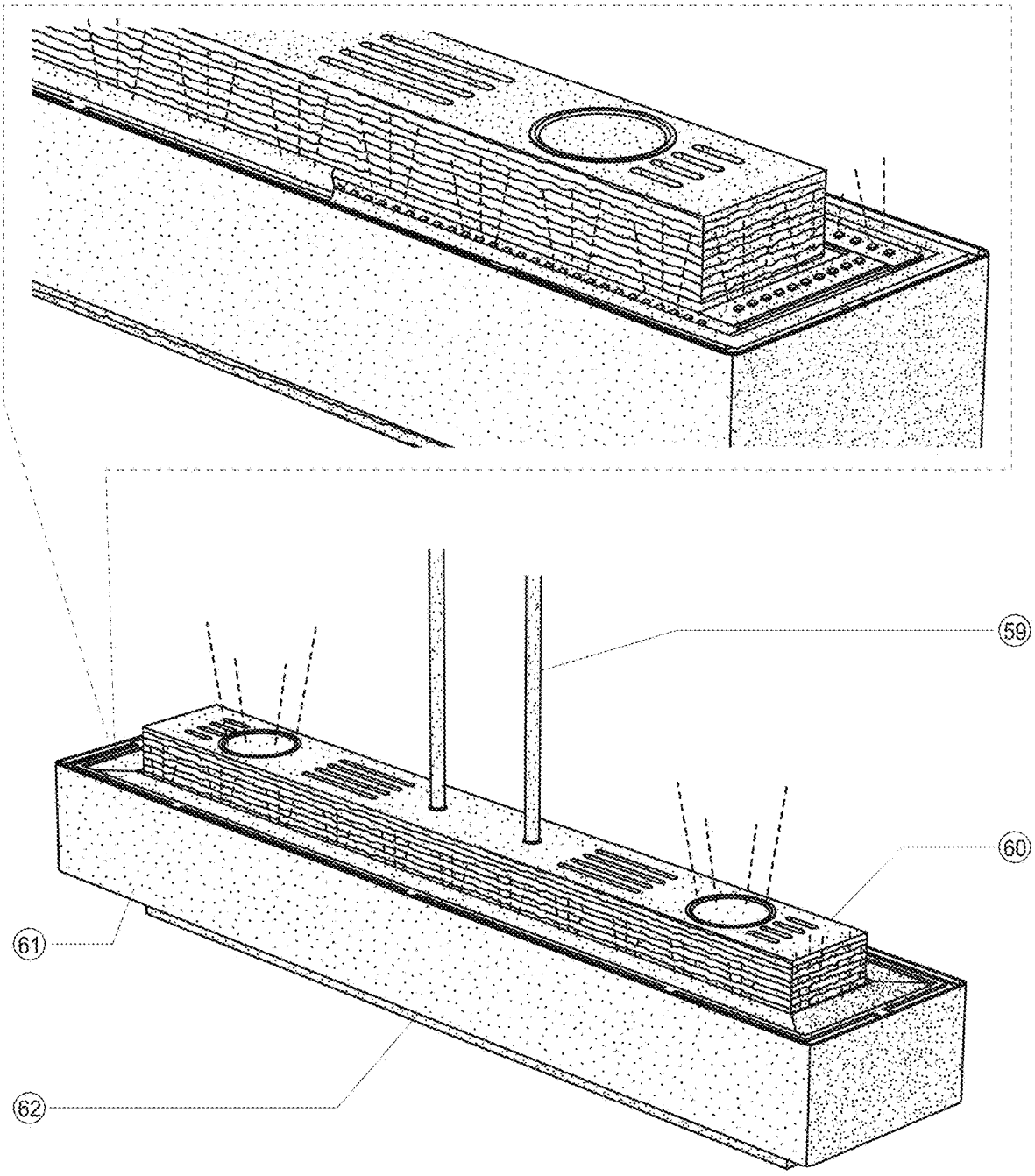
FIG. 68 are top perspective views showing up-lighting and grazing lighting for the lighting device shown in FIG. 53.
Figure 69:
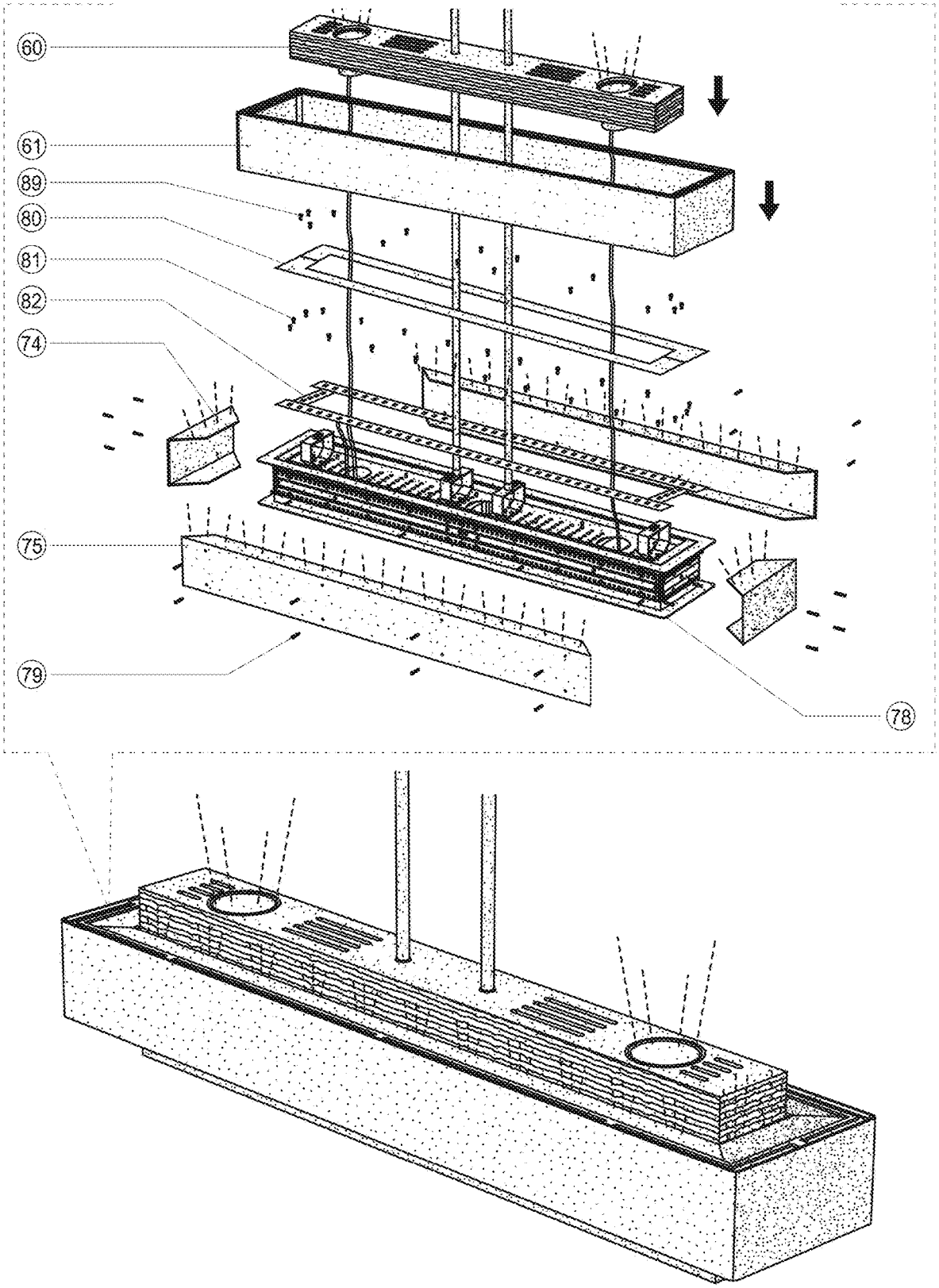
FIG. 69 includes a top perspective view and an exploded perspective view of the lighting device shown in FIG. 53.
Figure 70:
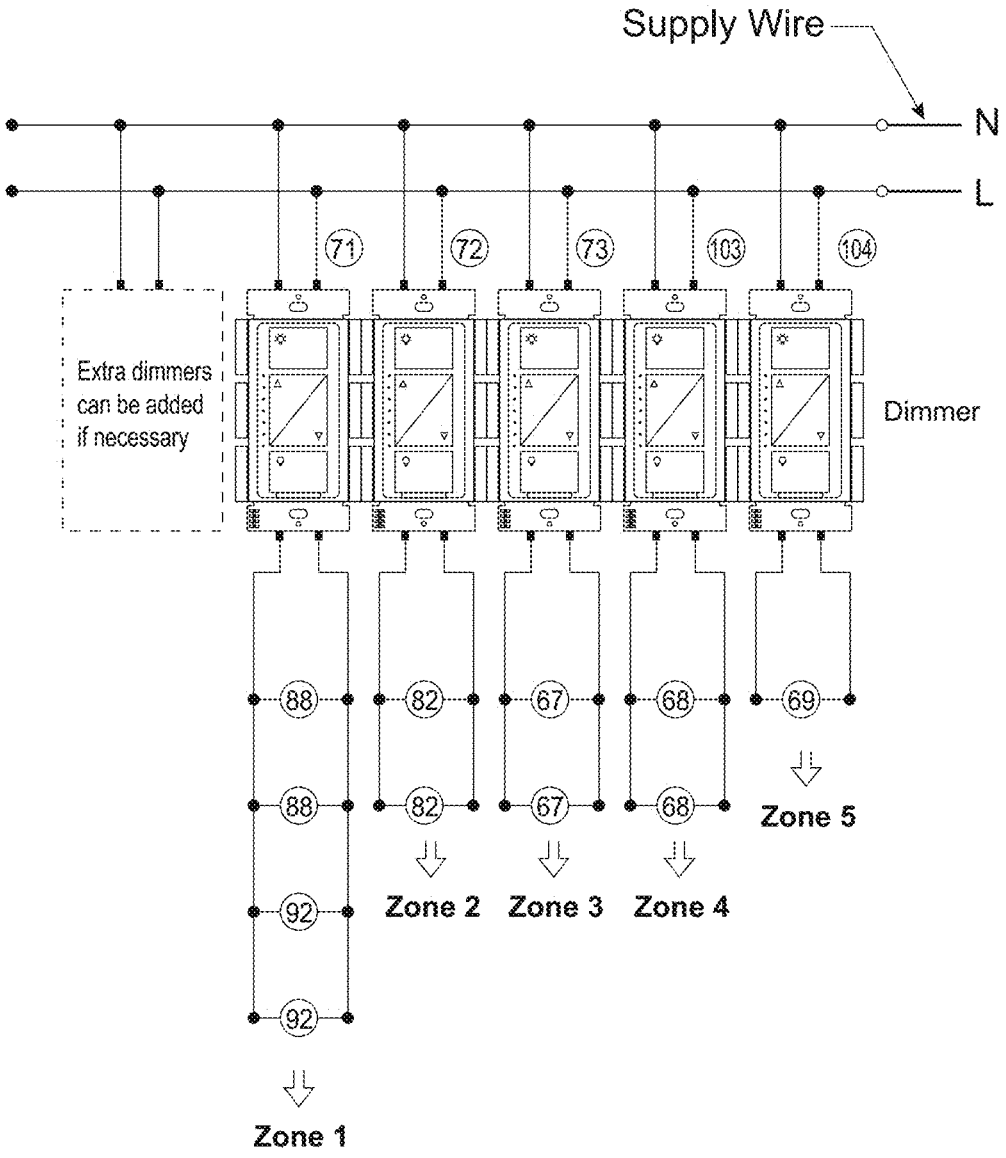
FIG. 70 is a wiring for the lighting device shown in FIG. 53.

Referring to the wiring diagram in FIG. 52, dimmers 39-41 are all connected to the neutral (N) and line/hot wire (L) that extends out of outlet box 43. Light dimmer 41 is coupled to sockets 20 that retain the first set of lights 18 that provide general lighting. Light dimmer 39 is coupled to light source drivers 38 that power the second set of lights 14 that provide the down lighting. Light dimmer 40 is coupled to third set of light source up lights modules 28 that provide indirect up lighting.

FIGS. 53-70 show another example lighting device 202. A rectangle shaped canopy 57 is attached to the ceiling of a room. Swivels 58 attach to canopy 57 and are used on vaulted ceilings lighting device 202 will hang straight. An upper stem 59 is connected between canopy 57 and a rectangle shaped fixture body 78.

An upper cover 60 includes a textured surface that is grazed with lights located on the top of fixture body 78. A translucent shade 61 extends around fixture body 78 and diffuses lights 88 and 92 that are located around the ends and sides of fixture body 78. A lower cover 62 also includes a textured surface that is grazed with lights 82 located on the bottom side of fixture body 78. Reflectors 63 attach around up light bulbs 67 and down light bulbs 68 and 69.

Brackets 65 are attached to the top and bottom sides of fixture body 78 and support the upper or upper and lower covers 60 and 62. Magnet chips 64 hold the upper and lower covers 60 and 62, respectively to brackets 65. A pair of hooks with wires 66 are provided so an installer can hook up wiring without having to hold the weight of cover 62. Lead wires 76 connect dimmers 103 and 104 to sockets 77 that in one example are used for GU 10 light source bulbs 68 and 69.

Up lights 67 are recessed inside of upper cover 60 and are located near the longitudinal ends of fixture body 78 providing up lighting for zone 3. Two down lights 68 are recessed inside of lower cover 62 and located near opposite longitudinal ends of fixture body 78. In one example, a light source module could be used instead of replaceable bulbs 68. Down lights 68 may comprise wide flood light bulbs that together light up a table with a wide area of light for providing zone 4. Down light 69 may comprise a narrow spot bulb for accenting an arrangement or some other object located on a table or floor below fixture 202 and provide lighting zone 5. Of course lights bulbs 68 and 69 may including any combination of flood and spot lighting to light up a table and/or any other objects.

Screws 70 attach rectangle shaped canopy 57 onto a wire box 97 that retains dimmers 71-73, 103, and 104. Dimmer 71 controls ambient lights 88 and 92 for lighting zone 1. As shown in the wiring diagram of FIG. 70, dimmer 72 controls upper and lower grazing lights 82 for lighting zone 2. Dimmer 73 controls up lights 67 for lighting zone 3. Dimmer 74 controls down lights 68 for lighting zone 4 and dimmer 73 controls down light 69 for lighting zone 5.

Diffusers 74 extend over and partially above and below lighting strips 88 attached to ends of fixture body 78. Horizontal top and bottom ends of diffusers 74 also cover the ends of lighting strips 82 that extend around the top and bottom peripheral edges of fixture body 78. lighting strips 82 are used as grazing lights for the textured surfaces on covers 60 and 62. Diffusers 75 extend over and partially above and below long lighting strips 92 that are attached to the lateral long sides of the fixture body 78. Horizontal top and bottom ends of diffusers 75 also cover the long sides of lighting strips 82 that are attached around the top and bottom peripheral edges of fixture body 78.

Fixture body 78 in one example provide the frame for attaching all light sources, diffusers 74 and 75, shade 61, and covers 60 and 62. In one example, fixture body 78 has a substantially elongated rectangular shape with a recessed upper wall, lower wall, end walls and side walls. The recessed side and end walls retain long lighting strips 92 and short lighting strips 88, respectively. The recessed upper and lower walls support upper lights 67 and lower lights 68 and 69, respectively. Upper and lower horizontal ledges extend out and around the periphery of the top and bottom sides of fixture body 78 and retain upper and lower grazing lights 82. Screws 79 attach diffusers 74 and 75 to fixture body 78.

Upper and lower insulation diffusers 80 extend over upper and lower lighting strips 82 that provide upper and lower grazing lighting for lighting zone 2, respectively. Screws 89 attach upper and lower insulation diffusers 80 to the top and bottom sides of fixture body 78. Upper and lower silicon washers 83 attach underneath upper and lower lighting strips 82. Upper and lower aluminum heat plates 84 attach underneath upper and lower silicon washers 83. Screws 81 attach upper and lower lighting strips 82 onto the top and bottom sides of fixture body 78 through upper and lower silicon washers 83 and upper and lower aluminum heat plates 84. Lead wires 85 electrically connect together upper and lower lighting strips 82.

Short aluminum heat plates 86 are attached to opposite ends of fixture body 78 underneathlighting lighting strips 88 that provide ambient lighting for zone 1. Short silicon washers 87 are installed between heat plates 86 and short-lighting strips 88. Front and back long silicon washers 90 are located underneath front and back longlighting strips 92 that provide ambient lighting for lighting zone 1. Front and back aluminum heat plates 98 are attached between silicon washers 90 and the side walls of fixture body 78. Screws 91 attach front and back light source lighting strips 92 to the front and back sides of fixture body 78 through front and back long silicon washers 90 and front and back long aluminum heat plates 98. As mentioned above, long light source lighting strips 92 are attached along the sides of the fixture body 78 to provide zone 1 ambient lighting. Lead wire 93 connects the lighting ambient lighting strips 92 and 88 together.

In various embodiments, each of the lighting strips 82, 88, 92 are light-emitting diode (LED) striplights (also known as an "LED tape" or "ribbon light"). A striplight is a multi-circuit lighting element, comprising one or more rows of lamps and wired internally into a plurality of circuits. The internal circuits may include one or more lamps, and the lamps may be spaced evenly within the strip. An LED strip light is a flexible circuit board populated by surface mounted (SMD) LEDs. In these embodiments, the LED strip lights may be single color, dynamic tunable white, multi-color, Red-Green-Blue (RGB), RGB-White (RGBW), and/or RGB-Warm White (RGBWW) addressable or non-addressable LEDs, RGB Correlated Color Temperature (RGBCCT), and/or the like.

Screws 94 are used for installing fire plate 115 onto wire box 97. Locknut 95 and washer 96 attach swivel 58 to wire box 97. Locknuts 102 and screws 106 attach dimmers 71-73, 103, and 104 to the inside of wire box 97. Wire nuts 105 connect wires from the dimmers to the associated lighting devices.

Wall anchors 107 are embedded in the ceiling. Screws 111 attach fire plate 115 to outlet box 114 and wood screws 112 attach fire plate 115 to wall anchors 107. Ground screw 113 attaches ground wire 101 to fire plate 115.

Fixture line/hot wire (L) 99 and fixture neutral wire (N) 100 connect to dimmer 71 for lighting zone 1, dimmer 72 for lighting zone 2, dimmer 73 for lighting zone 3, dimmer 103 for lighting zone 4, and dimmer 104 for lighting zone 5. Fixture ground wire (G) 101 connects to different locations in the fixture body. Outlet box ground wire (G) 108, outlet box line/hot wire (L) 109, and outlet box neutral wire (N) 110 extend out of outlet box 114 and connect to fixture ground wire (G) 101, fixture line/hot wire (L) 99, and fixture neutral wire (N) 100, respectively.

Lighting device 202 has an elongated fixture body 78 and is alternatively referred to as a linear chandelier 202. A first set of one or more lights 88 and 92 extend along one or more ends and/or elongated sides of fixture body 78 producing ambient light for lighting zone 1. A set of one or more lights 82 extend around the top edge and bottom edge of fixture body 78 producing the grazing lighting for lighting zone 2.

A set of one or more lights 67 extend upward from fixture body 78, produce lighting zone 3, and are not visible when looking at the chandelier from a straight on front view. A set of one or more lights 68 extend down from fixture body 78, produce lighting zone 4, and also are not visible when looking at chandelier 202 from a straight on front view. A set of one or more lights 69 extend down from substantially the bottom center of fixture body 78, produce lighting zone 5, and also are not visible when looking at chandelier 202 from a straight on front view. Lights 68 and/or 69 may include downwardly directed task lights that produce direct and accent lighting and lights 67 may include upwardly directed task lights producing indirect lighting.

Canopy 57 is configured to attach to a ceiling. One or more stems 59 are connected at top ends to canopy 57 and connected at a bottom ends to fixture body 78. Multiple dimmers 71-73, 103, and 104 are located in canopy 57 and are each coupled and independently dim the lights for different associated ones of lighting zones 1-5.

Translucent shade 61 extends around fixture body 78 and covers lights 88 and 92. Upper cover 60 has a textured surface, is attached on a top side of fixture body 78, and surrounds lights 67. Lower cover 62 also has a textured surface, is attached on a bottom side of fixture body 78, and surrounds lights 68 and 69. Upper and lower lights 82 provide grazing lighting for the textured surfaces formed on upper cover 60 and lower cover 62, respectively.

4. Example Implementations

Additional examples of the presently described method, system, and device embodiments include the following, non-limiting configurations. Each of the non-limiting examples may stand on its own, or may be combined in any permutation or combination with any one or more of the other examples provided below or throughout the present disclosure.

Example A01 includes a linear chandelier, comprising: an elongated fixture body; a first set of one or more lights extending along one or more elongated sides or ends of the fixture body producing ambient light; a translucent shade that extends around the fixture body to cover the first set of lights; a second set of one or more lights extending down from the fixture body that are not visible when looking at the chandelier from a straight on front view; a lower cover with a textured surface attached on a bottom side of the fixture body and surrounding the second set of lights; and one or more grazing lights extending around a perimeter of a bottom side of the fixture body producing a grazing light on the textured surface of the lower cover.

Example A02 includes the linear chandelier of example A01 and/or some other example(s) herein, wherein the second set of lights include two downwardly directed flood lights located on opposite ends of the fixture body and at least one spot light located between the two flood lights producing accent lighting.

Example A03 includes the linear chandelier any of examples A01-A02 and/or some other example(s) herein, further comprising: a third set of one or more lights extending upward from the fixture body that are not visible when looking at the chandelier from the straight on front view.

Example A04 includes the linear chandelier of example A03 and/or some other example(s) herein, wherein the third set of lights include upwardly directed task lights producing indirect lighting.

Example A05 includes the linear chandelier any of examples A03-A04 and/or some other example(s) herein, further comprising: multiple dimmers located in the fixture each coupled and independently dimming a different one of the first, second, and third set of lights.

Example A06 includes the linear chandelier any of examples A01-A05 and/or some other example(s) herein, further comprising: an upper cover with a textured surface attached on a top side of the fixture body; and one or more grazing lights extending around a perimeter of a top side of the fixture body producing a grazing light on the textured surface of the upper cover.

Example A07 includes the linear chandelier any of examples A01-A06 and/or some other example(s) herein, wherein the first set of lights include light strips attached to the elongated sides and ends of the fixture body.

Example A08 includes the linear chandelier of example A07 and/or some other example(s) herein, wherein the light strips are Light Emitting Diode (LED) lightstrips.

Example B01 includes a chandelier fixture comprising at least three lighting zones, the at least three lighting zones including a first set of light sources, a second set of light sources, and a third set of light sources; the first set of light sources provide light in at least two opposite outwardly directions from a horizontal plane centered in a middle of the fixture; the second set of light sources provide task lighting below the fixture; and the third set of light sources provide indirect up lighting.

Example B02 includes the chandelier fixture of example B01 and/or some other example(s) herein, further comprising an elongated frame configured to retain at least one of the first, second, and/or third sets of light sources.

Example B03 includes the chandelier fixture of example B02 and/or some other example(s) herein, wherein the first set of light sources extend longitudinally within the frame, and the second set of light sources are directed downward from opposite longitudinal ends of the frame.

Example B04 includes the chandelier fixture any of examples B02-B03 and/or some other example(s) herein, wherein the frame comprises a rectangular boxed shaped cage.

Example B05 includes the chandelier fixture any of examples B01-B04 and/or some other example(s) herein, wherein the first set of light sources provide the light in at least two opposite outwardly directions from the horizontal plane at about 30 degrees around the fixture.

Example B06 includes the chandelier fixture any of examples B01-B05 and/or some other example(s) herein, wherein the first, second, and third sets of light sources are controlled by a remote wireless scene controller removeably mounted in a standard switch box, the remote wireless scene controller configurable to remotely turn the first, second, and third sets of light sources on and off individually, control one or more programmed scenes involving control of individual ones of the first, second, and third sets of light sources.

Example B07 includes the chandelier fixture of example B06 and/or some other example(s) herein, wherein the remote wireless scene controller comprises at least three actuators for controlling respective ones of the first, second, and third sets of light sources.

Example B08 includes the chandelier fixture of example B06 or B07 and/or some other example(s) herein, wherein the chandelier fixture further comprises a first actuator, a second actuator, and a third actuator for controlling the first, second, and third sets of light sources, respectively, and the remote wireless scene controller is configurable to individually control the first, second, and third actuators via wired or wireless control signaling.

Example B09 includes the chandelier fixture any of examples B06-B08 and/or some other example(s) herein, wherein the remote wireless scene controller comprises a button to switch one or more of the first, second, and third sets of light sources on and off.

Example C01 includes a chandelier comprising at least two lighting zones, wherein a first zone of the at least two lighting zones provides general area lighting and a second zone of the at least two lighting zones provides task lighting.

Example C02 includes the chandelier fixture of example C01 and/or some other example(s) herein, wherein the second zone comprises one or more task lighting elements recessed within a frame or body of the chandelier.

Example C03 includes the chandelier fixture of example C02 and/or some other example(s) herein, wherein the one or more task lighting elements are hard wired to a master dimming controller affixed to the fixture.

Example C04 includes the chandelier fixture of example C03 and/or some other example(s) herein, wherein the first zone comprises one or more lighting elements hard wired to the master dimming controller.

Example D01 includes a chandelier comprising at least two zones of lighting that can be controlled by one or more remote controls.

Example E01 includes a light fixture comprising: a fixture body; a first lighting zone including a set of general area lighting elements; a second lighting zone including a set of downlighting elements configured to cast task lighting in a downward direction with respect to the horizontal plane of the fixture body; and a third lighting zone including a set of uplighting lighting elements configured to cast indirect light in an upward direction with respect to the horizontal plane of the fixture body.

Example E02 includes the light fixture of example E01 and/or some other example(s) herein, further comprising: a translucent shade that extends around the fixture body to cover the set of general area lighting elements.

Example E03 includes the light fixture any of examples E01-E02 and/or some other example(s) herein, further comprising: a lower cover with a textured surface attached on a bottom side of the fixture body and surrounding the set of downlighting lighting elements; and one or more grazing lights extending around a perimeter of the bottom side of the fixture body producing a grazing light on the textured surface of the lower cover.

Example E04 includes the light fixture any of examples E01-E03 and/or some other example(s) herein, wherein the set of general area lighting elements are configured to provide the general area lighting in an outwardly in all directions with respect to the horizontal plane of the fixture body.

Example E05 includes the light fixture any of examples E01-E04 and/or some other example(s) herein, wherein the set of downlighting lighting elements include at least two downwardly oriented flood lights located on opposite ends of the fixture body.

Example E06 includes the light fixture of example E05 and/or some other example(s) herein, wherein at least one spot light is positioned between the two flood lights, the at least one spot light configured to provide accent lighting.

Example E07 includes the light fixture any of examples E05-E06 and/or some other example(s) herein, wherein the set of uplighting lighting elements include at least one upwardly directed task lighting element configured to provide indirect lighting.

Example E08 includes the light fixture any of examples E01-E07 and/or some other example(s) herein, further comprising a set of dimmers including: a first dimmer electrically coupled to the set of general area lighting elements in the first lighting zone; a second dimmer electrically coupled to the set of downlighting lighting elements in the second lighting zone; and a third dimmer electrically coupled to the set of uplighting lighting elements in the third lighting zone, and each of the set of dimmers configured to control a brightness of the corresponding set of lighting elements, and the set of dimmers is disposed in or on the fixture body.

Example E09 includes the light fixture of e examples E01-E08 and/or some other example(s) herein, further comprising: an upper cover with a textured surface attached on a top side of the fixture body; and a set of grazing lighting elements extending around a perimeter of the top side of the fixture body, the set of grazing lighting elements configured to provide grazing light on the textured surface of the upper cover.

Example E10 includes the light fixture any of examples E01-E09 and/or some other example(s) herein, wherein the set of general area lighting elements are fixed to elongated sides of the fixture body and one or more ends of the fixture body.

Example E11 includes the light fixture of example E10 and/or some other example(s) herein, wherein the set of general area lighting elements comprise one or more light emitting diode (LED) lightstrips.

Example E12 includes a linear chandelier comprising: three separate compartments, wherein each compartment of the three separate compartments is configured to provide a different zone of lighting, the three separate compartments including: a first compartment housing one or more indirect uplighting elements arranged to provide indirect lighting; a second compartment housing one or more outwardlighting elements arranged to direct light outwardly along a lateral axis of the chandelier; and a third compartment housing one or more task lighting elements arranged to provide task lighting towards each end of the fixture.

Example E13 includes the linear chandelier of example E12 and/or some other example(s) herein, further comprising a substantially solid surface disposed between the second and third compartments.

Example E14 includes the linear chandelier any of examples E12-E13 and/or some other example(s) herein, wherein the one or more task lighting elements are recessed into a substantially solid surface of an underside of the second compartment.

Example E15 includes the linear chandelier any of examples E12-E14 and/or some other example(s) herein, further comprising: a fourth zone of lighting comprising one or more lighting elements disposed in the third compartment, the one or more lighting elements of the fourth zone arranged to provide accent lighting.

Example E16 includes a lighting system, comprising: a first lighting zone comprising a first set of light sources capable of providing light in at least two outwardly lateral directions from a horizontal plane centered in a middle of a light fixture; a second lighting zone comprising a second set of light sources capable of providing task lighting below the light fixture; and a third lighting zone comprising a third set of light sources capable of providing indirect uplighting.

Example E17 includes the lighting system of example E16 and/or some other example(s) herein, further comprising: an elongated frame configured to retain at least one of the first, second, or third sets of light sources.

Example E18 includes the lighting system of example E17 and/or some other example(s) herein, wherein the first set of light sources extend longitudinally within the frame, and the second set of light sources are oriented downward from opposite longitudinal ends of the frame.

Example E19 includes the lighting system of example E18 and/or some other example(s) herein, wherein the light fixture includes a rectangular boxed shaped cage.

Example E20 includes the lighting system any of examples E16-E20 and/or some other example(s) herein, wherein the first set of light sources are capable of providing light in a outwardly direction at 30 degrees with respect to the fixture Example E21 includes the lighting system any of examples E16-E21 and/or some other example(s) herein, wherein the first, second, or third sets of light sources are controllable by a remote wireless scene controller that can mount in a standard switch box, and is capable of storing one or more programmed scenes, each of the one or more programmed scenes indicating a pattern and brightness of individual light sources of one or more of the first, second, and third set of light sources.

Example E22 includes a linear light fixture comprising: an elongated fixture body; general area lighting elements within the linear light fixture, the general area lighting elements configured to provide general area lighting outwardly in at least two lateral directions with respect to a horizontal plane of the fixture body; and a plurality of task lights configured to cast light in a downward direction with respect to the horizontal plane of the fixture body and provide indirect uplighting.

Example E23 includes the lighting system of example E22 and/or some other example(s) herein, further comprising: at least one grazing lighting element of the fixture that has a textured surface and are grazed by one or more lighting elements.

Example E24 includes the lighting system of example E23 and/or some other example(s) herein, wherein the grazing lighting element is parallel to the textured surface.

Example E25 includes the lighting system of example E24 and/or some other example(s) herein, further comprising: two sets of grazing lighting elements, a first set of the two sets of grazing lighting elements oriented to provide uplighting and a second set of the two sets of grazing lighting elements oriented to provide downlighting, and wherein the first set or the second set includes the at least one grazing lighting element.

Example E26 includes the lighting system any of examples E22-E25 and/or some other example(s) herein, further comprising: at least one indirect lighting source attached to a canopy of the chandelier.

Example E27 includes a chandelier comprising: one or more down lights aimed downward and configured to provide task lighting: five or more arms, each arm of the five or more arms including a general area lights; and one or more uplights configured to provide indirect uplighting.

Example E28 includes the chandelier of example E27 and/or some other example(s) herein, wherein at least one uptight of the one or more uplights is centered on the chandelier between a body of the chandelier and a ceiling canopy of the chandelier.

Example E29 includes the chandelier of example E28 and/or some other example(s) herein, further comprising: at least one indirect lighting source on one or more sides of the chandelier.

Example E30 includes the chandelier of example E29 and/or some other example(s) herein, further comprising: at least one indirect lighting source attached to a canopy of the chandelier.

Example E31 includes a lighting system comprising: a plurality of task lights on a first zone, at least two task lights of the plurality of task lights are opposite of each other or opposite at least one task light on a second zone, a plurality of general area lights in between at least two task lights of the plurality of task lights and at least one task light on the third zone.

Example E32 includes the lighting system of example E31 and/or some other example(s) herein, further comprising: at least one grazing light on a fourth zone.

Example E33 includes the lighting system any of examples E32 and/or some other example(s) herein, further comprising: at least one indirect uplight.

Example F01 includes a light fixture comprising: a fixture body; a first lighting zone including a set of general area lighting elements; a second lighting zone including a set of downlighting elements configured to cast task lighting in a downward direction with respect to the horizontal plane of the fixture body; and a third lighting zone including a set of uplighting lighting elements configured to cast indirect light in an upward direction with respect to the horizontal plane of the fixture body and are not visible when looking at the chandelier from a straight on front view.

Example F02 includes the light fixture of example F01 and/or some other example(s) herein, further comprising: a translucent shade that extends around the fixture body to cover the set of general area lighting elements.

Example F03 includes the light fixture any of examples F01-F02 and/or some other example(s) herein, wherein the third lighting zone includes a set of uplighting lighting elements that are not visible when looking at the chandelier from a straight on front view.

Example F04 includes the light fixture of any of examples F01-F03 and/or some other example(s) herein, wherein the light source in the task lights are not visible when looking at the chandelier from a straight on front view.

Example F05 includes a light fixture comprising: a ring shaped lighting fixture frame with a plurality of amiable task lights substantially housed within the ring shaped frame and the set of general area lighting elements.

Example F06 includes the light fixture of example F05 and/or some other example(s) herein, wherein the light fixture has indirect uplighting.

Example F07 includes the light fixture any of examples F01, F05-F06, and/or some other example(s) herein, wherein the set of general area lighting elements are configured to provide the general area lighting in an outwardly in all directions with respect to the horizontal plane of the fixture body.

Example F08 includes a light fixture comprising: a fixture body; a first lighting zone including a set of general area lighting elements; a second lighting zone including a set of downlighting elements configured to cast task lighting in a downward direction with respect to the horizontal plane of the fixture body; and one or more grazing lights extending around a perimeter of the fixture lighting a textured surface.

Example F09 includes the light fixture of example F08 and/or some other example(s) herein, wherein there are two sets of grazing lights are aimed in opposite directions.

Example F10 includes the light fixture of example F09 and/or some other examples) herein, wherein the light fixture has an amiable accent light.

Example F11 includes the light fixture of any of examples F06-F07, F09-F10, and/or some other examples herein, wherein the first, second, or third sets of light sources are controllable by a remote wireless scene controller that can mount in a standard switch box, and is capable of storing one or more programmed scenes, each of the one or more programmed scenes indicating a pattern and brightness of individual light sources of one or more of the first, second, and third zones.

Example F12 includes the light fixture any of examples F05-F07, F09-F11, and/or some other examples herein, wherein at least one accent light is positioned between the two task lights.

Example F13 includes the light fixture any of examples F01-F12 and/or some other examples herein, further comprising a set of dimmers including: a first dimmer electrically coupled to the set of general area lighting elements in the first lighting zone; a second dimmer electrically coupled to the set of downlighting lighting elements in the second lighting zone; and a third dimmer electrically coupled to the set of uplighting lighting elements in the third lighting zone, and each of the set of dimmers configured to control a brightness of the corresponding set of lighting elements, and the set of dimmers is disposed in or on the fixture body.

Example F14 includes the light fixture of any of examples F01-F13 and/or some other examples herein, further comprising: an upper cover with a textured surface attached on a top side of the fixture body; and a set of grazing lighting elements extending around a perimeter of the top side of the fixture body, the set of grazing lighting elements configured to provide grazing light on the textured surface of the upper cover.

Example F15 includes the light fixture any of examples F01-F14 and/or some other examples herein, wherein the set of general area lighting elements are fixed to elongated sides of the fixture body and one or more ends of the fixture body.

Example F16 includes the light fixture of any of examples F01-F15 and/or some other examples herein, wherein the set of general area lighting elements comprise one or more light emitting diode (LED) lightstrips.

Example F17 includes a linear chandelier comprising: three separate compartments, wherein each compartment of the three separate compartments is configured to provide a different zone of lighting, the three separate compartments including: a first compartment housing one or more indirect uplighting elements arranged to provide indirect lighting; a second compartment housing one or more outwardlighting elements arranged to direct light outwardly along a lateral axis of the chandelier; and a third compartment housing one or more task lighting elements arranged to provide task lighting towards each end of the fixture.

Example F18 includes the linear chandelier of example F17 and/or some other examples herein, further comprising a substantially solid surface disposed between the second and third compartments.

Example F19 includes the linear chandelier of example F18 and/or some other examples herein, wherein the one or more task lighting elements are recessed into a substantially solid surface of an underside of the second compartment.

Example F20 includes the linear chandelier of example F19 and/or some other examples herein, further comprising: a fourth zone of lighting comprising one or more lighting elements disposed in the third compartment, the one or more lighting elements of the fourth zone arranged to provide accent lighting.

Example F21 includes a lighting system, comprising: a first lighting zone comprising a first set of light sources capable of providing light in at least two outwardly lateral directions from a horizontal plane centered in a middle of a light fixture; a second lighting zone comprising a second set of light sources capable of providing task lighting below the light fixture; and a third lighting zone comprising a third set of light sources capable of providing indirect uplighting.

Example F22 includes the lighting system of example F23 and/or some other examples herein, further comprising: an elongated frame configured to retain at least one of the first, second, or third sets of light sources.

Example F23 includes the lighting system of example F22 and/or some other examples herein, wherein the first set of light sources extend longitudinally within the frame, and the second set of light sources are oriented downward from opposite longitudinal ends of the frame.

Example F24 includes the lighting system of example F23 and/or some other examples herein, wherein the light fixture includes a rectangular boxed shaped cage.

Example F25 includes the lighting system of any of examples F21-F24 and/or some other examples herein, wherein the first set of light sources are capable of providing light in a outwardly direction at 30 degrees with respect to the fixture.

Example F26 includes the lighting system of any of examples F21-F25 and/or some other examples herein, wherein the first, second, or third sets of light sources are controllable by a remote wireless scene controller that can mount in a standard switch box, and is capable of storing one or more programmed scenes, each of the one or more programmed scenes indicating a pattern and brightness of individual light sources of one or more of the first, second, and third zones.

Example F27 includes a linear light fixture comprising: an elongated fixture body; general area lighting elements within the linear light fixture, the general area lighting elements configured to provide general area lighting outwardly in at least two lateral directions with respect to a horizontal plane of the fixture body; and a plurality of task lights configured to cast light in a downward direction with respect to the horizontal plane of the fixture body and provide indirect uplighting.

Example F28 includes the linear light fixture of example F27, the lighting system of any of examples F21-F25, and/or some other examples herein, wherein a third lighting zone including a set of uplighting elements are not visible when looking at the chandelier from a straight on front view.

Example F29 includes the linear light fixture of any of examples F27-F28 and/or some other examples herein, further comprising: at least one grazing lighting element of the fixture that has a textured surface and are grazed by one or more lighting elements.

Example F30 includes the linear light fixture of example F28 and/or some other examples herein, wherein the grazing lighting element is parallel to the textured surface.

Example F31 includes the linear light fixture of example F28 and/or some other examples herein, further comprising: two sets of grazing lighting elements, a first set of the two sets of grazing lighting elements oriented to provide uplighting and a second set of the two sets of grazing lighting elements oriented to provide downlighting, and wherein the first set or the second set includes the at least one grazing lighting element.

Example F32 includes the linear light fixture of example F27, the lighting system of any of examples F21-F25, and/or some other examples herein, further comprising: at least one indirect lighting source attached to a canopy of the chandelier.

Example F33 includes a chandelier comprising: one or more down lights aimed downward and configured to provide task lighting; and five or more arms, each arm of the five or more arms including a general area lights; and one or more uplights configured to provide indirect uplighting.

Example F34 includes the chandelier of example F33 and/or some other examples herein, further comprising: one or more amiable accent lights.

Example F35 includes the chandelier of any of examples F33-F34 and/or some other examples herein, wherein at least one uptight of the one or more uplights is centered on the chandelier between a body of the chandelier and a ceiling canopy of the chandelier.

Example F36 includes the chandelier of any of examples F34-F35 and/or some other examples herein, further comprising: at least one indirect lighting source on one or more sides of the chandelier.

Example F37 includes the chandelier of example F34 F35 and/or some other examples herein, further comprising: at least one indirect lighting source attached to a canopy of the chandelier.

Example F38 includes a lighting system comprising: a plurality of task lights on a first zone, at least two task lights of the plurality of task lights are opposite of each other or opposite at least one task light on a second zone, a plurality of general area lights in between at least two task lights of the plurality of task lights, and at least one task light on the third zone.

Example F39 includes the lighting system of example F38, the chandelier of any of examples F33-F37, and/or some other examples herein, further comprising: at least one grazing light on a fourth zone.

Example F40 includes the lighting system of any of examples F38-F39, the chandelier of any of examples F33-F37, and/or some other examples herein, further comprising: at least one indirect uplight.

Example F41 includes the lighting system of any of examples F38-F40 and/or some other examples herein, further comprising: indirect lighting on the outside front of the lighting system.

Example F42 includes the lighting system of any of examples F38-F40, the linear light fixture of example F27, and/or some other examples herein, wherein at least one accent light is positioned between the two task lights.

Example F43 includes the lighting system of any of examples F38-F40, the chandelier of any of examples F33-F37, and/or some other examples herein, wherein at least one accent light is amiable.

Example X01 includes a controller configurable or operable to directly control one or more lighting elements of a light fixture, and/or command an appliance that controls the one or more lighting elements of the light fixture.

Example X02 includes the controller of example X01 and/or some other example(s) herein, wherein the controller is hardwired to one or more control elements of the light fixture, the one or more control elements configured to control one or more lighting elements of the light fixture.

Example X04 includes the controller of example X01 and/or some other example(s) herein, wherein the controller is a wireless light controller that directly or indirectly controls the light fixture via wireless signaling.

Example X05 includes the controller of example X04 and/or some other example(s) herein, wherein the controller comprises a radio transmitter (Tx) configured to transmit various control signals to a radio receiver (Rx) that is communicatively coupled to the lighting elements and/or control elements of the light fixture.

Example X06 includes the controller of example X05 and/or some other example(s) herein, wherein the Rx is wired or screwed into the light fixture, wired or otherwise connected to an electrical system of a building to which the light fixture is attached, and/or plugged into an outlet and configured to use existing wiring of the building to which the light fixture is attached.

Example X07 includes the controller any of examples X05-X06 and/or some other example(s) herein, wherein the Rx comprises circuitry that is programmed or configurable by any number of means to respond to selected control elements of the one or more control elements.

Example X08 includes the controller any of examples X05-X07 and/or some other example(s) herein, wherein the are remotely controlled by the controller via the Tx.

Example X09 includes the controller any of examples X05-X08 and/or some other example(s) herein, wherein the controller is embodied as a computing device comprising processor circuitry and memory circuitry communicatively coupled with the Tx.

Example X10 includes the controller of example X09 and/or some other example(s) herein, wherein the memory circuitry comprises any combination of volatile memory, non-volatile memory, and/or data storage.

Example X11 includes the controller any of examples X09-X10 and/or some other example(s) herein, wherein the processor circuitry comprises one or more multi-core processors, one or more microprocessors, and/or one or more microcontrollers.

Example X12 includes the controller any of examples X01-X11 and/or some other example(s) herein, wherein the controller is embodied as a single device such as an integrated circuit, an embedded system, a field-programmable gate array (FPGA), a system-on-a-chip (SoC), an application specific integrated circuit (ASIC), or other integrated system or device.

Example X13 includes the controller any of examples X05-X12 and/or some other example(s) herein, wherein the Tx is configured to use any of one or more radio access technologies and associated protocols (e.g., a cellular networking protocol such a 3GPP 4G or 5G standard, a wireless local area network protocol such as IEEE 802.11/Wi-Fi®, a wireless wide area network protocol, Ethernet, Bluetooth®, Bluetooth Low Energy, a IoT protocol such as IEEE 802.15.4 or ZigBee®, low-power wide-area network (LP-WAN) or low-power wide-area (LPWA) protocols, etc.) to transmit the control signaling.

Example X14 includes the controller any of examples X09-X13 and/or some other example(s) herein, wherein the computing device is a smartphone, a wearable device, a smart appliance, a smart speaker, a network element, or a gateway device.

Example X15 includes the controller any of examples X09-X13 and/or some other example(s) herein, wherein the controller is embodied as a special-purpose light fixture controller or light switch.

Example X16 includes the controller any of examples X09-X13 and/or some other example(s) herein, wherein the memory circuitry is configured to store one or more lighting scenes, the lighting scenes indicate a visual pattern to be provided by the selected ones of the one or more lighting elements.

Example X17 includes the controller of example X16 and/or some other example(s) herein, wherein the visual pattern indicate one or more of activation or deactivation of individual lighting elements, a brightness level of individual lighting elements, a color for individual lighting elements, and/or a blinking rate or flashing rate of individual lighting elements.

Example X18 includes the controller any of examples X16-X17 and/or some other example(s) herein, wherein the controller is configurable or operable to control the one or more control elements and/or the one or more lighting elements according to one of the stored lighting scenes in response to an input from a physical input device, a voice command, or based on preset schedule.

Example X19 includes the controller any of examples X02-X18 and/or some other example(s) herein, wherein the one or more control elements comprise one or more dimmers discussed elsewhere in the present disclosure and/or one or more switches discussed elsewhere in the present disclosure.

Example X20 includes the controller any of examples X01-X19 and/or some other example(s) herein, wherein the light fixture is the light fixture any of examples A01-A08, B01-B09, C01-C04, D01, E01-E32, and/or F01-F43.

5. Definitions and Terminology

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB); that is, A is an optional element. With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

The description may use the terms "embodiment" or "embodiments," which may each refer to one or more of the same or different embodiments. The terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

The terms "lighting scene" or "scene" refer to a group of lighting zones wherein each lighting zone's illumination level is determined by its respective controller or dimmer. Scenes are defined by different combinations of on/off, intensity conditions, and/or fade rates of the zones.

The term "lighting zone" refers to one or more light sources that are commonly controlled. The illumination level of a lighting zone may be commonly controlled by a single dimmer. The light sources of a lighting zone may emit light in a predefined direction and/or at a predefined intensity, or in a predetermined sector or coverage area. A lighting zone can also include one or more mechanical devices such as a motor, for example a motor in a ceiling fan with direction and speed controls.

The term "light fixture" or "luminaire" refers to a complete lighting unit comprising one or more lamps, light sources, or light emitting elements, together with the parts designed to distribute the light, to position and protect the lamps/light sources/light emitting elements, and to connect the lamps/light sources/light emitting elements to a power supply.

The term "light source" refers to natural and artificial processes that emit light. For purposes of the present disclosure, a "light source" refers to an individual lamp or a collection of lamps that produces light. The term "lamp" is a replaceable component that produces light, and may also be referred to as a "light emitting element." Lamps may produce light based on incandescence and/or luminescence.

The term "incandescence" refers to the emission of light from a hot body as a result of its temperature. Examples of incandescent lamps include, but are not limited to incandescent light bulbs, halogen lamps/bulbs combustion-based lamps such as kerosene lamps, Acetylene/Carbide lamps, and/or the like. The term "luminescence" refers to the emission of light by a substance not resulting from heat. Examples of luminescent lamps include, but are not limited to fluorescent lamps, fluorescent induction, photoluminescent (laser lamp), chemiluminescent, solid-state (LED bulb), cathodoluminescent (electron-stimulated), electroluminescent (field-induced polymer), gas discharge means (e.g., deuterium arc lamps, neon lighting, plasma (sulfur) lamps, xenon arc lamps, xenon flash tubes, etc.), ultraviolet light lamps (e.g., Blacklights), high-intensity discharge (HID) elements (e.g., mercury vapor lamps, metal-halide lamps, etc.), Illuminescent lamps also includes electroluminescent light emitting elements, which are based on an electric current flowing through a substance, and may include, for example, light emitting diodes (LEDs) and variants thereof (e.g., organic LEDs, polymer LEDs, AMOLEDs, etc.), electroluminescent wires, field-induced polymer electroluminescent (FIPEL) technology, lasers, and/or the like.

The term "general area lighting" or "general lighting" refers to the general illumination of an area including providing light without concern for directing the light in any specific direction, and/or lighting a general area without placing any focus on any features in the area.

The term "ambient lighting" refers to providing general, diffuse illumination for a space, and is appropriate for activities that are not visually demanding. Sometimes the terms "ambient lighting" and "general lighting" may be used interchangeably.

The term "task lighting" refers to providing increased light or illuminance for specific tasks or activities in a room that may or may not already have some ambient light, and/or providing increased light or illuminance to a specific surface such as a table (or portion of a table), a rug, or the like. Task lighting is can be useful for seeing small objects or objects of low contrast.

The term "accent lighting" or "highlighting" refers to providing is light directed narrowly at a specific object. Accent lighting is mainly decorative and usually intended to highlight a specific object.

The term "grazing lighting" refers to providing light that is reflected from a source placed close to a surface, usually to emphasize the texture of the surface.

The term "indirect lighting" refers to providing light in an indirect manner where light spreads via reflection or the like. With indirect lighting, the source of light is hidden and the light spreads through the room via reflection on the ceiling, floor, or wall, as such eliminating dazzle and shadows.

The term "downlighting" refers to casting light in a downward direction.

The term "uplighting" refers to casting light in an upward direction.

The term "outwardlighting" refers to casting light in an outward direction, in a lateral direction, and/or in a longitudinal direction.

The term "lateral" refers to directions or positions relative to an object spanning the width of a body of the object, relating to the sides of the object, and/or moving in a sideways direction with respect to the object.

The term "longitudinal" refers to directions or positions relative to an object spanning the length of a body of the object; relating to the top or bottom of the object, and/or moving in an upwards and/or downwards direction with respect to the object.

The term "linear" refers to directions or positions relative to an object following a straight line with respect to the object, and/or refers to a movement or force that occurs in a straight line rather than in a curve.

The term "lineal" refers to directions or positions relative to an object following along a given path with respect to the object, wherein the shape of the path is straight or not straight.

The term "lighting scene" or "scene" refers to

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. The term "coupled" as used herein may mean that two or more elements are in direct physical or electrical contact. However, "coupled" may also mean that two or more elements are not in direct contact with each other, but yet still cooperate or interact with each other. The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

The term "fabrication" refers to the creation of a metal structure using fabrication means. The term "fabrication means" as used herein refers to any suitable tool or machine that is used during a fabrication process and may involve tools or machines for cutting (e.g., using manual or powered saws, shears, chisels, routers, torches including handheld torches such as oxy-fuel torches or plasma torches, and/or computer numerical control (CNC) cutters including lasers, mill bits, torches, water jets, routers, etc.), bending (e.g., manual, powered, or CNC hammers, pan brakes, press brakes, tube benders, roll benders, specialized machine presses, etc.), assembling (e.g., by welding, soldering, brazing, crimping, coupling with adhesives, riveting, using fasteners, etc.), and/or molding or casting (e.g., die casting, centrifugal casting, injection molding, extrusion molding, matrix molding, and three-dimensional (3D) printing techniques including fused deposition modeling, selective laser melting, selective laser sintering, composite filament fabrication, fused filament fabrication, stereolithography, directed energy deposition, electron beam freeform fabrication, etc.).

The term "fastener", "fastening means", or the like refers to device that mechanically joins or affixes two or more objects together, and may include threaded fasteners (e.g., bolts, screws, nuts, threaded rods, etc.), pins, linchpins, r-clips, clips, pegs, clamps, dowels, cam locks, latches, catches, ties, hooks, magnets, molded or assembled joineries, swivels, hinges, and/or the like components/devices for coupling two elements. The term "swivel" or "swiveling means" refers to a coupling between two parts enabling one to revolve without turning the other. The term "hinge" or "hinging means" refers to a movable joint or mechanism on which one element (e.g., a door, gate, or lid) swings as it opens and closes and/or which connects linked objects.

Having described and illustrated the principles of the invention in various embodiments thereof, it should be apparent that the invention can be modified in arrangement and detail without departing from such principles. I claim all modifications and variations coming within the spirit and scope of the following claims.

The invention claimed is:

1. A light fixture comprising:

a fixture body;

a first lighting zone including a set of general area lighting elements within the light fixture, the set of general area lighting elements configured to provide general area lighting outwardly in at least two lateral directions with respect to a horizontal plane of the fixture body;

a second lighting zone including a set of downlighting elements configured to cast task lighting in a downward direction with respect to the horizontal plane of the fixture body and provide indirect uplighting;

a third lighting zone including a set of uplighting lighting elements configured to cast indirect light in an upward direction with respect to the horizontal plane of the fixture body and are not visible when looking at the chandelier from a straight on front view; and two sets of grazing lighting elements including:

a first set of the two sets of grazing lighting elements oriented to provide uplighting, and a second set of the two sets of grazing lighting elements oriented to provide downlighting, the first set or the second set includes at least one grazing lighting element having a textured surface and is grazed by one or more lighting elements, and the at least one grazing lighting element is parallel to the textured surface.

2. The light fixture of claim 1, further comprising:

a translucent shade that extends around the fixture body to cover the set of general area lighting elements.

3. The light fixture of claim 1, wherein the third lighting zone includes a set of uplighting lighting elements that are not visible when looking at the chandelier from a straight on front view.

4. The light fixture of claim 1, wherein the light source in the task lights are not visible when looking at the chandelier from a straight on front view.

5. The light fixture of claim 1, further comprising a set of dimmers including:

a first dimmer electrically coupled to the set of general area lighting elements in the first lighting zone;

a second dimmer electrically coupled to the set of downlighting lighting elements in the second lighting zone; and a third dimmer electrically coupled to the set of uplighting lighting elements in the third lighting zone, and each of the set of dimmers configured to control a brightness of the corresponding set of lighting elements, and the set of dimmers is disposed in or on the fixture body.

6. The light fixture of claim 1, further comprising:

an upper cover with a textured surface attached on a top side of the fixture body, wherein at least one set of grazing lighting elements of the two sets of grazing lighting elements extend around a perimeter of the top side of the fixture body, the at least one set of grazing lighting elements configured to provide grazing light on the textured surface of the upper cover.

7. The light fixture of claim 1, wherein the set of general area lighting elements are fixed to elongated sides of the fixture body and one or more ends of the fixture body.

8. The light fixture of claim 7, wherein the set of general area lighting elements comprise one or more light emitting diode (LED) lightstrips.

9. A light fixture comprising:

a fixture body;

a first lighting zone including a set of general area lighting elements within the light fixture, the set of general area lighting elements configured to provide general area lighting outwardly in at least two lateral directions with respect to a horizontal plane of the fixture body;

a second lighting zone including a set of downlighting elements configured to cast task lighting in a downward direction with respect to the horizontal plane of the fixture body and provide indirect uplighting a third lighting zone including at least two sets of grazing lights including:

a first set of the at least two sets of grazing lighting elements oriented to provide uplighting, and a second set of the at least two sets of grazing lighting elements oriented to provide downlighting, and wherein:

one or both of the first set or the second set extends around a perimeter of the fixture body, and one or both of the first set or the second set includes one or more grazing lights configured to light a textured surface, and the one or more grazing lights are parallel to the textured surface.

10. The light fixture of claim 9, wherein grazing lights of a first set of the at least two sets of grazing lights are aimed in opposite directions as at least one grazing light of a second set of the at least two sets of grazing lights.

11. The light fixture of claim 9, wherein the light fixture has an amiable accent light.

12. The light fixture of claim 9, wherein the first, second, or third sets of light sources are controllable by a remote wireless scene controller that can mount in a standard switch box, and is capable of storing one or more programmed scenes, each of the one or more programmed scenes indicating a pattern and brightness of individual light sources of one or more of the first, second, and third set of light sources.

13. A linear chandelier comprising:

three separate compartments, wherein each compartment of the three separate compartments is configured to provide a different zone of lighting, the three separate compartments including:

a first compartment housing one or more indirect uplighting elements arranged to provide indirect lighting;

a second compartment housing one or more general area lighting elements arranged to provide light without concern for directing the light in any specific direction; and a third compartment housing one or more task lighting elements arranged at each end of the linear chandelier to provide task lighting in a downward direction.

14. The linear chandelier of claim 13, further comprising a substantially solid surface disposed between the second and third compartments.

15. The linear chandelier of claim 14, wherein the one or more task lighting elements are recessed into a substantially solid surface of an underside of the third compartment.

16. The linear chandelier of claim 15, further comprising:

a fourth zone of lighting comprising one or more lighting elements disposed in the third compartment, the one or more lighting elements of the fourth zone arranged to provide accent lighting.

17. A lighting system, comprising:

a first lighting zone comprising a first set of light sources capable of providing general area light in at least two outwardly lateral directions from a horizontal plane centered in a middle of a light fixture;

a second lighting zone comprising a second set of light sources capable of providing task lighting below the light fixture and providing indirect uplighting; and a third lighting zone comprising a third set of light sources capable of providing indirect uplighting, the third set of light sources including at least two sets of grazing light sources including:

a first set of the at least two sets of grazing light sources oriented to provide uplighting, and a second set of the at least two sets of grazing light sources oriented to provide downlighting, the first set or the second set includes at least one grazing light source parallel to the textured surface and grazed by one or more other light sources.

18. The lighting system of claim 17, further comprising: an elongated frame configured to retain at least one of the first, second, or third sets of light sources.

19. The lighting system of claim 18, wherein the first set of light sources extend longitudinally within the frame, and the second set of light sources are oriented downward from opposite longitudinal ends of the frame.

20. The lighting system of claim 19, wherein the light fixture includes a rectangular boxed shaped cage.

21. The lighting system of claim 17, wherein the first set of light sources are capable of providing light in a outwardly direction at 30 degrees with respect to the fixture.

22. The lighting system of claim 17, wherein the first, second, or third sets of light sources are controllable by a remote wireless scene controller that can mount in a standard switch box, and is capable of storing one or more programmed scenes, each of the one or more programmed scenes indicating a pattern and brightness of individual light sources of one or more of the first, second, and third zones.

23. A linear light fixture comprising:

an elongated fixture body;

general area lighting elements within the linear light fixture, the general area lighting elements configured to provide general area lighting outwardly in at least two lateral directions with respect to a horizontal plane of the fixture body; and a plurality of task lights including a first set of task lights configured to cast light in a downward direction with respect to the horizontal plane of the fixture body, and a second set of task lights configured to cast light in an upward direction with respect to the horizontal plane of the fixture body, wherein at least some task lights in the first set of task lights are arranged at each end of the elongated fixture body, and at least some task lights in the second set of task lights are arranged at each end of the elongated fixture body.

24. The linear light fixture of claim 23, wherein a third lighting zone including a set of uplighting elements are not visible when looking at the linear light fixture from a straight on front view.

25. The linear light fixture of claim 23, further comprising:

at least one grazing lighting element that has a textured surface and is grazed by one or more lighting elements.

26. The linear light fixture of claim 25, wherein the at least one grazing lighting element is parallel to the textured surface.

27. The linear light fixture of claim 23, further comprising:

at least one indirect lighting source attached to a canopy of the linear light fixture.

28. A linear light fixture comprising:

an elongated fixture body;

general area lighting elements within the linear light fixture, the general area lighting elements is configured to provide general area lighting outwardly in at least two lateral directions with respect to a horizontal plane of the fixture body;

a plurality of task lights configured to cast light in a downward direction with respect to the horizontal plane of the fixture body and provide indirect uplighting;

at least one grazing lighting element that has a textured surface and is grazed by one or more lighting elements, wherein the at least one grazing lighting element is parallel to the textured surface; and two sets of grazing lighting elements, wherein a first set of the two sets of grazing lighting elements is oriented to provide uplighting and a second set of the two sets of grazing lighting elements is oriented to provide downlighting, and wherein the first set or the second set includes the at least one grazing lighting element.

29. A chandelier comprising:

one or more down lights aimed downward and configured to provide task lighting; and five or more arms, each arm of the five or more arms including a set of general area lights;

one or more uplights configured to provide indirect uplighting; and at least two sets of grazing lights, the at least two sets of grazing lights including a first set of the at least two sets of grazing light sources oriented to provide uplighting, and a second set of the at least two sets of grazing light sources oriented to provide downlighting, the first set or the second set includes at least one grazing light source parallel to a textured surface and grazed by one or more other light sources.

30. The chandelier of claim 29, further comprising: one or more amiable accent lights.

31. The chandelier of claim 29, wherein at least one uplight of the one or more uplights is centered on the chandelier between a body of the chandelier and a ceiling canopy of the chandelier.

32. The chandelier of claim 29, further comprising:

at least one indirect lighting source on one or more sides of the chandelier.

33. The chandelier of claim 29, further comprising:

at least one indirect lighting source attached to a canopy of the chandelier.

34. A lighting system comprising:

a plurality of task lights on a first zone, at least two task lights of the plurality of task lights are opposite of each other or opposite to at least one task light on a second zone;

a plurality of general area lights in between at least two task lights of the plurality of task lights and at least one task light on a third zone; and at least two sets of grazing lights forming a fourth zone, the at least two sets of grazing lights including a first set of the at least two sets of grazing light sources oriented to provide uplighting, and a second set of the at least two sets of grazing light sources oriented to provide downlighting, the first set or the second set includes at least one grazing light source parallel to a textured surface and grazed by one or more other light sources.

35. The lighting system of claim 34, further comprising:

at least one indirect uplight.

36. The lighting system of claim 34, further comprising:

indirect lighting on an outside of a front portion of the lighting system.

37. The lighting system of claim 34, wherein at least one accent light is positioned between the at least two task lights.

38. The lighting system of claim 37, wherein at least one accent light is amiable.

* * * * *